United States Patent [19]

Nukaga et al.

[11] Patent Number: 5,038,586

[45] Date of Patent: Aug. 13, 1991

[54] WASHING MACHINE

[75] Inventors: Tadashi Nukaga; Kentaro Mochizuki; Shinji Yamaguchi; Yoshikazu Banba, all of Otsu, Japan

[73] Assignee: Sanyo Electric Co., Ltd., Osaka, Japan

[21] Appl. No.: 488,237

[22] Filed: Mar. 1, 1990

[30] Foreign Application Priority Data

Mar. 28, 1989 [JP] Japan ..... 1-76925
Sep. 12, 1989 [JP] Japan ..... 1-236231

[51] Int. Cl.[5] ..... D06F 33/00

[52] U.S. Cl. ..... 68/12.01; 68/15; 68/23.5; 68/183; 68/207; 68/208

[58] Field of Search ..... 68/12 R, 15, 23.5, 183, 68/207, 208

[56] References Cited

U.S. PATENT DOCUMENTS 4,410,329 10/1983 Blevins et al. ..... 68/12 R X

FOREIGN PATENT DOCUMENTS 2998 1/1980 Japan .
119195 7/1984 Japan .

*Primary Examiner*—Philip R. Coe
*Attorney, Agent, or Firm*—Darby & Darby

[57] ABSTRACT

A washing machine comprises a drum rotating device, a water supplying device, a draining device, a sensing device for sensing excessive foam generated beyond a permissible amount in an outer tub of the washing machine in the washing operation, and a control device for controlling the drum rotating device, the water supplying device and the draining device. In this washing machine, the sensing device would sense the abnormal foaming in the washing operation and inputs a foam sensing signal to the control device. Then, the control device forces the water supplying device to supply water in the tub and/or the draining device to drain the tub so as to settle the abnormal foaming.

19 Claims, 52 Drawing Sheets

United States Patent Office

PTO - BOYERS, PA Duty Station

MISSING PAGE TEMPORARY NOTICE

PATENT # 5038586 FOR ISSUE DATE 8-13-91

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

DRAWING SHEET # 38

Data Conversion Operation

Boyers, Pa

WASHING MACHINE

BACKGROUND OF THE INVENTION (i) Field of the Invention

The present invention relates to a washing machine and, more particularly, it relates to a washing machine which comprises an outer tub supported in a frame, and a drum rotatably held about a horizontal supporting shaft in the tub and formed with many bores in its peripheral wall and which is capable of sensing foam generated beyond a permissible amount in the tub in washing the laundry.

(ii) Description of the Prior Art

In a conventional drum washing machine, since the rotation of a drum violently agitates washing water including detergent, foam is generated in a tub. When the foam is excessively generated, it impedes the drum from rotating, and the foam remaining in the tub pollutes rinsing water. Japanese Unexamined Patent Application No. 118195/1984 discloses a drum washing machine. The drum washing machine comprises an outer tub supported in a frame, a drum rotatably held about a horizontal supporting shaft in the tub and formed with many bores in its peripheral wall, rotating means for rotating the drum and sensing means for sensing foam generated beyond a permissible amount in the tub in washing the laundry.

The sensing means senses the foaming in washing the laundry and raises an alarm to urge the user to dilute washing water.

A float is used for the sensing means. When the float is raised by the foam, a sensing switch works.

However, in this prior art embodiment, the user must laboriously manage the defoaming whenever foam is excessively generated. In this case, the defoaming requires only diluting washing water, and thus water in the tub increases. As a result, although the rotation of the drum causes the laundry to beat the wall of the drum, the laundry float in the increased washing water, and hence the desired result of the beating is not obtained.

Although the float is used for the sensing means, the float requires considerable foam to rise. Thus, foaming must be in a fairly advanced stage to be sensed.

It is known that a pair of electrodes can be used for the sensing means utilizing the conduction between those electrodes. However, contrary to using the float, the electrodes become conductive even with a small quantity of foam or water, so that the use of them leads to a large error. Additionally, the electrodes are easily soiled, and therefore the accuracy in sensing is reduced as time elapses.

SUMMARY OF THE INVENTION

Accordingly, it is an object of the present invention to provide a washing machine comprising an outer tub supported in a frame, water supplying means for supplying water to the tub, draining means for draining the tub, a drum rotatably supported about a horizontal supporting shaft in the tub and formed with many bores in its peripheral wall, drum rotating means for rotating the drum, sensing means for sensing foam generated beyond a permissible amount in the tub in washing the laundry, and means for settling foaming in response to a foam sensing signal from the sensing means.

In short, the present invention provides a drum washing machine characterized by including the sensing means for sensing foam generated beyond the permissible amount in the tub; and control means for controlling the drum rotating means, the water supplying means and the draining means. When the foam sensing signal is received from the sensing means in washing the laundry, the control means acts to instruct the supplying means and/or the draining means to supply water to the tub and/or drain the tub.

In this way, defoaming can be assuredly done without much labor. Further, the result which is obtained by the laundry beating the wall of the drum is not lost.

Preferably in order to effectively defoam, in addition to practicing the above-mentioned water supply and/or drainage, the drum is controlled, for example, to temporarily stop and to rotate at low speed, and means for heating water and means for blowing air are provided.

As the foam sensing means, for example, sensing means which comprises an overflow chamber formed in the wall of the outer tub, communicating with a drain pipe and having a pair of electrodes in the overflow chamber is used instead of the above-mentioned prior art float.

The order of supplying water to the tub and draining the tub is arbitrary, and both the supply and drainage may be carried out simultaneously.

"Water supply and/or drainage" in this invention means supplying water to the tub by the above-mentioned supplying means and/or draining the tub by the above-mentioned draining means. Also, "washing" means cleaning processes such as washing, rinsing, hydroextracting and drying in bloc. A concept of "a washing machine" herein includes a machine practicing all or one of the above-mentioned cleaning processes.

BRIEF DESCRIPTION OF THE DRAWINGS

FIG. 26 is a perspective view showing an inner surface of a drum;

FIG. 27 is a perspective view showing a bulging member; and

FIG. 28 is a perspective view showing a drum;

FIG. 29(*a*) is a view showing the portion in hydroextracting operation; and

FIG. 29(*b*) is a view showing the portion in drying operation;

FIGS. 48 to 53 are flow charts showing different embodiments of the abnormal foam managing program;

DETAILED DESCRIPTION OF THE PREFERRED EMBODIMENTS

Figure 1:
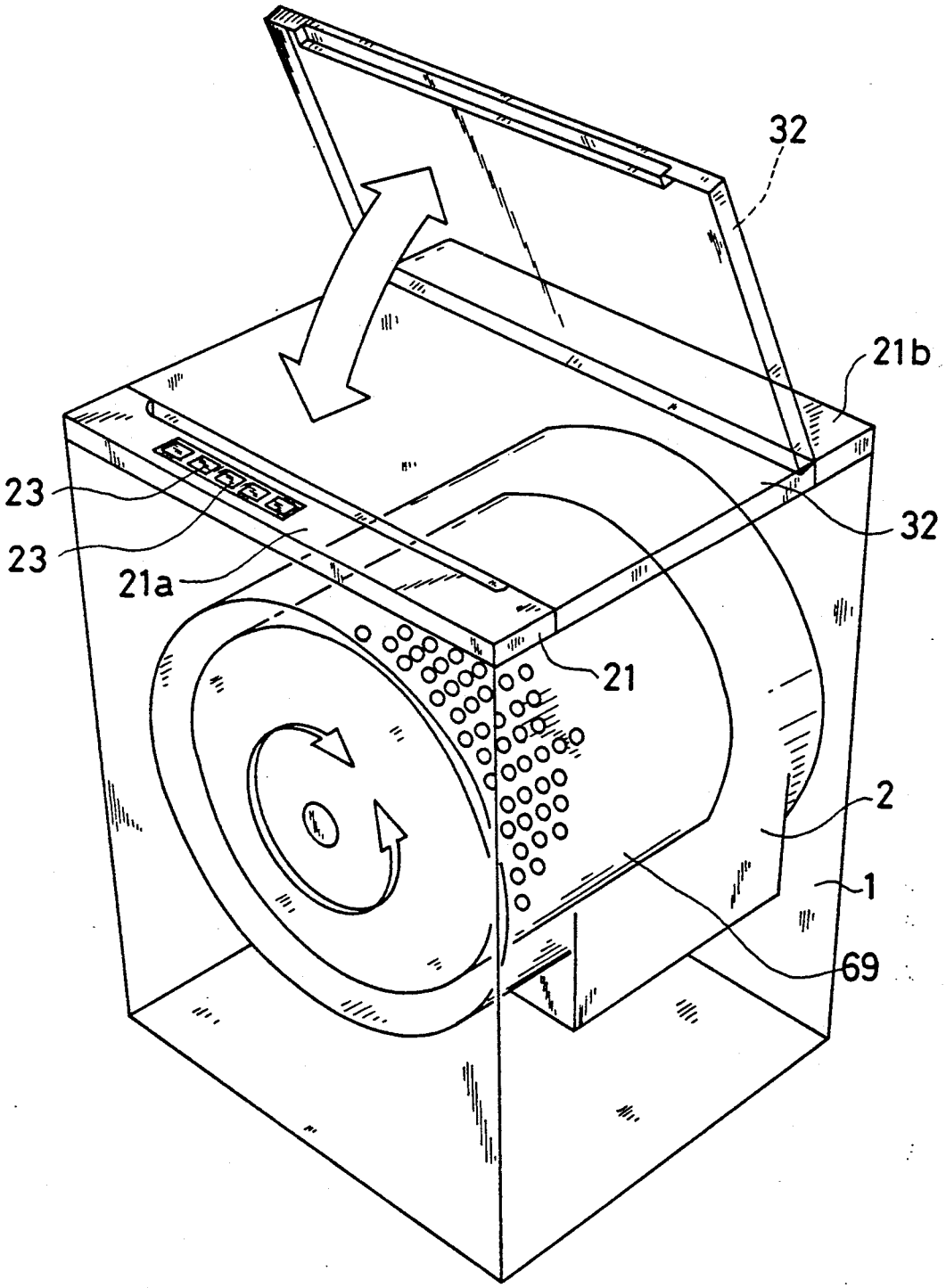
FIG. 1 is a perspective view showing a washing machine according to the present invention.
Figure 2:
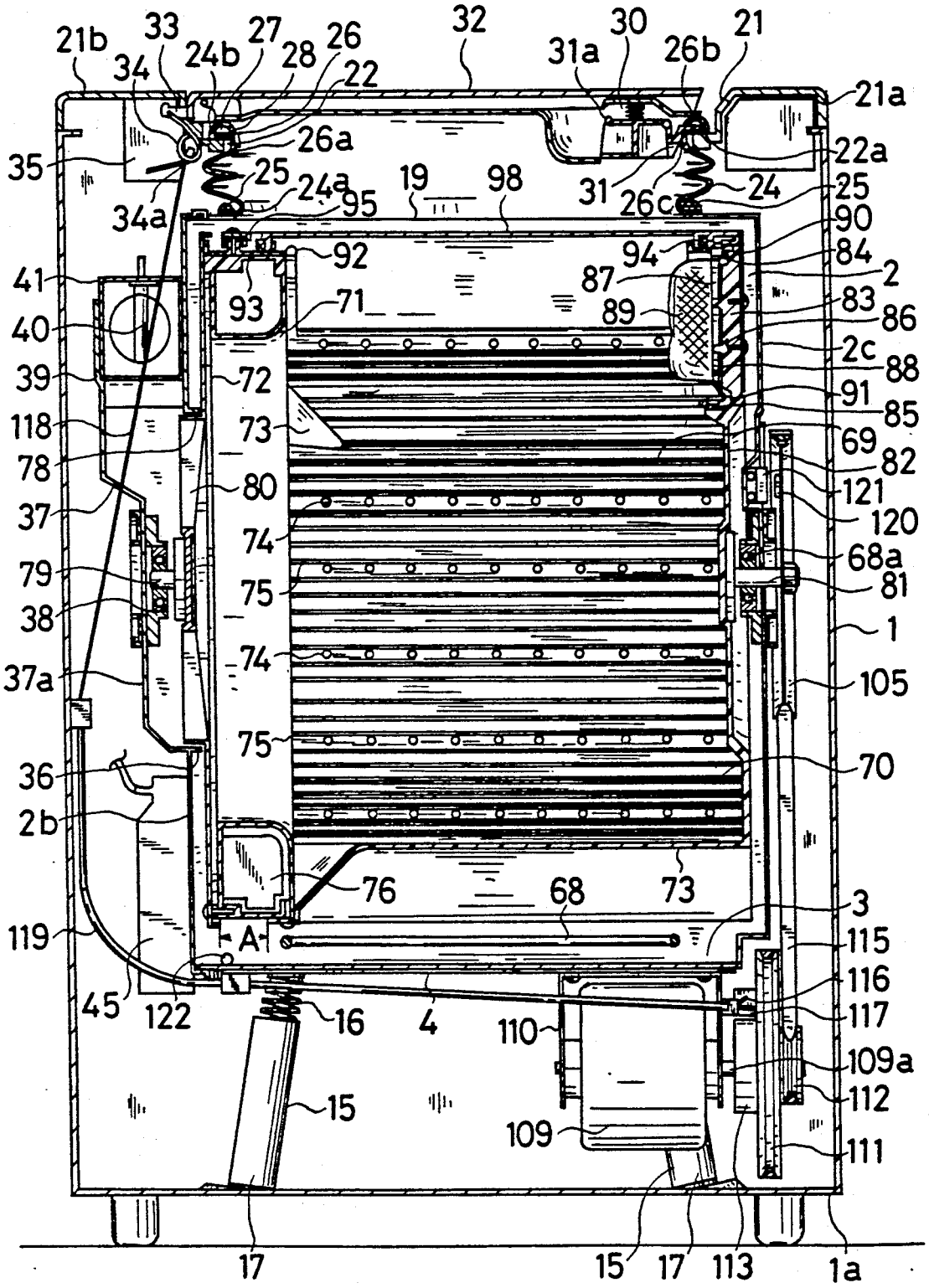
FIG. 2 is a sectional side view showing the washing machine.
Figure 3:
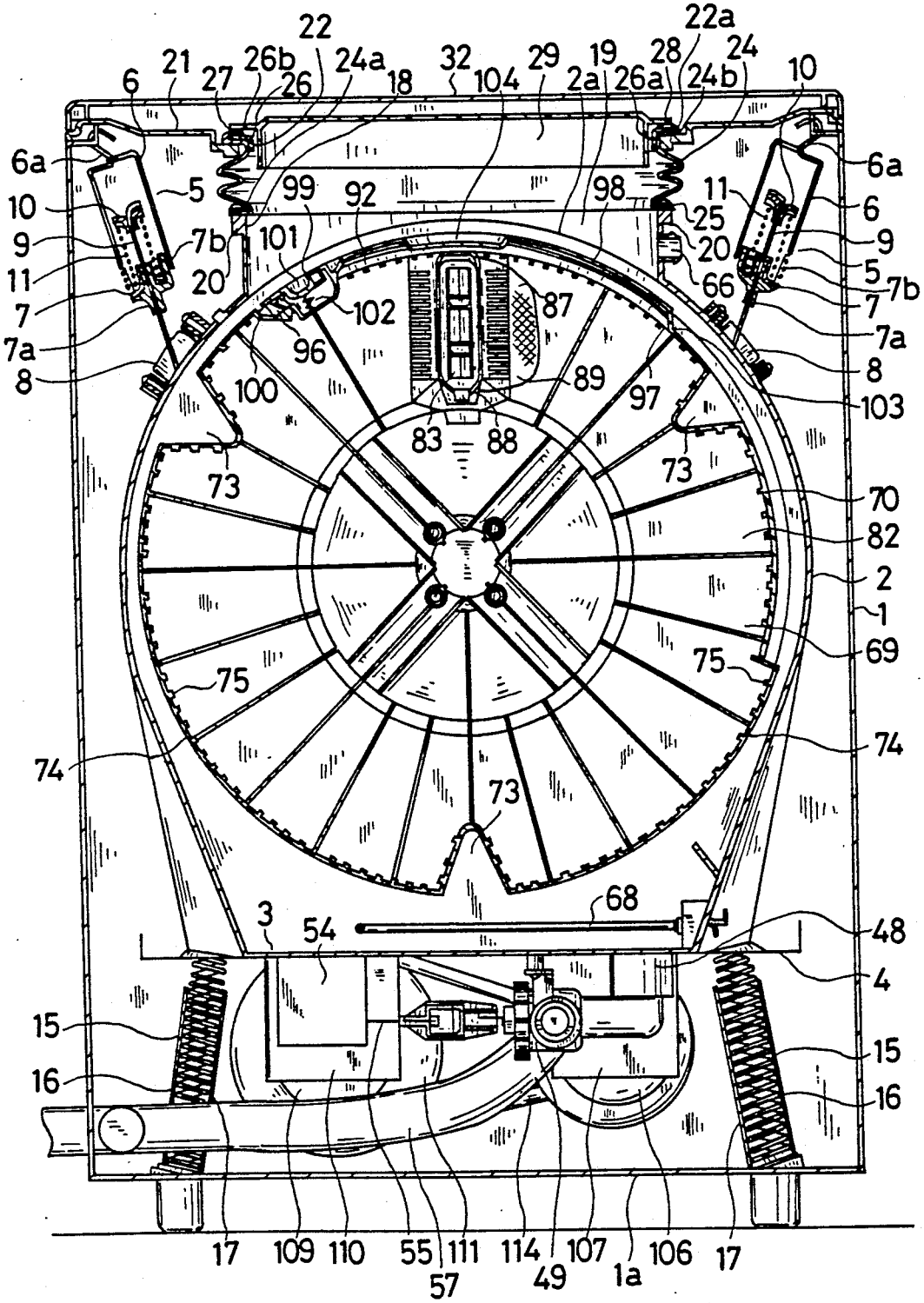
FIG. 3 is a rear elevation view showing the washing machine.
Figure 4:
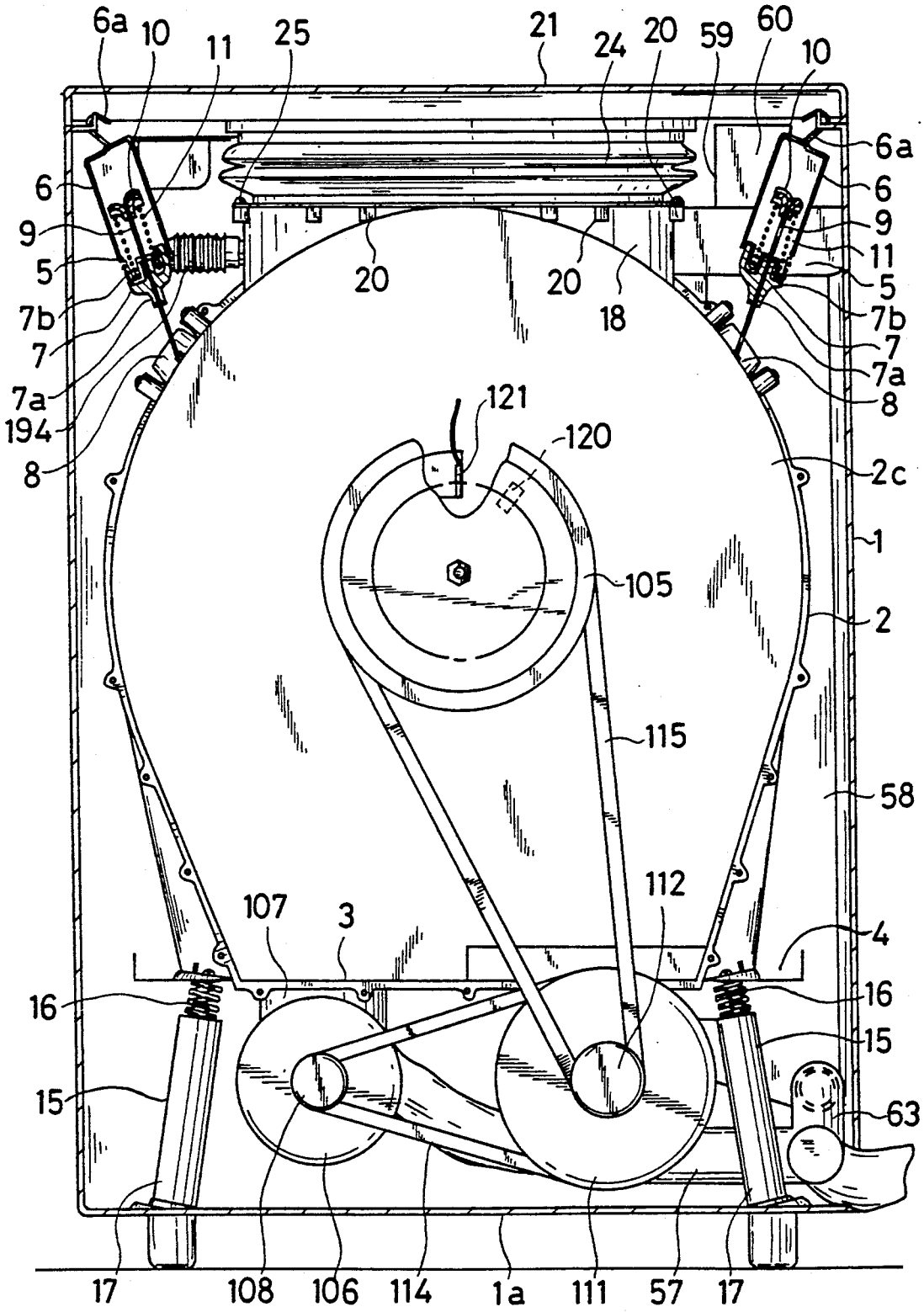
FIG. 4 is a front view showing a major portion of the washing machine.

A washing machine according to the present invention includes a microcomputer which is placed in a given position and is used as control means for controlling the drum rotating means, the water supplying means and the draining means.

The washing machine also includes sensing means for sensing foam generated beyond a permissible amount in an outer tub. The sensing means preferably includes an overflow chamber provided in the wall of the tub and communicating with a drain pipe, and a pair of electrodes placed in the overflow chamber and sensing the foaming in washing the laundry. In this way, a sensing unit for exclusive use can be omitted, and the manufacturing cost can be reduced. In addition to that, the electrodes do not so easily become conductive because of water, and this ensures defoaming.

The overflow chamber has a partition for separating the electrodes from an overflow inlet of the overflow chamber, and thus the overflow chamber has a double-cell structure where the partition divides a room into two. Preferably, the cells communicate to each other. In this way, since the electrodes are separated from the overflow inlet, the electrodes do not so easily become conductive because of a slight foam, so that mistakes in sensing can be prevented.

The electrodes are preferably rod-shaped, and preferably held hanging down in the overflow chamber. In this way, the moisture on the electrodes can easily run down the rod, and the surface of the electrodes is kept drained off. Thus, the electrodes is prevented from corroding.

A partition plate is preferably provided between the electrodes to separate them from each other, so that the electrodes do not become tangled in lint. Even if the electrodes are deformed, they would not come into contact with each other.

Preferably, an inlet pipe is provided in a position where the electrodes are held to introduce water from the position to the overflow chamber. In this way, since water supplied from the roots of the electrodes cleans the electrodes, the accuracy in sensing can be kept well.

Preferably, the overflow chamber has an overflow outlet for water projecting upward and an aperture formed below the overflow outlet and communicating to the outer tub. In this way, the water used for cleaning the electrodes can be collected without waste, and this effectively saves water.

The control means preferably acts to instruct the water supplying means to supply water and increase the amount of the water in the tub. Water is supplied when abnormal foaming is sensed to defoam and dilute washing water. Thus, the foaming can assuredly be settled without much labor.

The control means preferably acts to instruct the water supplying means and the draining means to supply water and increase the amount of the water in the tub and to drain the tub by a predetermined amount of water. Since the supplied water is useful in settling the foaming and keeping the washing water at an adequate water level after the drainage, the result which is obtained by the laundry beating the wall of the drum is not lost even after foaming is settled.

The control means may act to instruct the drum rotating means to stepwise increase operating time per unit time, so that the foaming is inhibited, and labor and time spent for defoaming can be somewhat omitted.

The washing machine according to the present invention may include the blowing means for blowing air, to which the control means acts to instruct the blowing means to blow air in supplying water to the tub and/or draining the tub, so that the supplied water defoams and the air blows the foam. Thus, the blowing means produces considerable effect in defoaming.

The washing machine according to the present invention may include the water heating means for rising the temperature of the washing water in the outer tub. The control means acts to instruct the water supplying means and/or the draining means to supply water in the tub and/or to drain the tub in a predetermined time from the beginning of the washing, and then it acts to instruct the water heating means to rise the temperature of the washing water. In the case of washing the laundry with hot water, the foaming has to be sensed and settled before the washing water is heated, so as to prevent supplied water from lowering the temperature of the hot water.

The washing machine according to the present invention may preferably include alarming means for causing a user to realize that the foaming has been settled by supplying water in the tub and/or draining the tub. The control means preferably acts to instruct the alarming means to give warning in response to a stored signal which means the foaming has been settled, after the washing including washing, rinsing, hydroextracting, or drying operation is completed. From the experience at this time, the user will regulate the amount of detergent next time.

The control means may preferably include means for estimating the degree of the foaming based upon the length of period from a certain point of time to a point of time when the foam sensing signal is received from the sensing means. The control means acts to instruct the water supplying means and/or the draining means to regulate the water to be supplied and/or to be discharged in accordance with the estimation of the estimating means. In this case, required and sufficient amount of supplied and/or discharged water can be selected to avoid wasting time in defoaming.

The control means may act to instruct the drum rotating means to temporarily stop the drum in supplying water. In this case, the drum is stopped in settling the foaming, and hence foaming proceeds no more.

The control means may act to instruct the drum rotating means to rotate the drum at low speed in supplying water. In this case, since the drum rotates at low speed in settling the foaming, the supplied water reaches every inch of the drum, and hence considerable effect in defoaming can be produced.

The control means may act to instruct the water supplying means to supply water intermittently, so that the supplied water can be saved.

According to another aspect of the present invention, the drum washing machine is characterized in that a fluid balancer which is relatively heavy compared with other components is placed at only one end of the drum body, and the relatively heavy drum rotating means is placed close to the other end of the drum body in the outer bottom portion of the outer tub. In short, the fluid balancer is positioned close to the one end of the outer tub, and the drum rotating means is positioned close to the other end of the outer tub.

In this way, the fluid balancer and the drum rotating means are balanced in weight to control the inclination of the outer tub elastically supported, and the drum can be rotated without difficulty.

More specifically, the washing machine of the present invention producing the aforementioned effects can overcome the disadvantage in a washing machine disclosed in Examined Japanese Patnet Application No. 2998/1980; there can be solved the problem that the outer tub inclines because its rear portion is heavier than its front portion, and consequently the drum does not rotate smoothly.

Embodiments of the present invention will now be described in conjunction with the accompanying drawings. "Abnormal foaming" herein means the foaming generated beyond a permissible amount in an outer tub of a washing machine in washing the laundry.

Referring to FIGS. 1 to 6, a drum washing machine of the present invention comprises a frame 1 made of sheet iron, an outer tub 2 made of synthetic resin and having a shape like a horizontal shaft drum. The drum has a horizontal supporting face 3 in its bottom portion and positioned in the frame 1. An iron mounting plate 4 is fixed to the horizontal supporting face 3.

The outer tub 2 is elastically suspended from the frame 1 with four upper supporting members 5 fixed to four corners of the upper portion of the frame 1. Each of the upper supporting members 5 is comprised of a supporter 6, an upper hook **6*a* formed in one end of the supporter 6 for catching hold of the four corners of the upper portion of the frame 1, a lower spring receiver 7 attached to the other end of the supporter 6 and formed with an aperture 7*a* in its center portion and with a concave portion 7*b* in its outer peripheral portion, a supporting rod 9 fitted in the aperture 7*a* of the lower spring receiver 7 for catching at its one end hold of a holder 8 provided at each of four corners in the upper portion of the outer tub 1, an upper spring receiver 10 seizing the other end of the supporting rod 9, and a spring A 11 extending between the lower spring receiver 7 and the concave portion 7*b***.

Figure 9:
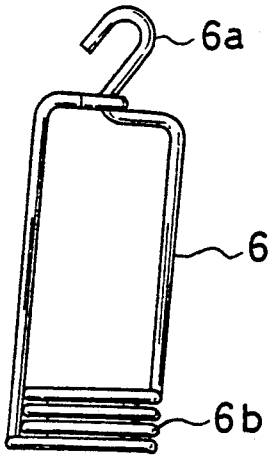
FIG. 9 is a side view showing a hook.
Figure 10:
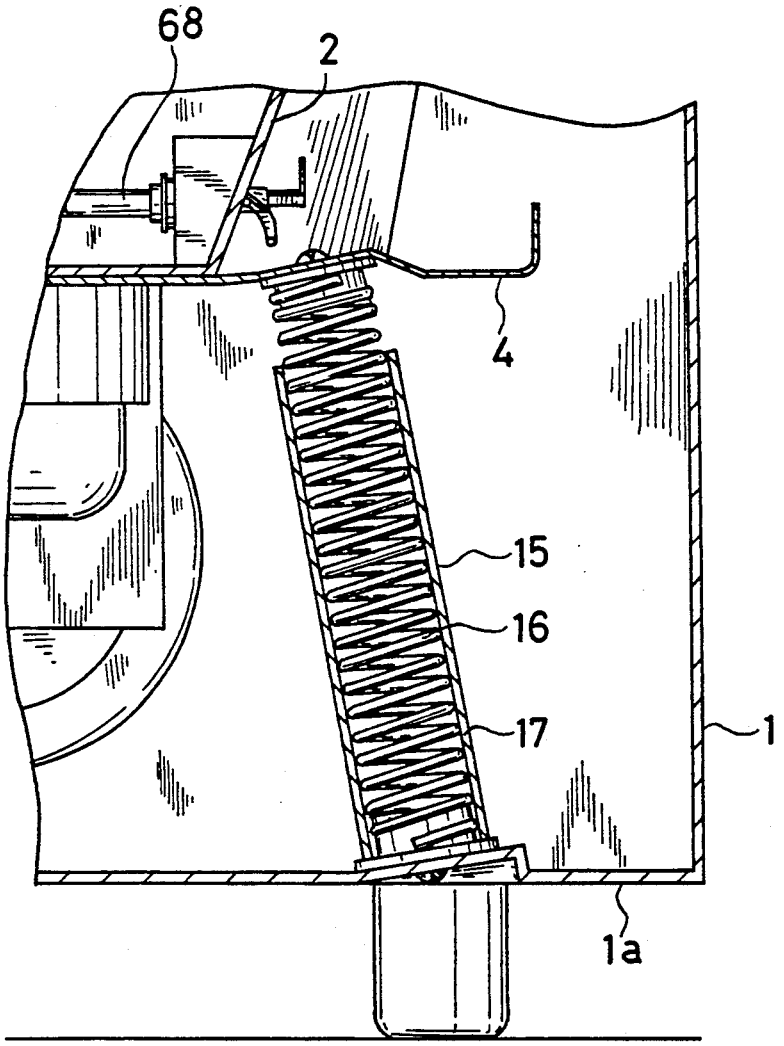
FIG. 10 is a sectional view of a major portion of a lower supporting member.
Figure 11:
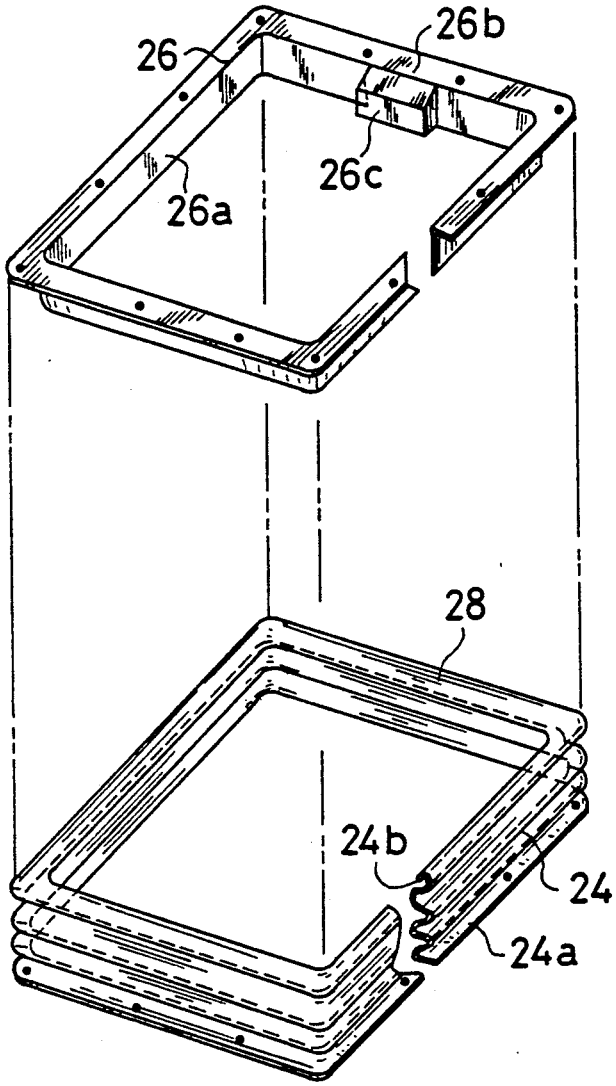
FIG. 11 is a perspective view showing a rubber packing and a gasket.
Figure 12:
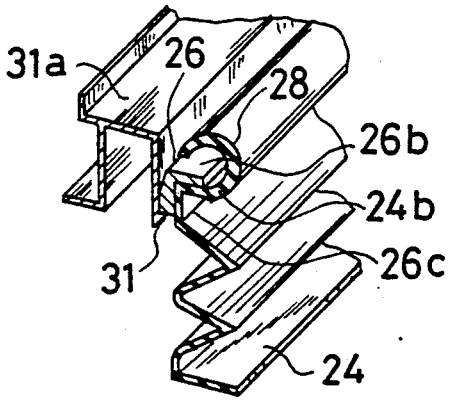
FIG. 12 is an expanded sectional view showing a major portion of a lid interlocked.
Figure 13:
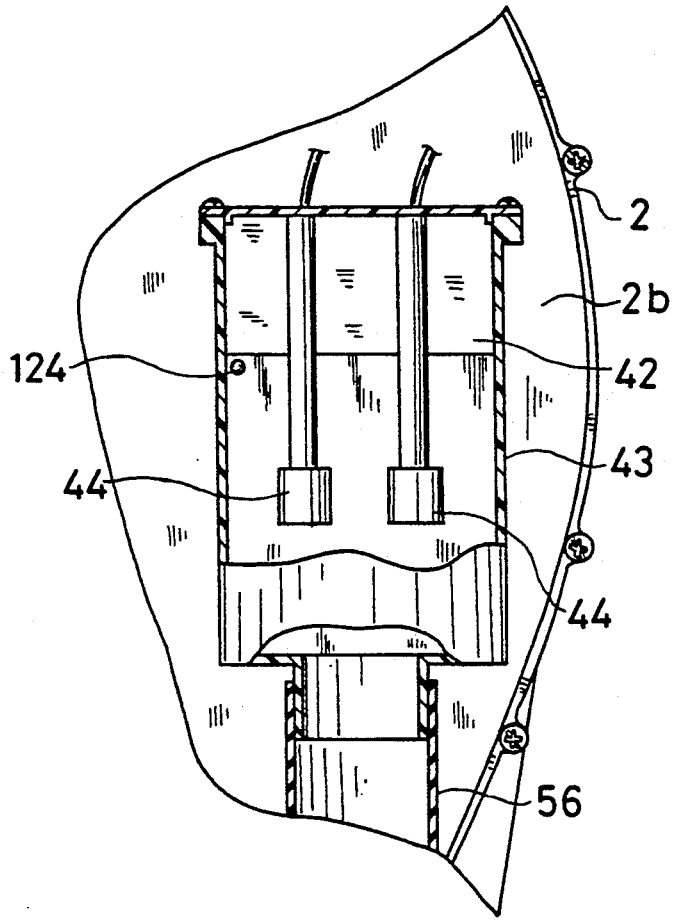
FIG. 13 is a sectional view showing an overflow outlet.
Figure 14:
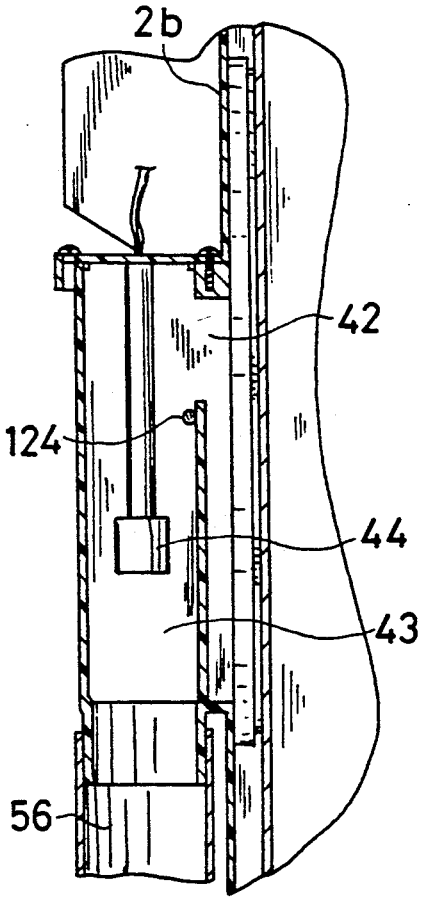
FIG. 14 is a sectional view showing the overflow outlet.
Figure 15:
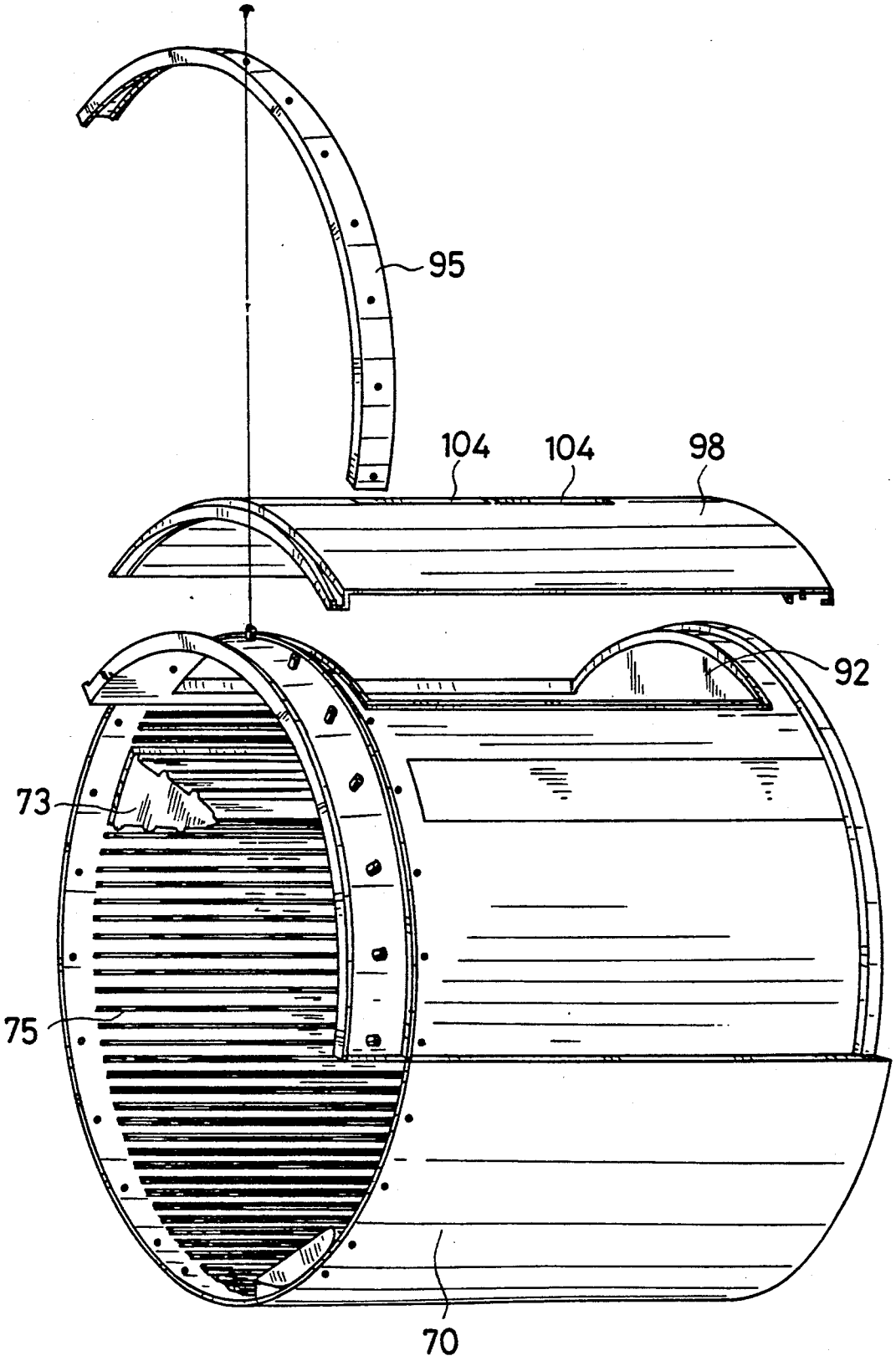
FIG. 15 is a perspective exploded view showing a trunk of a drum.

The supporter 6 is made of a single thick wire bent as shown in FIG. 9; a coil **6*b* is formed at the end opposite to the upper hook 6*a*, and the lower spring receiver 7 is screwed into the coil 6*b***.

The lower spring receiver 7 is made with an upper member 12 made of resin and having the concave portion **7*b* and a lower member 13 made of elastic rubber and having the aperture 7*a*, adhering to each other. A grease pocket 14 is formed in the inner surface of the aperture 7*a* to smoothly slide the supporting rod 9**.

The vibration of the outer tub 2 is absorbed due to the extension and contraction of the spring A 11 of the upper supporting member 5 and the slide resistance between the supporting rod 9 and the aperture **7*a***.

A lower supporting member 15 is placed between the mounting plate 4 of the outer tub 2 and each of the four corners of the bottom **1*a* of the frame 1 to elastically bear the outer tub 2. The lower supporting member 15 is made of a spring B 16 extended between the mounting plate 4 and the frame 1, and an elastic cylinder 17 surrounding the spring B 16. The vibration of the outer tub 2 is absorbed due to the extension and contraction of the spring B 16 and the frictional resistance between the spring B 16 and the cylinder 17. The elastic cylinder 17 prevents the spring B 16** from buckling down.

A tube 18 is a rectangular hollow body formed integral with the outer tube 2 and extending upward from the upper portion of the outer tub 2. The tube 18 defines an opening B 19 for taking in and out the laundry in the upper portion of the outer tub 2. The upper edge of the tube 18 is intended to reach almost the same level as a virtual upper circumferential plane 2*a* of the outer tub 2. A mounting boss 20 is also integrally formed along the upper edge of the tube 18 in a position at almost the same level as the virtual upper circumferential plane 2*a*. A packing explained below is fixed to the mounting boss 20 with screws.

An upper panel 21 made of synthetic resin is fixed on the upper edge of the frame 1. The upper panel 21 has units swelling out therefrom; an operating unit 21*a* containing electronic parts in its front end and has a housing unit 21*b* housing water supplying device in its rear end. The upper panel 21 has a rectangular opening A 22 for taking in and out the laundry in its center portion. Various operating keys 23 are disposed in the upper face of the operating unit 21*a*. A rubber packing 24 has a shape like bellows and its lower end 24*a* is fixed to the mounting boss 20 of the tube 18 with screws 25.

A gasket 26 made of synthetic resin is comprised of a vertical wall 26*a* fit into the opening A 22, a horizontal wall 26*b* put on a rim 22*a* of the opening A 22 from the upper part and a claw 26*c* bulging inward from the center of the inner front of the vertical wall 26*a*. The upper end 24*b* of the rubber packing 24 is put between the rim 22*a* of the opening A 22 and the gasket 26, and the horizontal wall 26*b* and the rubber packing 24 are fixed to the rim 22*a* with screws 27. The upper end of the rubber packing 24 is folded into a flap 28 which covers the screws 27 fastening the rubber packing 24 and the rim 22*a*.

A safety cover 29 is pivotably held by the rear edge of the opening A 22 to cover the opening A 22. The safety cover 29 is provided with a claw 31 at its bottom face of the front center. The claw 31 is always pressed upward by a spring 30 and interlocked with the claw 26*c* of the gasket 26 from the lower part when the safety cover 29 is closed. An end 31*a* of the claw 31 is pushed up by the pressing of the spring 30 to release the interlock between the claws 31 and 26*c*, so that the safety cover 29 can be opened. When the safety cover 29 is closed, the lower face of the safety cover 29 is contact with the upper face of the flap 28.

A lid 32 is pivotably held before the housing unit 21*b* of the upper panel 21 to lie over the safety cover 29. A supporting arm 33 is formed projecting from the rear end of the lid 32 into the housing unit 21*b*. A torsion coil spring 34 is fixed between the supporting arm 33 and a supporting rib 35 in the housing unit 21*b*. Due to the coil spring 34, the lid 32 opens and closes as if an articulation works well.

The rear wall 2*b* of the outer tub 2 is individually manufactured. The rear wall 2*b* is bonded to the remaining part of the tub 2 after a drum explained later is put in position from the rear opening of the tub 2. A cylinder 36 is formed in the center portion of the rear wall 2*b*. An air duct A 37 is integrally formed with the outer surface of the rear wall 2*b*. A wall 37*a* extends from the upper center of the air duct A 37 to the cylinder 36 and covers the cylinder 36. A rear bearing 38 for the drum is fixed to the wall 37*a* close to the cylinder 36. In the upper part of the air duct A 37, a heater casing 39 is formed, and a sheathed heater A 40 is placed therein. An iron plate 41 encloses the heater A 40 to prevent the fire originated in dust or the like from spreading to resin material.

An overflow outlet 42 provided at the level corresponding to a half of the height of the rear wall 2*b*. An overflow pipe 43 serves as an overflow chamber to conduct water from the overflow outlet 42. A pair of electrodes 44 serving as foam sensing means are placed in the overflow pipe 43. An air trap 45 is formed in the lower portion of the rear wall 2*b* and is connected to a water level sensor 46 provided in the housing unit 21*b* through a pressure hose 47.

A drain outlet 48 is provided in the bottom of the outer tub 2, and a valve case 49 is also provided having three connecting pipes 50, 51, 52. The connecting pipe 50 is connected to the drain outlet 48. A drain valve 53 serving as a part of draining means is provided in the valve case 49 to open and close the connecting pipe 50. A drain valve motor 54 serving as a part of the draining means is provided to open and close the drain valve 53. Wire 55 connected to the drain valve 53 is rolled by the rotation of the drain valve motor 54 to open the drain valve 53. The force applied by a spring (not shown) restores the drain valve 53 to the closed state by cutting off the rotation force of the drain motor 54.

An overflow hose 56 connects the overflow pipe 43 to the connecting pipe 52 of the valve case 49. A drain hose 57 serving as a part of the draining means is connected to the connecting pipe 51 of the valve case 49, and has its end drawn out of the machine. A dehumidifying pipe 58 made of synthetic resin is vertically provided in the rear corner portion of the frame 1. A fan device 59 which is comprised of a fan and a fan motor 60 to serve as air blowing means is provided in the upper end of the dehumidifying pipe 58. The fan device 59 has its inlet lead to the dehumidifying pipe 58 and its outlet connected to the heater casing 39 through an air blowing duct B 61 having a shape like bellows. The dehumidifying pipe 58 whose two lower ends each communicate with the overflow hose 56 and the drain hose 57 through a drain pipe 63 and a circulating duct 62 having a shape like bellows, respectively.

A twin water supply electromagnetic valve 64 serving as a part of water supply means is provided in the housing unit 21*b*. One of the water supply valves, A 64*a*, is connected to an opening 66 provided in the tube 18 through a inlet hose A 65 serving as a part of water supply means, and the other of the water supply valves, B 64*b*, is connected to the upper portion of the dehumidifying pipe 58 through an inlet hose B 67 serving as a part of the water supply means. A sheathed heater B 68 serving as temperature rising means is provided in the inner bottom portion of the outer tub 2, and a front bearing 68*a* for the drum is fixed to the center portion of a front wall 2*c* of the outer tub 2.

The horizontal shaft drum 69 made of synthetic resin is rotatably supported in the outer tub 2 and used for washing, hydroextracting and drying. The drum 69 is comprised of a cylindrical body 70 leaving its rear side open, a fluid balancer 71 attached near the rear end of the body 70, and a rear panel 72 fixed after the balancer 71.

Figure 17:
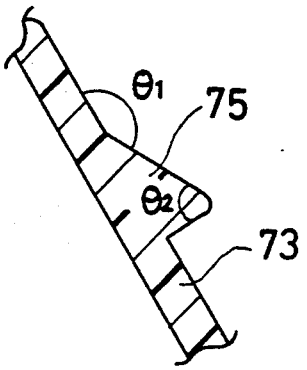
FIG. 17 is an expanded sectional view showing a major portion of a baffle.
Figure 18:
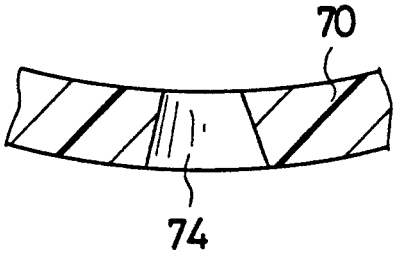
FIGS. 18 and 19 are sectional views showing different embodiments of a bore.
Figure 19:
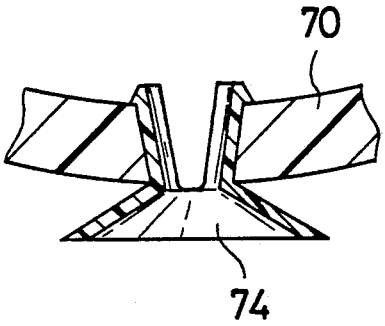
Figure 20:
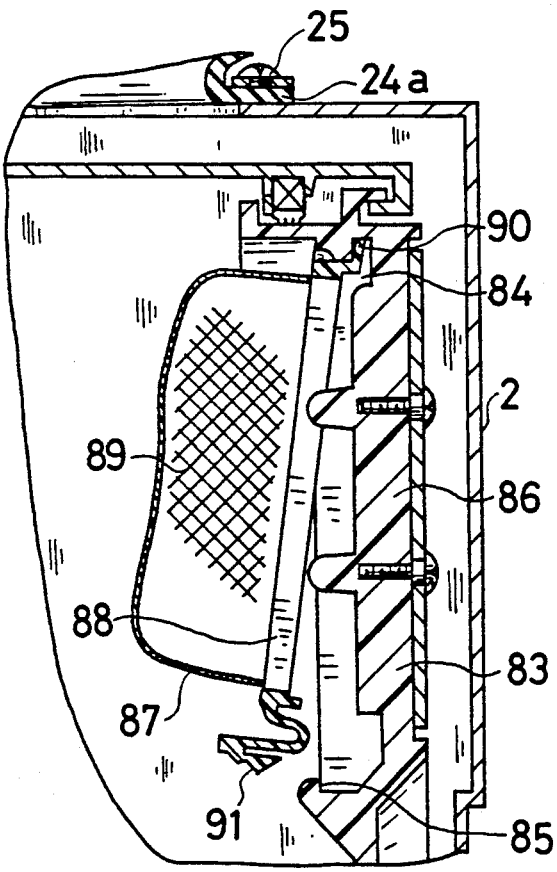
FIG. 20 is a sectional side view showing a filter mounting portion.
Figure 21:
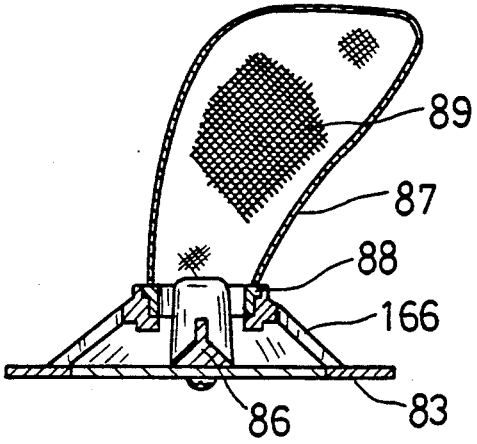
FIG. 21 is a sectional plan view showing the filter mounting portion.

A baffle 73 is a projection having a triangular section and is provided at a position of every 120° along the inner peripheral surface of the body 70. The body 70 is provided with many perforations 74 around the surface, and is also provided with many horizontal ribs 75 along the inner peripheral surface of the body 70. The horizontal ribs 75 are also formed in the upper face of the baffles 73. The rib 75 on the baffle 73 is particularly put in position so that the angle $\theta_1$ comes to be an obtuse angle and the angle $\theta_2$ comes to be an acute angle, as shown in FIG. 17. The performations 74 are gradually widened from the inner portion to the outer portion as shown in FIG. 18 (another example as shown in FIG. 19 may be used).

Figure 16:
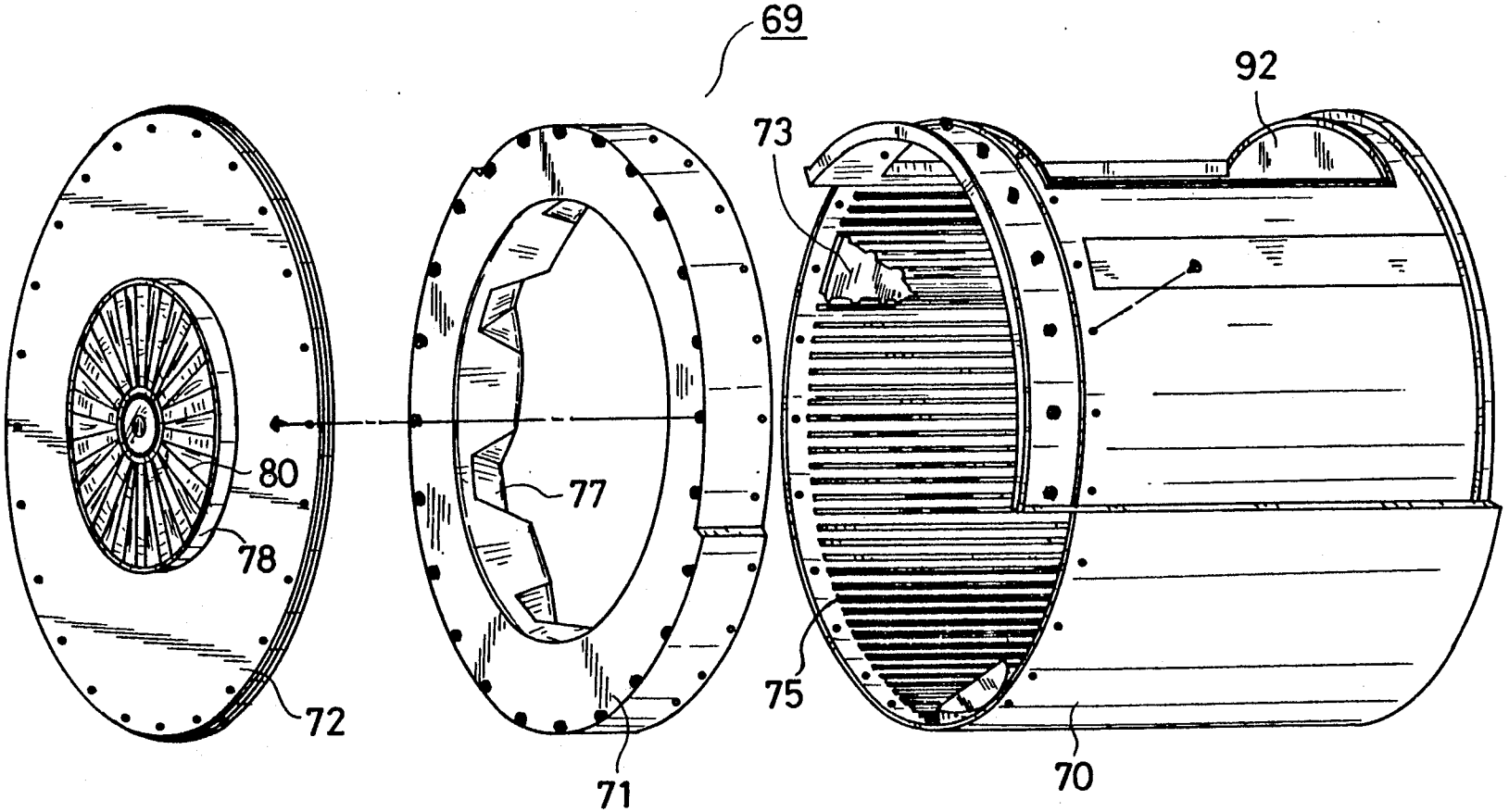
FIG. 16 is a perspective exploded view showing the drum.

The fluid balancer 71 is a hollow annular member containing a certain quantity of salt water. A plurality of resistance plates 76 are set inside the fluid balancer 71 at intervals of every 30° from the rear side to the front. A distance between each of the resistance plates 76 and either of the inner and outer interior surfaces is under 5 mm, and the distance in the outer part is smaller than that in the inner part. As shown in FIG. 16, a plurality of concave portions 77 are provided along the front inner peripheral surface of the balancer 71, and work as the resistance plates 76 do.

An inlet 78 is formed projecting in the center portion of the rear panel 72 to fit into the cylinder 36, and a supporting shaft 79 is fixed at the center of the inlet 78. An axial flow fan 80 serving also as a filter is integrally formed in the inlet 78.

Then, as shown in FIG. 16, the balancer 71 is fitted into the body 70, and fixed to the rear end of the body 70 with screws at a position where it comes in contact with the ends of the baffles 73. The rear panel 72 is put on the rear side of the balancer 71 and fixed thereto with screws, and this makes the drum 69 perfect. In this way, the balancer 71 is used as a wall between the end of the body 70 and the rear panel 72, and hence, resin material can be saved by an amount corresponding to an interval A (see FIG. 2) between the body 70 and the rear panel 72.

A supporting shaft 81 is fixed in the center portion of a front panel 82 of the body 70. A filter mounting portion 83 is formed in the inner surface of the front panel 82 and closer to the outer circumference thereof. The filter mounting portion 83 is provided with a concave portion 84 close to its outer circumference portion, a projection 85 close to the center portion and a rib 86, which is triangular in section, at the center portion.

A filter unit 87 is composed of an elongated frame 88 and a net 89 attached to the frame 88. The frame 88 is provided with a claw 90 at its one end and another claw 91 at the other end. The claw 90 engages with the concave portion 84 and the claw 91 elastically engages with the projection 85. In order to complete the attachment of the filter unit 87, the frame 88 pivots on the fulcrum where the claw 90 just engages with the concave portion 84, and then the claw 91 engages with the projection 85. In order to remove the filter unit 87, these steps may be done in the reverse order.

A rectangular opening C 92 for taking clothes in and out is defined in the body 70, extending along the circumferential surface of the body 70. The opening C is almost as large as the opening B 19. Slide grooves 93, 94 are formed at the body 70 before and after the opening C 92 very close thereto. A slide cover 95 individually manufactured is attached to the slide groove 93. A claw 96 is formed projecting upward from one side of the body 70 close to the opening C 92, and a contact rib 97 is formed projecting upward from the other side. The opening C 92 is positioned just above the filter mounting portion 83.

A lid 98 made of synthetic resin is placed at the opening C 92 and is slidably held in the slide grooves 93, 94. A pull 99 is pivotably held at an end of a side of the lid 98. The pull 99 is provided with a claw 100 which interlocks with the claw 96, at one end, and a concave portion 101 at the other end, and a spring 102 always urges the pull 99 in order that the claw 100 interlocks with the claw 96.

A rib 103 is formed at an end of the opposite side of the lid 98, projecting downward. Reservoir concaves 104, 104 are integrally formed in the center portion of the upper surface of the lid 98. The reservoir concaves 104, 104 reserve washing soap, bleaching agent, softening agent, etc. for later use. It is desirable that a plurality of the reservoir concaves 104, 104 be provided for various kinds of treatment agent.

In order to open the lid 98, the concave portion 101 is pressed down to release the interlock between the claws 96 and 100 and the lid 98 is slid to its opening position. On the other hand, when the lid 98 is slid to its closed position, the claw 100 is pressed up along the inclined face of the claw 96 until it automatically interlocks with the claw 96.

The front and rear drum bearing 68*a*, 38 rotatably support the supporting shafts 79, 81 holding the drum 69. The supporting shaft 81 projects from the front wall of the outer tub 2. A drive pulley 105 is fixed to the supporting shaft 81.

A washer motor 106 as drum rotating means is fixed to the mounting plate 4 by a mounting member 107, and a small pulley A 108 is fixed to a motor shaft. A hydroextractor motor 109 is fixed to the mounting plate 4 by a mounting member 110, and a large pulley A 111, a small pulley B and a brake drum 113 are fixed to a motor shaft 109*a*. The small and large pulleys A 108 and A 111, and the small pulley B 112 and the drive pulley 105 are connected to each other through belts 114 and 115, respectively. The washer motor 106 and the hydroextractor motor 109 are disposed closest to the forefront of the outer tub 2.

With the washing machine having a structure as stated above, in washing the laundry, the washer motor 106 repeatedly rotates the drum 69 alternately in opposite directions at low speed so that the laundry carried up in the drum 69 falls down and beats against the bottom of the drum 69, resulting in a good washing effect. Further, in hydroextracting, the hydroextractor motor 109 rotates the drum 69 in one direction at high speed, so that centrifugal action of the spinning drum extracts water from the laundry within the drum 69.

In the washing machine of this embodiment, although the balancer 71, the washer motor 106 and the hydroextractor motor 109 are relatively heavy, they are disposed to be well-balanced by positioning the balancer 71 close to the rear end of the outer tub 2 and positioning the washer motor 106 and the hydroextractor motor 109 close to the front end thereof, so that the outer tub 2 does not easily incline.

Figure 67:
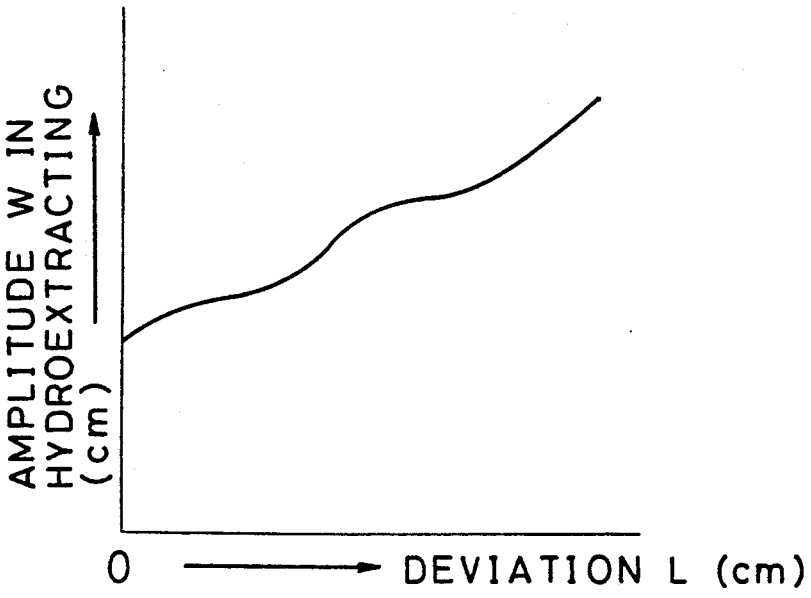
FIG. 67 is a graph showing an amplitude characteristic in the hydroextracting operation.

FIG. 67 shows the results of measurement of the vibration of the drum 69 when a hydroextracting operation is carried out with weight balance varied. A horizontal axis L shows the distance from the middle point between the balancer 71 and the middle point of the motors 106, 109 to the vertical center line of the drum 69. A vertical axis W is the maximum amplitude of the outer tub 2 during the hydroextracting operation.

Namely, as the middle point between the balancer 71 and the middle point of the motors 106, 109 is deviated more largely from the center of the outer tub 2, they get more ill-balanced and the drum 69 comes to rotate unstably. This results in the outer tub 2 vibrating largely during the hydroextracting operation.

A brake lever 116 is pivotably supported by the mounting member 110 of the hydroextractor motor 109. The brake lever 116 has a brake shoe 117. When the lid 32 is opened, a spring not shown urges the brake shoe 117 so that the brake shoe 117 comes in pressure contact with the brake drum 113. A wire 118 has its one end connected to the brake lever 116 and the other end connected to the torsion coil spring 34. A tube 119 serves as a guiding and protecting member for the wire 118.

When the lid 32 is closed, a connecting portion 34*a* of the torsion coil spring 34 is displaced upward and pulls the wire 118. The brake lever 116 is rotated to leave the brake shoe 117 from the brake drum 113. When the lid 32 is opened, the connecting portion 34*a* of the torsion coil spring 34 is displaced downward and slackens the wire 118. Then, the brake shoe 117 is pressed to come in contact with the brake drum 113, and thus the hydroextractor motor 109 is braked.

A magnet 120 is attached to the drive pulley 105. A reed switch 121 is placed closest to and opposed to the magnet 120 of the outer tub 2. The reed switch 121 is closed when the magnet 120 is set close to it by the rotation of the drive pulley 105, and opened when the magnet 120 is set away from it. Rotation position detecting means for the drum 69 is composed of the magnet 120 and the reed switch 121, though explained below. The reed switch 121 is placed in a position above and perpendicular to the shaft line of the drum 69.

A first negative characteristic thermistor 122 is placed close to the bottom of the outer tub 2, and is a component of a water temperature sensing circuit explained below. A second negative characteristic thermistor 123 is placed at the opening for insertion of a heater in the heater casing 39. A third negative characteristic thermistor 124 is placed within the overflow pipe 43. The second and third thermistors 123, 124 are composed of a drying completion sensing circuit explained below.

Figure 23:
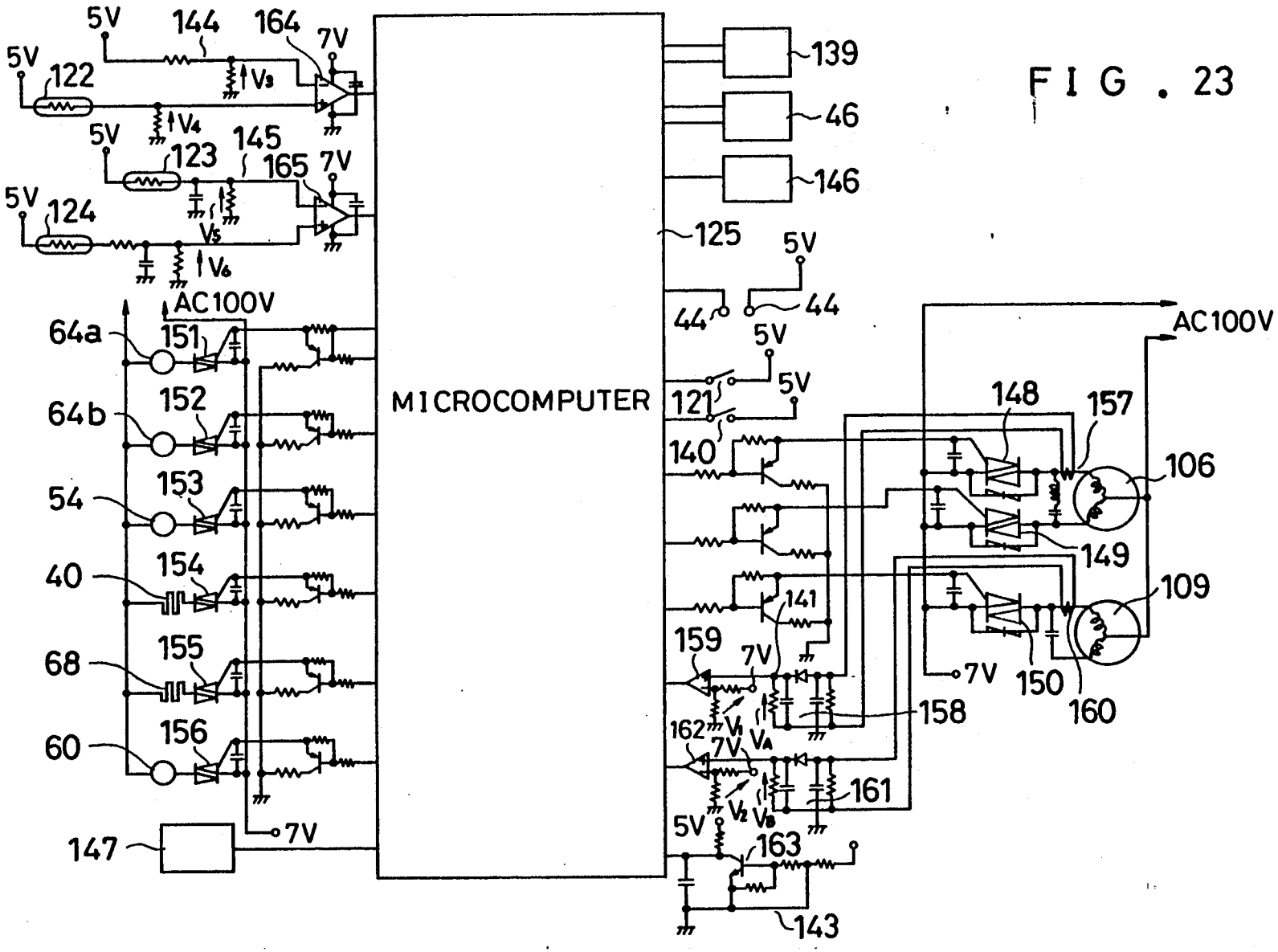
FIG. 23 is a diagram showing an electric circuit.

Now, an exemplary circuit of the washing machine of the present invention will be described in conjuction with FIG. 23.

Figure 22:
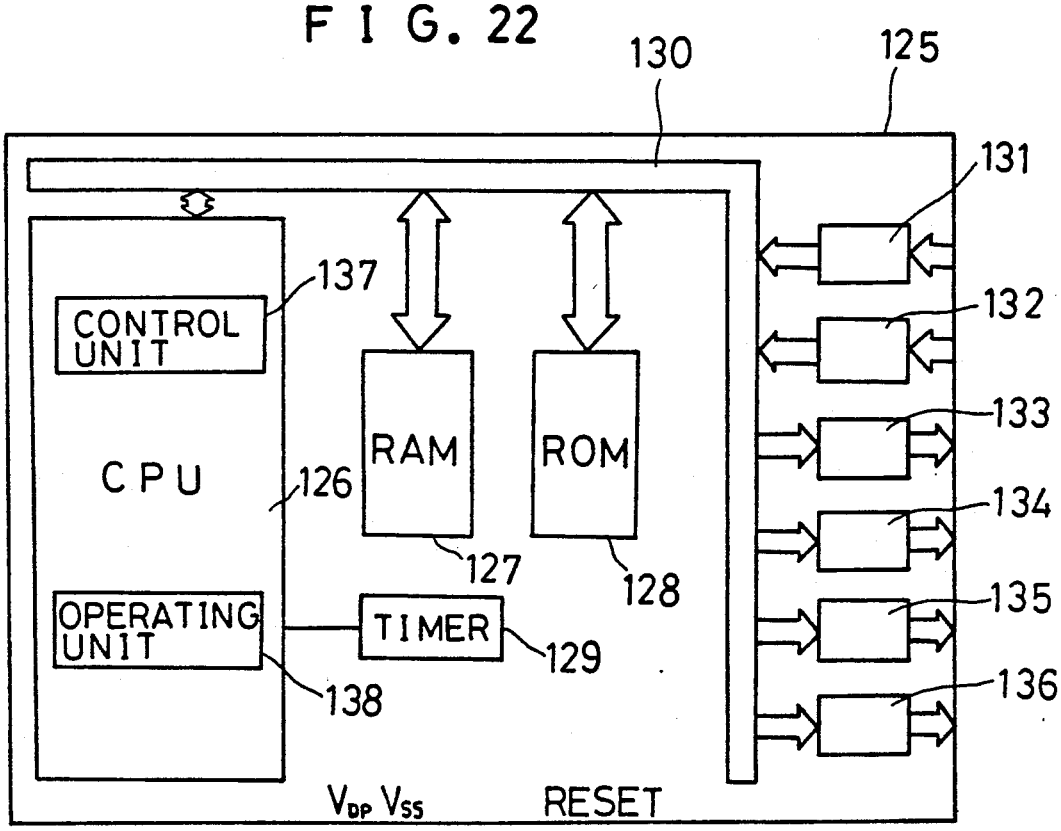
FIG. 22 is a block diagram showing a system architecture of a microcomputer.

A micro computer 125 (for example, LC 6523 manufactured by Sanyo Electric Co., Ltd.) controls the rotation of the drum 69, water supply and drainage, and is composed, as is well known, of a CPU 126, a RAM 127 as storage means, a ROM 128, a timer 129, a system bus 130 and input/output ports 131 to 136, as shown in FIG. 22.

The CPU 126 is composed of a control unit 137 and an operating unit 138. The control unit 137 fetches and executes instructions. The operating unit 138 performs operating processes such as binary addition, logical operation, addition and subtraction, and comparison for data received from an input device and a memory in response to a control signal from the control unit 138. The RAM 127 stores data related to devices. The ROM 128 stores in advance means of operating the devices, setting conditions for judgment, rules for processing various information, etc.

The microcomputer 125 receives signals from an input key circuit 139 composed of a group of various operating keys 23, the water level sensor 46, an safety switch 140 switching on or off correspondingly to the opening and closing of the lid 32, the reed switch 121, a washer motor current detecting circuit 141, a hydroextractor motor current detecting circuit 142, a reference pulse generating circuit 143, a water temperature sensing circuit 144 and a drying completion sensing circuit 145.

The microcomputer 125 makes the washer motor 106 rotate in the forward and reverse directions based upon information. The microcomputer 125 further sends drive signals to the hydroextractor motor 109, the water supply electromagnetic valve 64*a*, the water supply electromagnetic valve 64*b*, the drain valve motor 54, the fan motor 60, the heater A 40, the heater B 68, a buzzering circuit 146 as alarming means, and an LED driving circuit 147 as warning means. The microcomputer 125 and the loads are connected through bi-directional thyristors 148 to 156. The microcomputer 125 outputs signals to turn on and off the bi-directional thyristors 148 to 156.

The water level sensor 46 functions as follows: First, it detects the change in the water level in the outer tub 2 as the change in the pressure within the air trap 45, and then move a magnetic member in a coil in accordance with the detected pressure. Thus, it detects the change in the water level as the change in inductance of the coil. Further, it detects the change in the inductance as the change in oscillation frequency and inputs the detection results to the microcomputer 125. The microcomputer 125 detects the water level within the outer tub 2 successively and in a wide scope based upon the change in the oscillation frequency.

The washer motor current detecting circuit 141 is composed of a current transformer A 157 detecting current existing in the washer motor 106, a circuit 158 rectifying the detected current, smoothing it and converting it into direct current voltage $V_A$, and a comparator A 159 comparing the voltage $V_A$ with the reference voltage $V_1$ to output a warning signal A to the microcomputer 125 when $V_A > V_1$.

The hydroextractor motor current detecting circuit 142 is composed of a current transformer B 160 detecting current existing in the hydroextractor motor 109, a circuit 161 rectifying the detected current, smoothing it and converting it to direct current voltage $V_B$ and a comparator B 162 comparing the voltage $V_B$ with the reference voltage $V_2$ to output a warning signal B to the microcomputer 125 when $V_B > V_2$.

Figure 25:
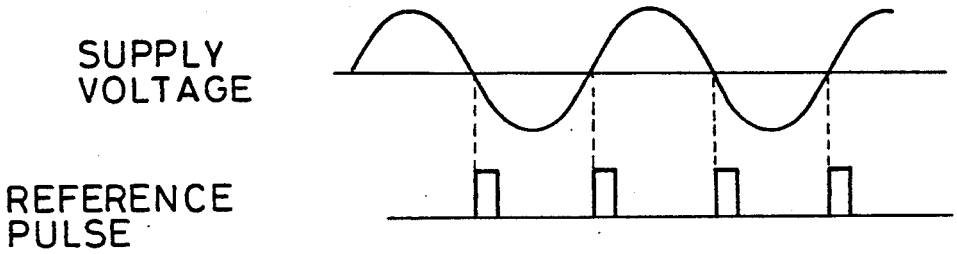
FIG. 25 is a waveform chart in a reference pulse generating circuit.

The reference pulse generating circuit 143 is composed of a transistor 163, and various resistances and capacitors. The circuit 143 receives at its input terminal a full-wave rectifying signal of the voltage at a secondary side of a transformer (not shown) and inputs pulses synchronized with zero cross points of commercial supply voltage to the microcomputer 125, as shown in FIG. 25.

Figure 24:
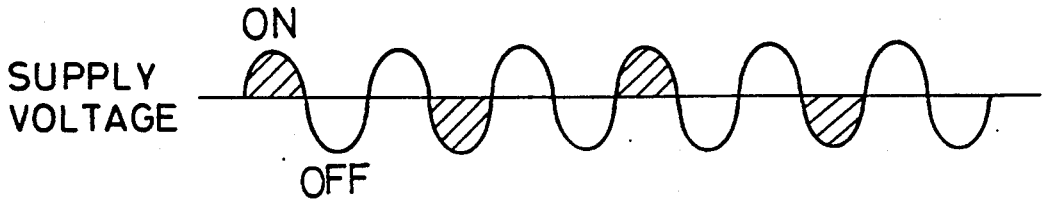
FIG. 24 is a diagram presented for explaining the pulse-cut control.

The microcomputer 125 controls the bi-directional thyristors 148, 149, 150 of the washer motor 106 and the hydroextractor motor 109 based upon the reference pulse to appropriately turn on and off with a unit of a half cycle of alternate current supply voltage. Specifically, as shown in FIG. 24, when the bi-directional thyristors 148, 149, 150 are turned on n times out of m times with a unit of a half cycle of the supply voltage, the number of revolutions of the motors is about n/m compared to the case where the thyristors are successively kept turned on. Hereinafter, this control system is referred to as n/m pulse cut control.

Further, half-wave is applied to the motors through ½ pulse cut control so as to brake the motors. Hereinafter, this braking system is referred to as direct current brake.

The water temperature sensing circuit 144 inputs voltage $V_4$ varied by reference voltage $V_3$ and a resistance value of the first thermistor 122 to an operational amplifier 164, and outputs a warning signal C to the microcomputer 125 from the operational amplifier 164 at the point of time when $V_4 > V_3$.

Although the voltage condition is initially set to satisfy $V_3 > V_4$, the first thermistor 122 decreases in the resistance value as the temperature of the washing water rises, and accordingly the value of the voltage $V_4$ increases. $V_4 > V_3$ is satisfied at the point of time when the temperature of the washing water reaches a critical temperature (about 70° C.), and then abnormality is sensed.

The drying completion sensing circuit 145 inputs voltage $V_5$ varied by a resistance value of the second thermistor 123 and voltage $V_6$ varied by a resistance value of the third thermistor 124 to an operational amplifier 165, and outputs a completion signal D to the microcomputer 125 from the operational amplifier 165 at the point of time when $V_6 > V_5$ is satisfied.

Although the voltage condition is initially set to satisfy $V_5 > V_6$, the resistance value of the third termistor 124 is increasingly reduced as the drying operation proceeds, and the voltage condition satisfies $V_6 > V_5$ when the laundry is completely dehumidified. Then, the microcomputer 125 receives a signal from the operational amplifier 165 and defines that the drying is completed.

The operation based upon the above-mentioned system will be explained in conjunction with FIGS. 34 to 44.

According to this embodiment, the water level within the outer tub 2 during the washing process can be set with three levels (High, Middle, Low). The reversal cycle of the drum 69 during the washing and rinsing process can be set with three levels (Strong: ON for 15 seconds—OFF for 3 seconds, Standard: ON for 9 seconds—OFF for 3 seconds, Weak: ON for 6 seconds—OFF for 3 seconds), and the degree of hydroextraction can be set with two levels (Standard: successively turning on, Weak: ⅔ pulse cut control). The water level during the rinsing process is set at "High" level in advance, and the reversal cycle of the drum during the drying process is set at ON for 10 seconds—OFF for 2 seconds in advance.

Operating the keys enables the user to choose between a standard course where a sequence of processes of washing, rinsing, hydroextracting and drying are performed respectively on standard operating conditions (i.e., period of time, water level, reversal cycle of the drum, degree of hydroextraction) and a shortened course where a period of time spent for each processe is cut down. The operating conditions in each course can be varied by the key operation (this process can be omitted if the required period is set zero).

Then, the microcomputer 125 controls the operations of the loads one after another in accordance with the preset course.

Figure 34:
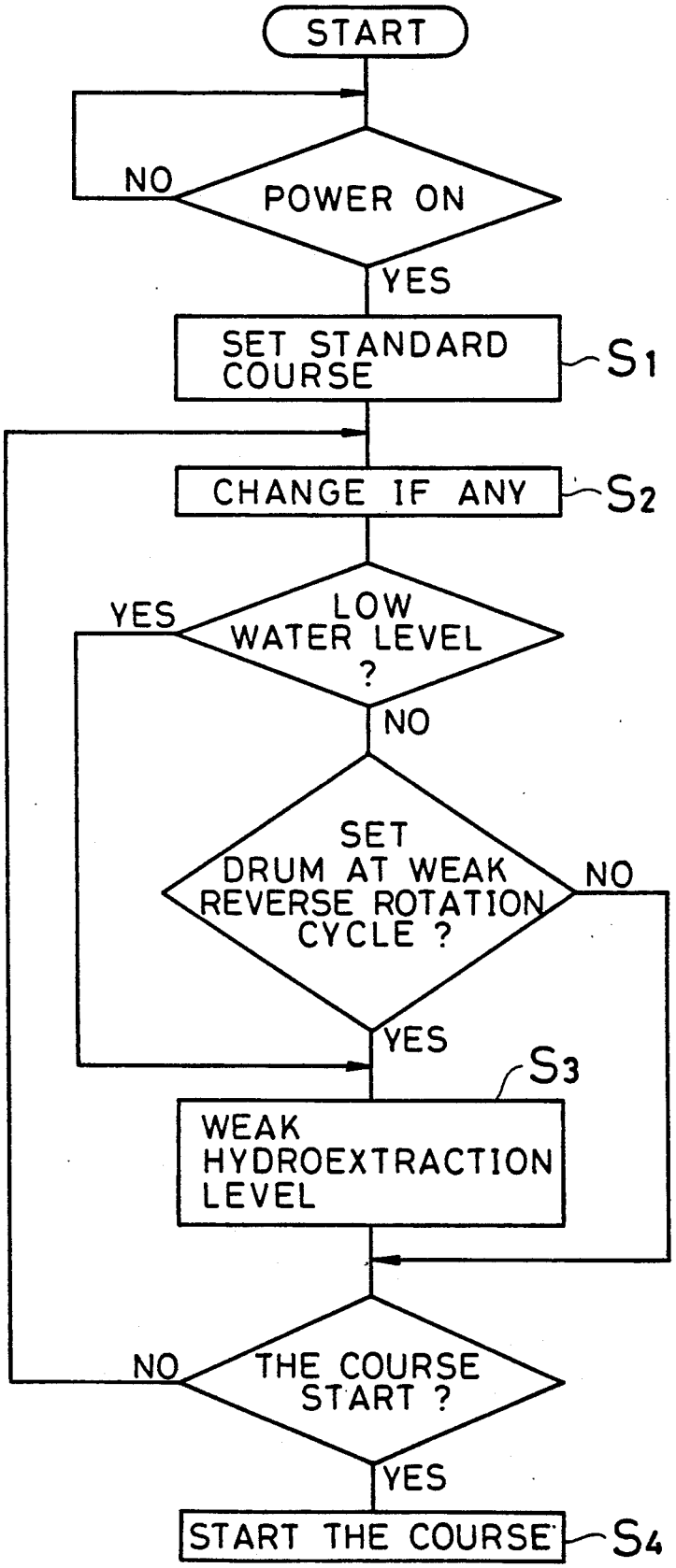
FIGS. 34 to 44 are flow charts showing a course setting program, a washing and rinsing program, an abnormal foam managing program, a water re-supplying program, a hydroextracting program, a load sensing program 1 and another example, a load sensing program 2 and another example, a drying program, a water temperature regulating program and a drum stopping program.

Referring to FIG. 34, the microcomputer 125, immediately after powered on, automatically sets the standard course (S-1). Then, the user might make a change in conditions, if any (S-2) When water level is set "Low" and the drum reversal cycle is set "Weak", generally there may be a small quantity of laundry or the laundry may be delicate, and hence the degree of hydroextraction comes to automatically be set "Weak" (S-3). Then, the course starts when a start key for the course is operated (S-4).

The operation will be described for every process in practicing the standard course. Although not shown in flow charts, counters are independently provided to count a period of time for each process, a period of time for he rotation of a motor, a period of time for a pause, etc. They are reset after they has counted a specified period of time.

Washing Process

Figure 35:
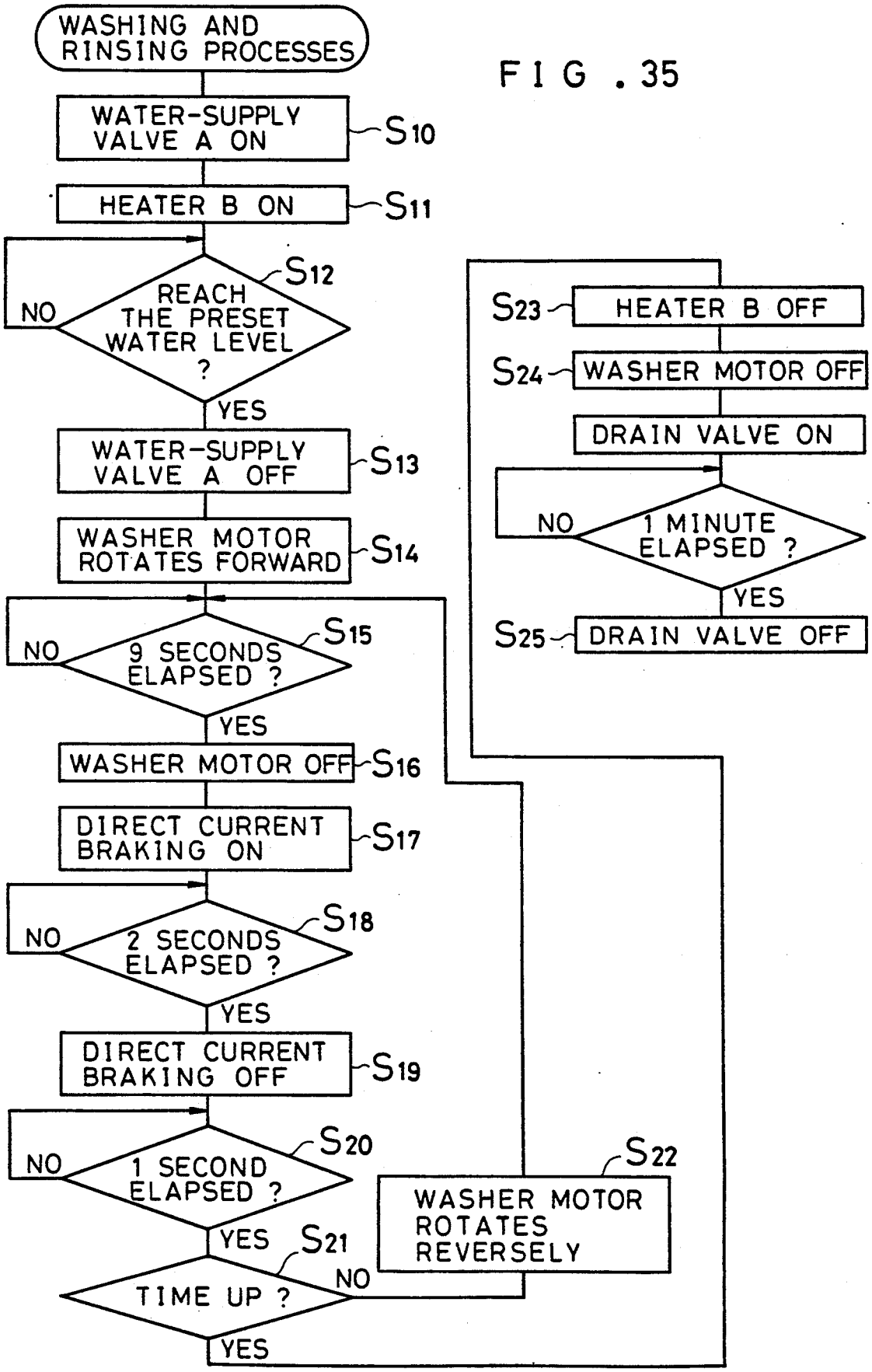

As shown in FIG. 35, in the washing process, water is first supplied in the tub 2 to a predetermined water level, and simultaneously the heater B 68 is turned on to heat the water in the tub 2 (S-10 to S-13). Then, the washer motor 106 rotates reversely for a predetermined period of time in a reverse rotation cycle where it rotates forward for 9 seconds—stops for 3 seconds—rotates reversely for 9 seconds—stops for 3 seconds (S-14 to S-21).

The drum 69 rotates reversely due to the rotation of the washer motor 106. Washing treatment agent (washing agent or bleaching agent when the washing operation is performed) reserved in the reservoir concave 104 is put in and solves in the washing water. In the drum 69, the laundry is carried up by the baffle 73 and falls down to beat against the bottom of the drum 69. Also, the laundry rubs against the lateral ribs 75 and the concave portions 77, and thus the washing is effectively done.

According to this embodiment, direct current braking is performed to the washer motor 106 and the hydroextractor motor 109 for 2 seconds synchronizing with the pause of the washing motor 106. This results in the drum 69 stopping abruptly, and the reaction causes the laundry to beat against the inner wall of the drum 69. Thus the washing effect is further increased.

Assuming now that the ratio of the small pulley A 108 to the large pulley A 111 is 1 to 3 and that the ratio of the small pulley B 112 to the drive pulley 105 is 1 to 3, the ratio of the small pulley A 108 to the drive pulley 105 comes to be 1 to 9. Consequently, the torque necessary for the washer motor 106 to rotate the drum 69 may be ⅓ of the torque necessary for the hydroextractor motor 109 to rotate the drum 105.

This applies to the braking force to each of the motors. If equivalent braking forces are applied, the washer motor 106 is effectively braked rather than the hydroextractor motor 109 is. This is effectuated for the case where the starting torque of the washer motor 106 and that of the hydroextractor motor 109 are almost the same (in this embodiment, the starting torque of the hydroextractor motor 109 is about 1.2 times larger than that of the washer motor 106). If a hydroextractor motor of large starting torque is used, the braking force effectively works for the hydroextractor motor. However, the large starting torque requires large electric power and leads to cost increase, and thus the motor of such large torque causes the disadvantage in practical use.

Thus, it is effective to brake the washer motor 106 through the direct current braking. In this embodiment, both the motors 106 and 109 are braked through direct current braking to obtain further braking effect. In the explanation below, also, the direct current braking means brake both the motors.

During the reversal rotation of the drum 69, the washing water pass from a gap 166 between the frame 88 and the filter mounting portion 83 to the net 89, and lint in the water is trapped by the net 89.

After a specified time elapses, the heater B 68 and the washer motor 106 are turned off (S-23) (S-24), and the washing water is discharged (S-25).

Figure 36A:
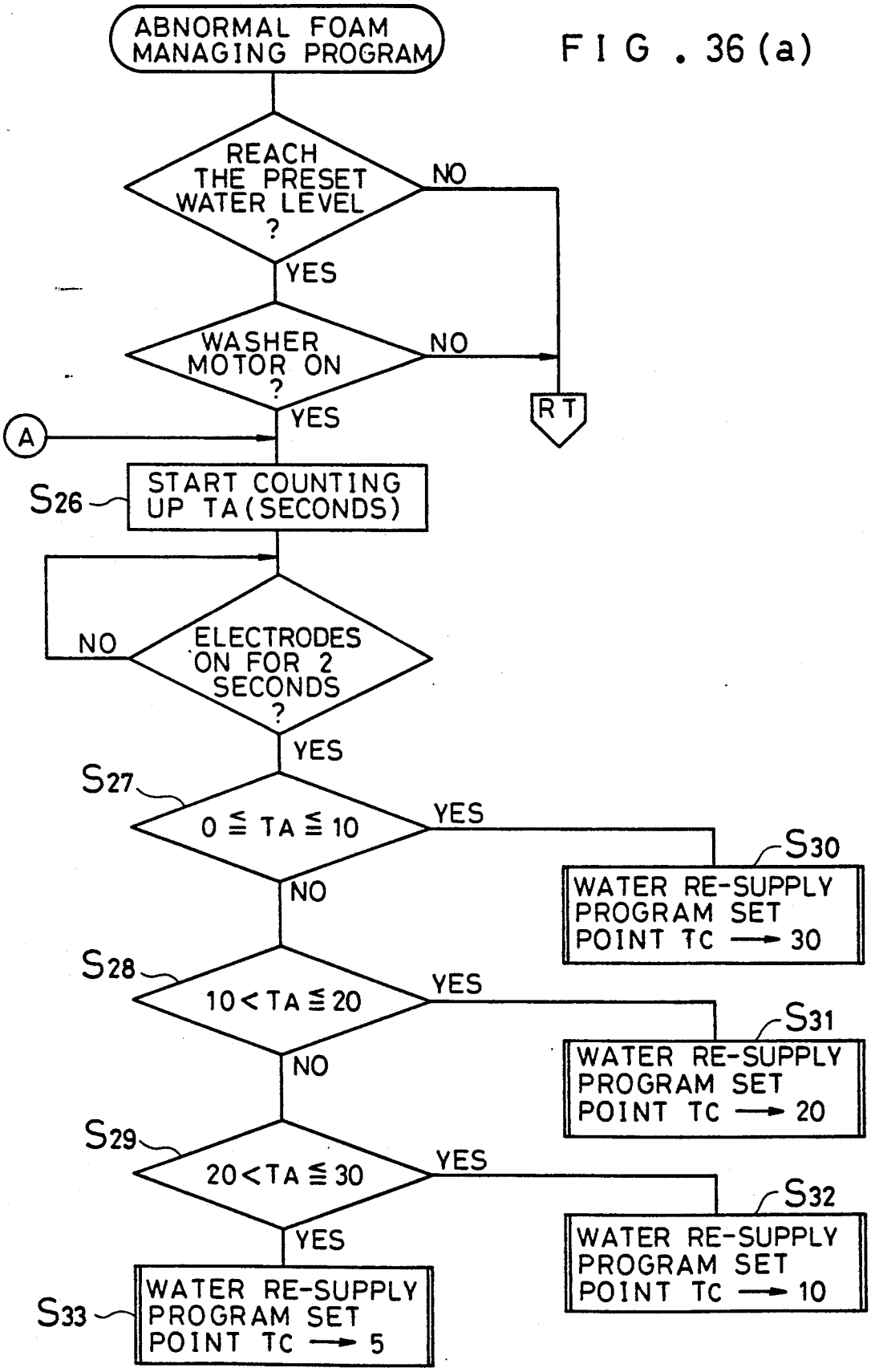
Figure 36:
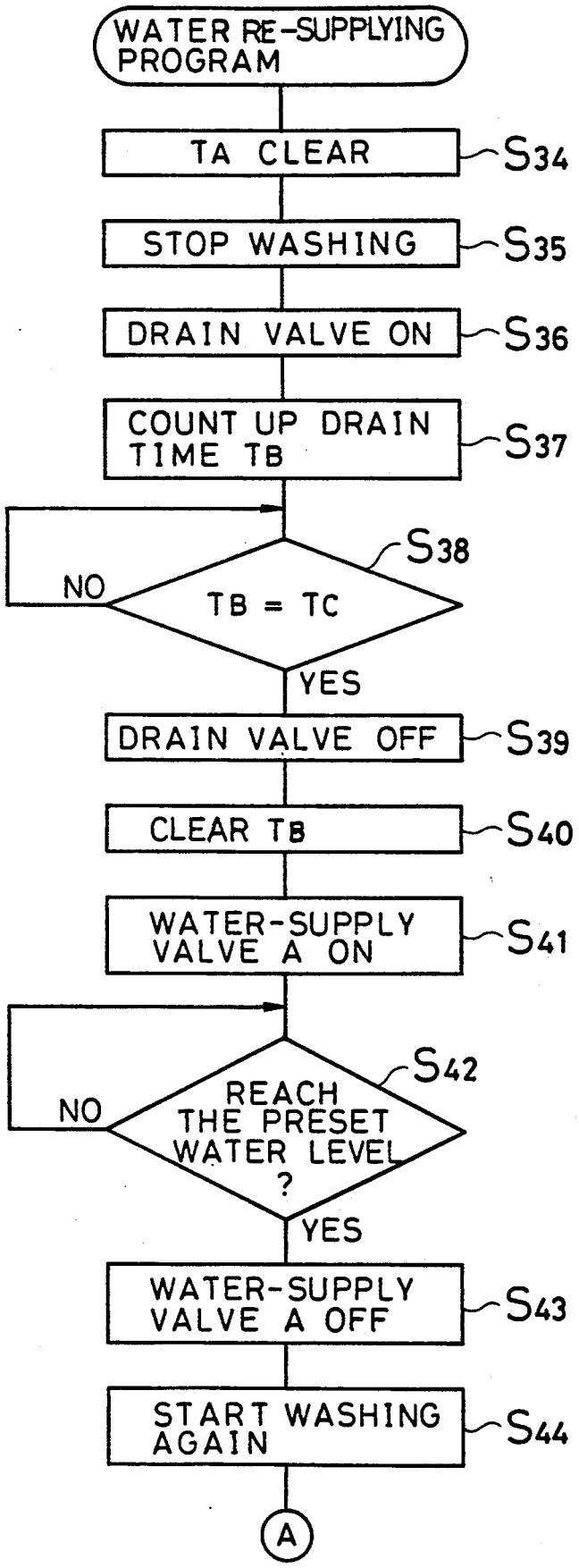

In this washing process, the abnormal foaming managing program in FIG. 36 is carried out as a sub-program at the same time. It begins to count $T_A$ seconds (S-26) simultaneously with the turn-on of the washer motor 106. At this time, foam is produced excessively due to the reversal rotation of the drum 69 depending upon the concentration of the washing agent. The foam comes in the overflow pipe 43 from the overflow outlet 42 to make the electrodes 44, 44 conductive.

Then, the microcomputer 125 counts the time $T_A$ until the electrodes 44, 44 are kept conductive for successive 2 seconds. The time $T_A$ and the reference value stored in the ROM 128 are compared (S-27) (S-28) (S-29). When $0 \leqq T_A \leqq 10$, it is estimated the degree of the abnormal foaming is extremely high, and a value $T_C$ in the next water resupplying program is set 30 seconds (S-30). Also, when $10 < T_A \leqq 20$, the value $T_C$ is set 20 seconds (S-31); when $20 < T_A \leqq 30$, the value $T_C$ is set 10 seconds; and when $T_A > 30$, the value $T_C$ is set 5 seconds (S-33), respectively. The reason why electrodes 44, 44 are kept conductive for two seconds successively is to distinguish from the conduction for a shorter period of time due to the overflowing water.

In the water re-supplying program, $T_A$ is cleared (S-34) to temporarily stop the washing operation (S-35). After discharging water for the set period $T_C$ seconds (S-37) to (S-39), water is supplied again to the predetermined water level (S-40) to (S-43), and the operation starts again.

Namely, in this abnormal foaming managing program, the washing water is diluted in accordance with the degree of the foaming, if the foam is abnormally produced, because the higher concentration of the washing agent causes the higher the degree of foaming.

Rinsing Process

The operations in the rinsing process are similar to those in the washing process shown at (S-10) to (S-25).

Hydroextracting Process

When the hydroextracting operation is performed on an overload condition such that too much laundry is put in the drum or cloth catches the drum shaft, the motors may lock or generate abnormal heat and is damaged by the heat.

Figure 37:
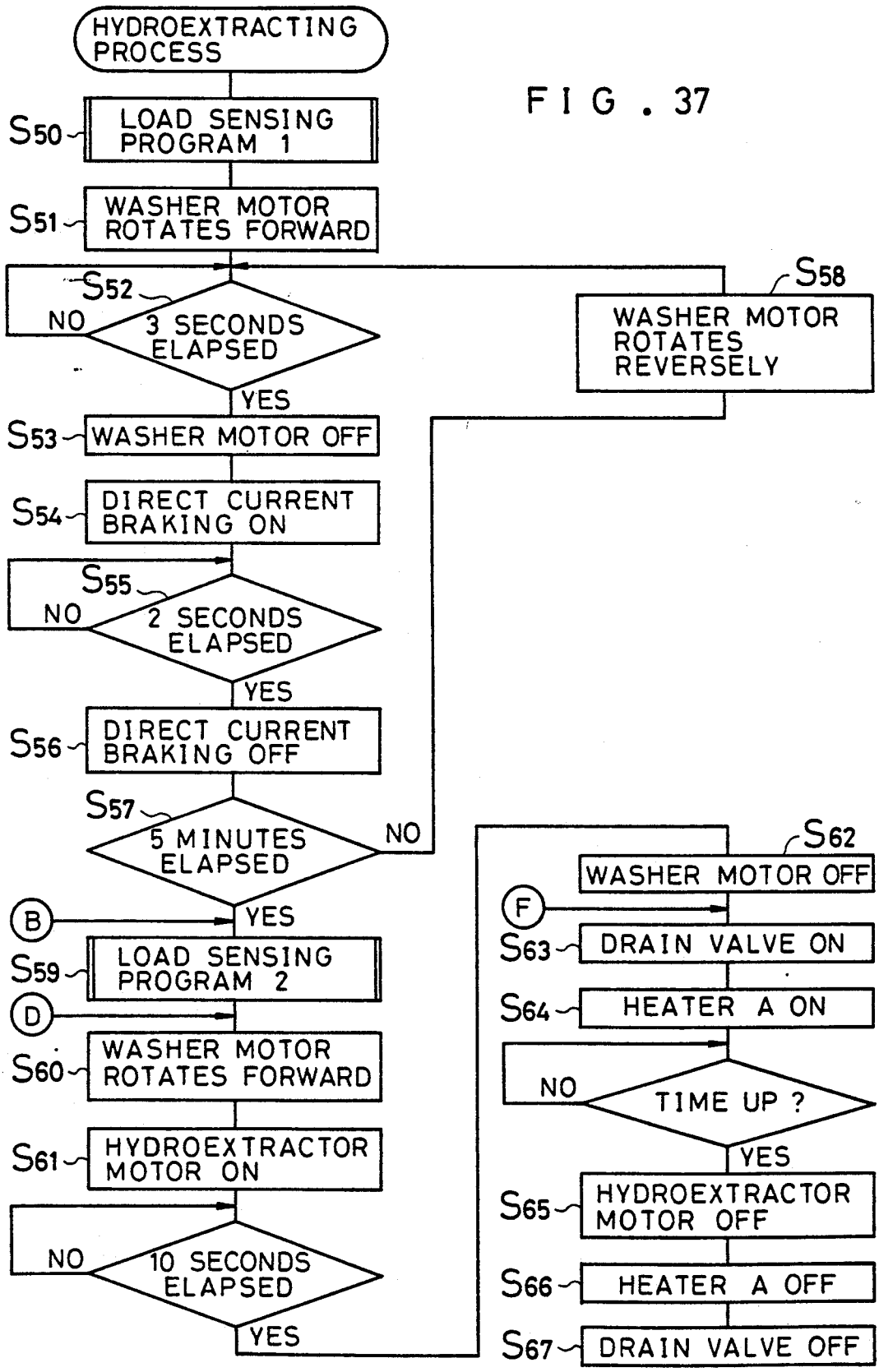

Then, as shown in FIG. 37, the load sensing program 1 (S-50) (explained later) where the overload condition is sensed is carried out. If there is nothing abnormal, the washer motor 106 rotates for five minutes in the reversal cycle of forward rotation for 3 seconds—pause for 2 seconds—reverse rotation for 3 seconds—pause for 2 seconds. Simultaneously, the direct current braking is carried out while the washer motor 106 pauses (S-51) to (S-58). This five-minutes reversal operation untangles the laundry within the drum 69 and puts it uniformly in the drum 69.

Then, the hydroextracting operation is fully performed. Before that, the load sensing program 2 (S-59) (explained later) where the overload condition is sensed is carried out. If there is sensed nothing abnormal, the washer motor 106 is, in addition to the hydroextractor motor 109, rotated forward simultaneously to smoothly start the hydroextractor motor 109 (S-60) (S-61). Ten seconds after, the hydroextractor motor 109 alone is kept rotated (S-62). The draining valve 53 is opened (S-63), the heater A (40) is turned on (S-64), and the hydroextracting operation is performed only for a set period (S-65) (S-66) (S-67).

In this hydroextracting operation, the axial flow fan 80 acts to absorb hot air heated by the heater A 40 and introduces it into the drum 69. This enhances the efficiency of dehumidification.

Figure 38:
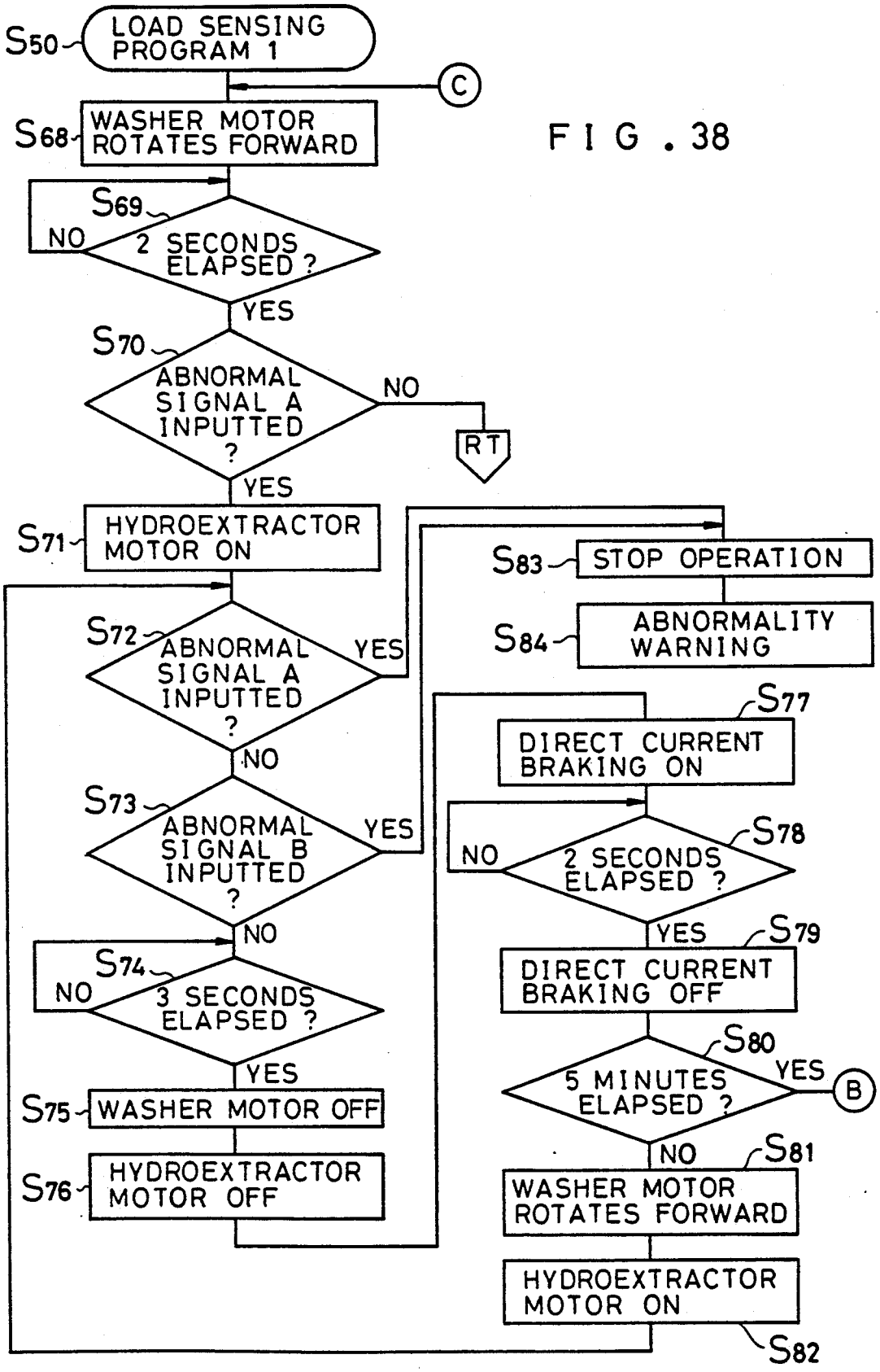

As shown in FIG. 38, in the load sensing program 1, the washer motor 106 is rotated forward for 2 seconds (S-68) (S-69), and then a condition of a signal received from the washer motor current detecting circuit 141 is searched (S-70). If the warning signal A is not found, it is decided that the drum 69 is not overloaded, and the step (S-51) and the followings are carried out.

When the warning signal A is found, instead of the reversal operation of the washer motor 106 at (S-51) to (S-58), both the washer motor 106 and the hydroextractor motor 109 rotate intermittently in the similar rotation cycle for five minutes (S-71) to (S-82). This allots the overload which should have been applied to the washer motor 106 alone to both the washer motor 106 and the hydroextractor motor 109. At (S-72) (S-73), the warning signal A or B is still found, the operation is immediately stopped (S-83), and a warning of abnormality is given (by buzzing or lighting up and out all the LEDs) (S-84).

Figure 39:
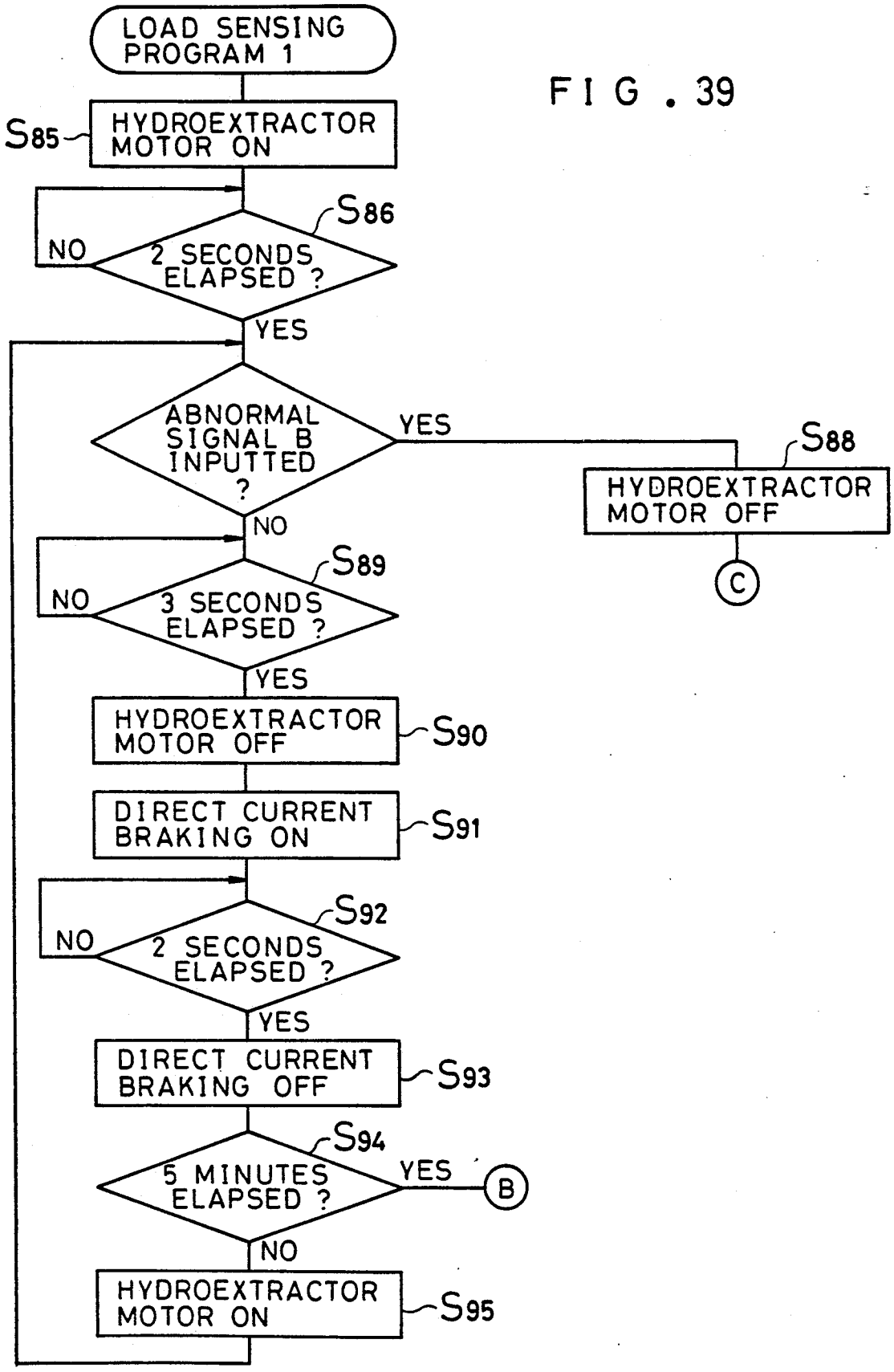

As another example of (S-50) to (S-58), the hydroextractor motor 109 may intermittently be turned on and off to untangle the laundry. In such a case, as shown in FIG. 39, the hydroextractor motor 109 is kept ON for two seconds (S-85) (S-86), and then a condition of a signal received from the hydroextractor motor current detecting circuit 142 is searched. If the warning signal B is found, the hydroextractor motor 109 is turned off (S-88), and the step (S-68) and the followings are carried out. If the warning signal B is not found, it is judged that the drum 69 is not overloaded, and the hydroextractor motor 109 is intermittently rotated for five minutes in a cycle of ON for 3 seconds—OFF for 2 seconds (including the direct current braking) (S-89) to (S-95).

Figure 40:
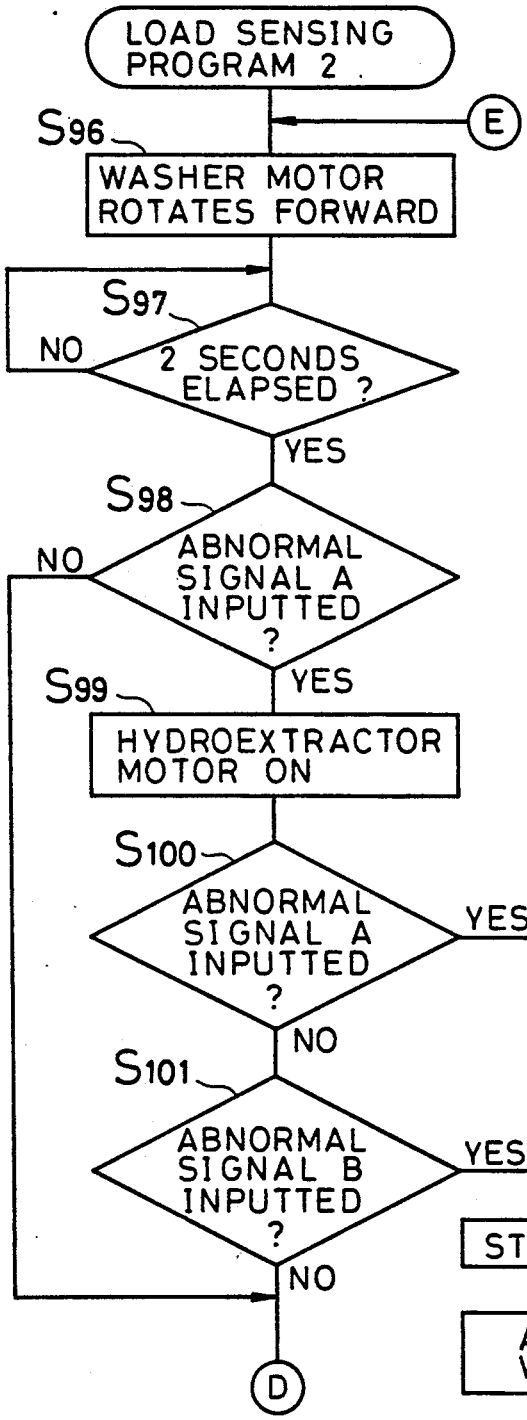

Then, in the load sensing program 2, as shown in FIG. 40, the washer motor 106 is rotated for two seconds (S-96) (S-97), and then a condition of a signal received from the washer motor current detecting circuit 141 is searched (S-98). If the warning signal A is not found, the step (S-60) and the followings are carried out. If the warning signal A is found, the hydroextractor motor 109 is further driven (S-990). After the condition is improved, the step (S-60) and the followings are carried out. If the condition cannot be improved, the operation is immediately stopped, and a warning of abnormality is given (S-100) to (S-103).

Figure 41:
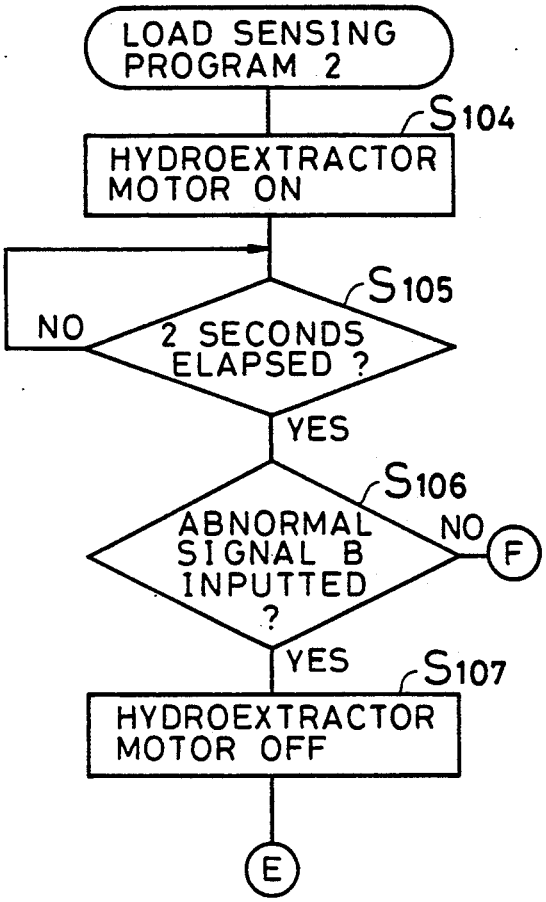

As another example of the (S-96) to (S-103), the hydroextractor motor 109 alone may start the hydroextracting operation. In such a case, as shown in FIG. 41, the hydroextracting motor 109 is kept ON for two seconds (S-104) (S-105), and then a condition of a signal received from the hydroextracting motor current detecting circuit 142 is searched (S-106). If no abnormality is found, the step (S-63) and the followings are directly carried out, and if any, the hydroextractor motor 109 is temporarily turned off (S-107), and then the step (S-96) and the followings are carried out.

Drying Process

Figure 42A:
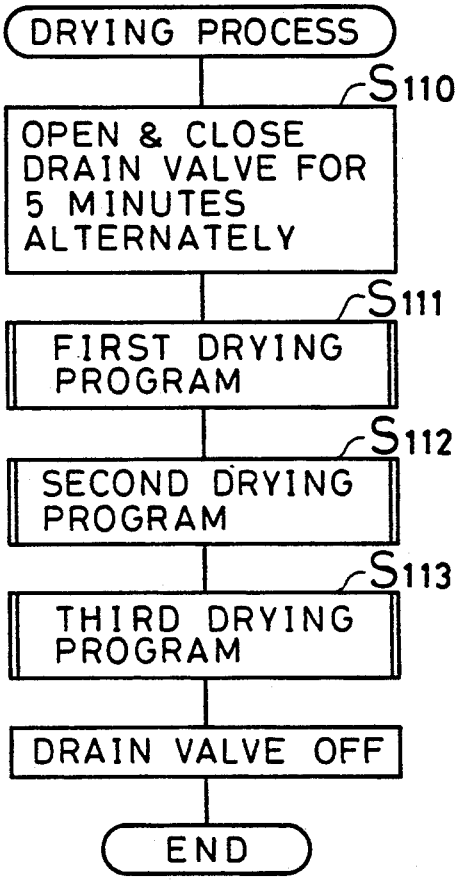
Figure 42C:
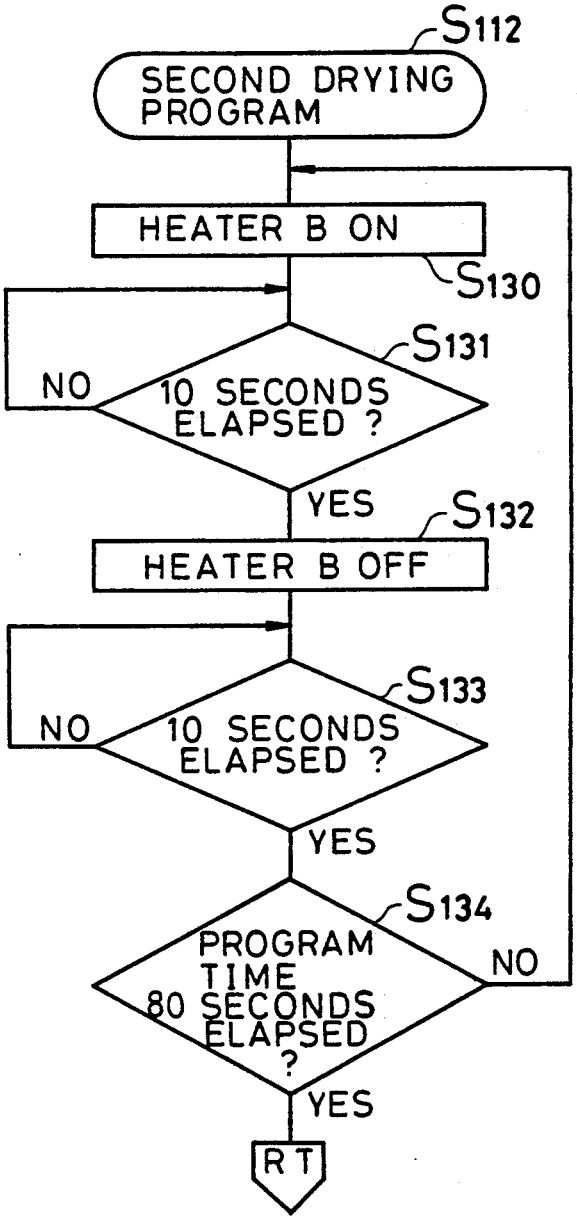
Figure 42:
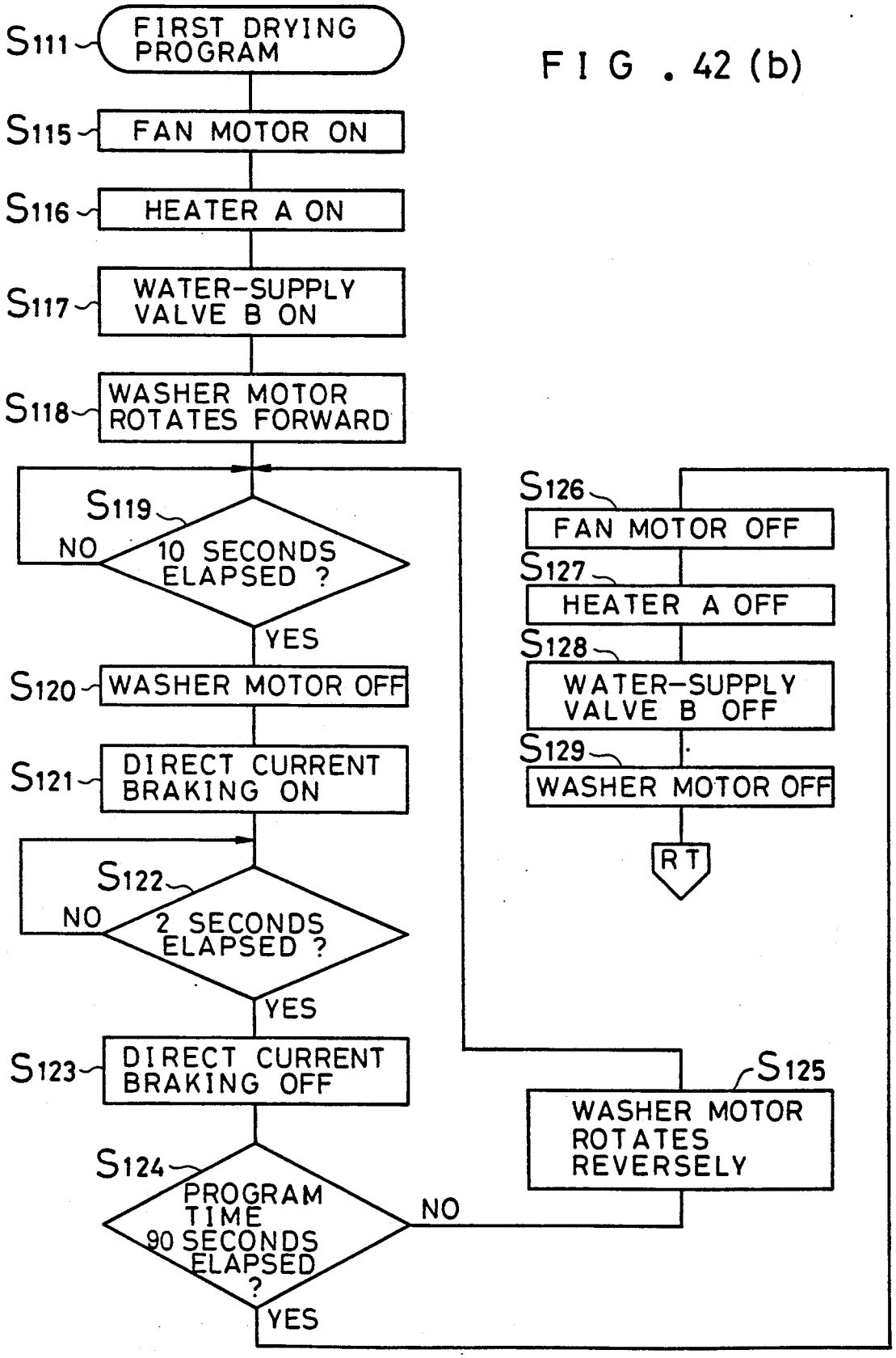
Figure 42D:
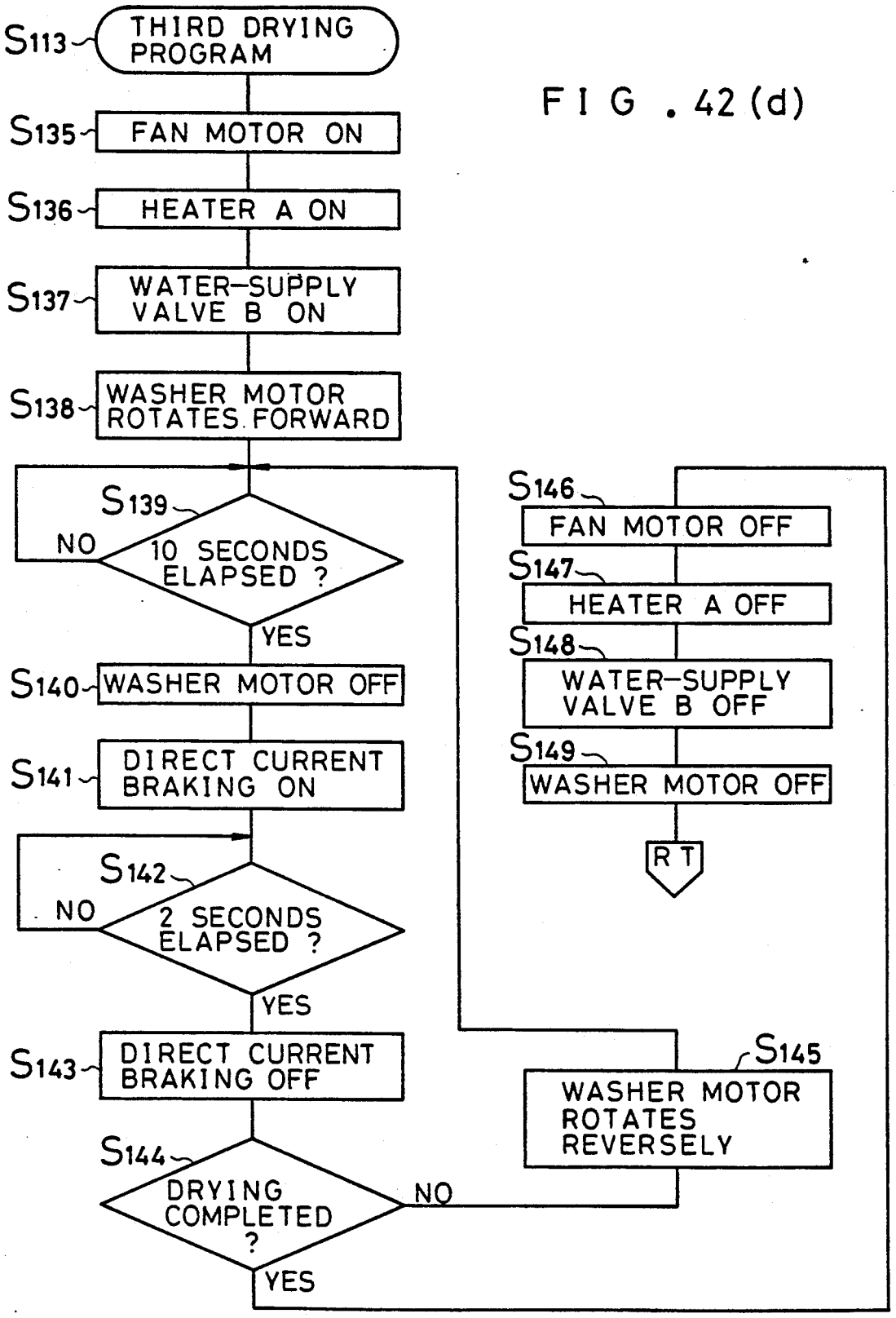

As shown in FIG. 42(*a*), this process includes four steps; intermittent turning on for 5 minutes and then off for 5 minutes (S-110), a first drying program (S-111), a second drying program (S-112) and a third drying program (S-113).

According to the first drying program (S-111), the fan motor 60, the heater A 40 and the water supplying valve B 64*b* are driven respectively, as shown in FIG. 42(*b*) (S-114) (S-115) (S-116). Additionally, the washer motor 106 is rotated for 90 seconds in the reversal cycle of forward rotation for 10 seconds—pause for 2 seconds (including the direct current braking)—reverse rotation for 10 seconds—pause for 2 seconds (including the direct current braking) (S-118) to (S-125).

This enables the hot air heated by the heater A (40) to pass through the air duct A 37 and enter the drum 69 from the inlet 78. In this way, the hot air exchanges heat with the laundry within the drum 69. The air after the heat exchange is discharged through the circulating path of the overflow outlet 42—the overflow pipe 43—the overflow hose 56—the circulating duct 62—the dehumidifying pipe 58—air duct B 61 and introduced to the heater casing 39 again.

In this circulating path, water from the water supplying valve B 64*b* drops along the inner peripheral wall surface of the dehumidifying pipe 58. As a result, the discharged air passing through the dehumidifying pipe 58 is cooled by the water and dehumidified. The humidity removed from the air is discharged together with the water out of the machine from the drain pipe 63 and the drain hose 57.

After 90 seconds has elapsed, the fan motor 60, the heater A 40, the water supplying valve B 64*b* and the washer motor 106 are turned off, and the second drying program (S-112) is carried out (S-126) to (S-129).

According to the second drying program (S-112), the heater B 68 is turned on and off for eighty seconds in the cycle of ON for 10 seconds and OFF for 10 seconds, as shown in FIG. 42(*c*) (S-130) to (S-134). In this way, the laundry cling to the inner surface of the drum 69 can be dehumidified through the bores 74. As a result, the laundry can easily come off from the drum 69.

Then, the third drying program (S-113) shown in FIG. 42(*d*) is carried out. The program steps (S-135) to (S-149) are similar to those in the first drying program (S-115) to (S-129). However, the third drying program (S-113) is completed when the completion of the drying is sensed based on a signal from the drying completion sensing circuit 145 at (S-144).

The drain valve motor 54 is intermittently driven (S-110) during the drying process. While the drain valve 53 is opened, air is discharged from the drain outlet 48. Thus, the flow of the drying air is changed in the drum 69, and the laundry can be uniformly dehumidified.

The second drying program can be carried out simultaneously with the first and third drying program.

Figure 43:
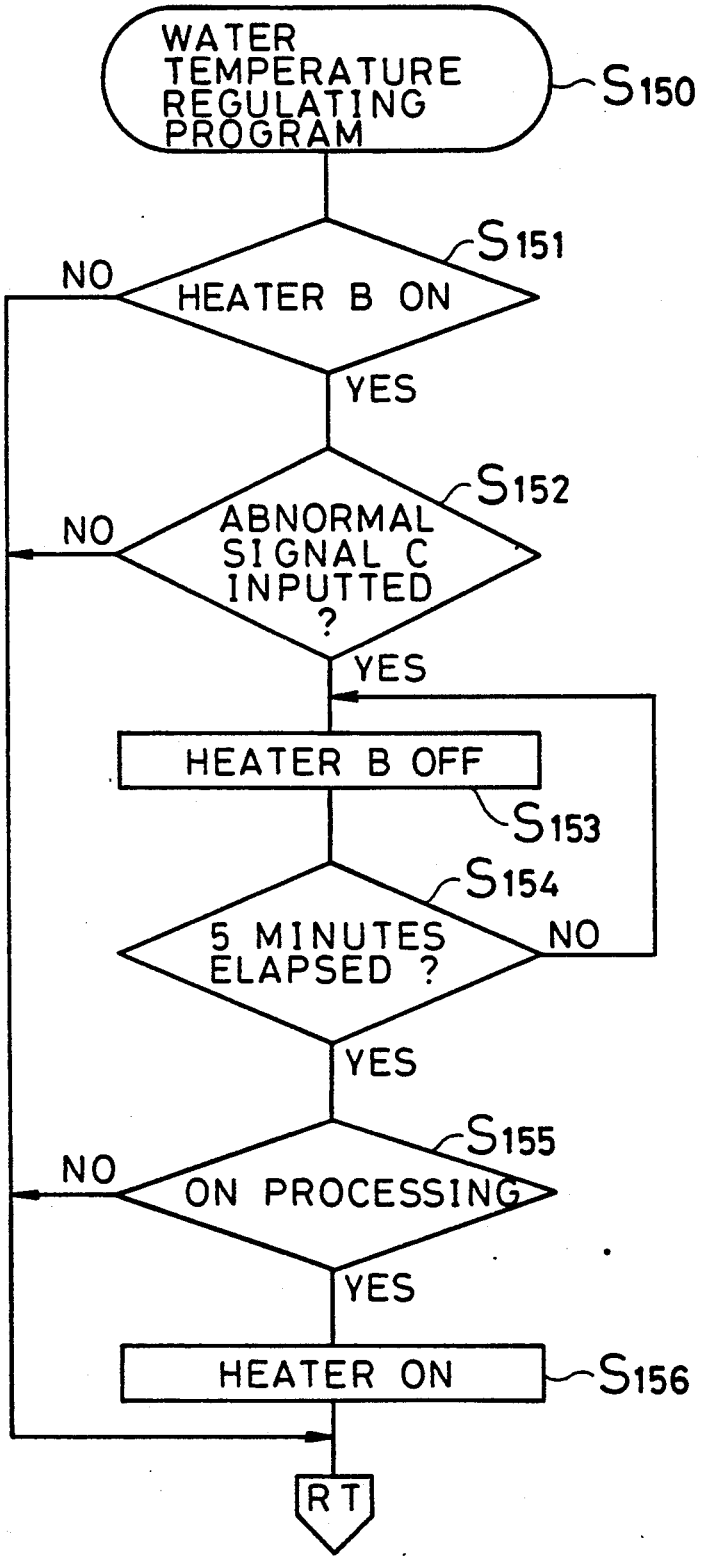

FIG. 43 shows a water temperature regulating program (S-150) which is carried out during the washing and rinsing process. When the washing water heated by the heater B 68 reaches a critical temperature, the laundry is damaged or the user is scaleded. To prevent that, the microcomputer 125 ignores the main program and forces the heater B 68 to turn off for five minutes when it receives a warning signal C from the water temperature sensing circuit 144 (S-151) to (S-156).

Figure 44:
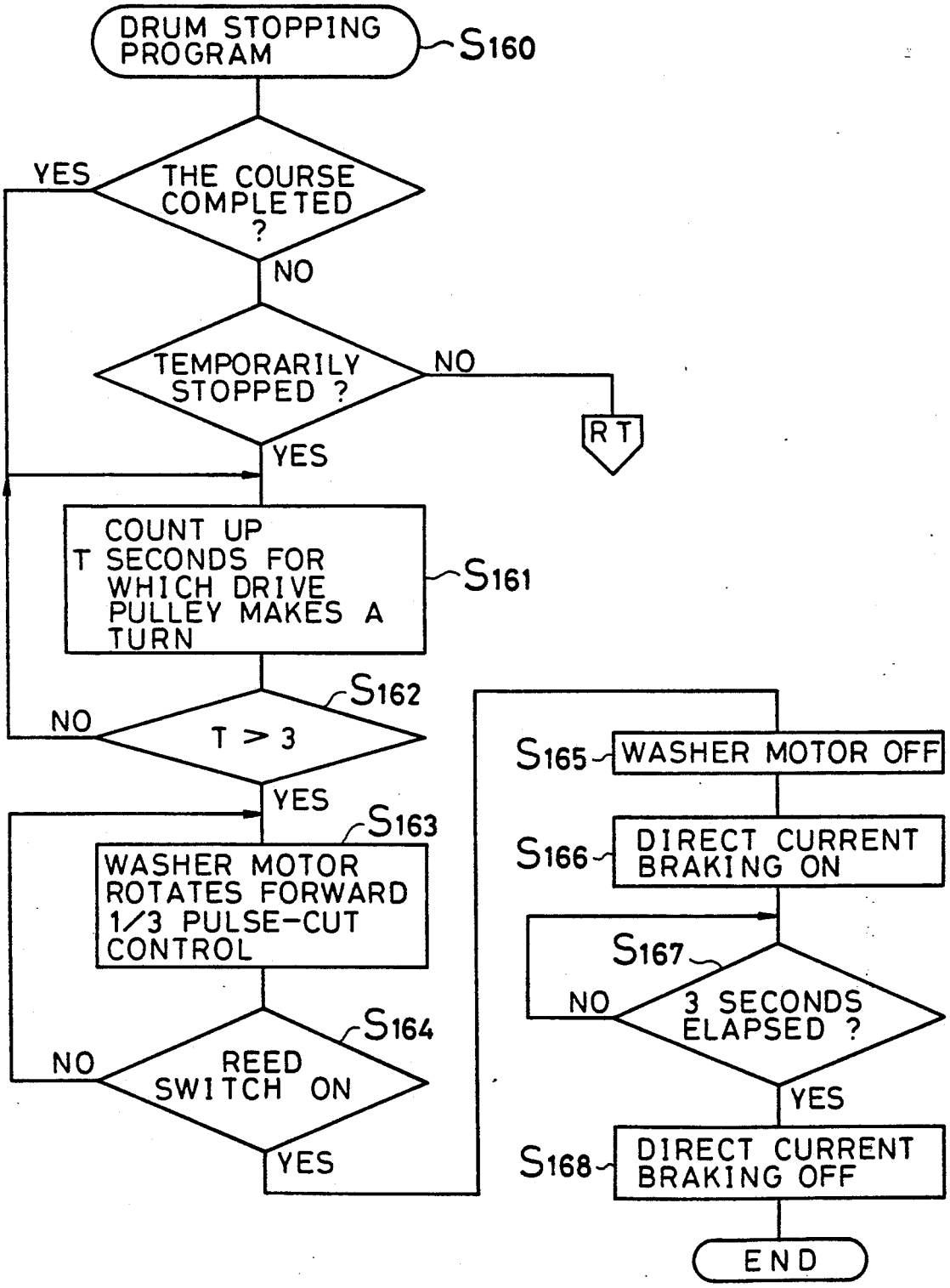

FIG. 44 shows a drum stopping program (S-160) for stopping the drum 69 always in position.

When the course is completed, when the lid 32 is kept open or when the course is interrupted by the operation of a temporary stop key (not shown), the drum 69 should be stopped with the lid 98 facing the opening B 19 for taking out the laundry easily.

In such a case, the microcomputer 125 counts a period T (seconds) which is an interval between the ON and OFF of the reed switch 121 (S-161). When $T>3$ (seconds) is satisfied, the drum 69 is rotated through the $\frac{1}{3}$ pulse cut control (S-162) (S-163). Then, immediately after the reed switch 121 turns on, the washer motor 106 is turned off while the direct current braking is performed for three seconds (S-164) to (S-168). This causes the drum 69 to immediately stop. As stated above, since the lid 98 is correlated to the reed switch 121, the lid 98 is necessarily stopped at the position above the reed switch 121.

When the lid 32 is left open, the brake shoe 117 is pressed against the brake drum 113 to come in contact with it. However, since the $\frac{1}{3}$ pulse cut control is completed before the drum 69 makes a turn, there is no possibility that the motors generate heat and the brake shoe 117 are worn.

The time till $T>3$ which comes to be satisfied can be shortened by somewhat performing the direct current braking before counting the time T.

Effects not mentioned above and still another embodiment will be presented below.

(1) In each process above stated, the drum 69 necessarily starts in the direction of the forward rotation of the washer motor 106. This direction is changed to the direction opposite to the direction of closing the lid 98, so that the lid 98 automatically closes because of the reaction in starting the drum 69, even if the lid 98 is left half-opened.

(2) The top end of the tube 18 is set at the level almost the same as the virtual circumferential plane 2*a* of the outer tub 2, and the mounting bosses 20 of the packing 24 are provided out of this level, whereby the protrusion of the tube 18 can be lowered as much as possible, and the laundry can be easily taken in and out.

(3) The claw 25 with which the safety cover 29 interlocks from the lower part is provided in the gasket 26 for pressing the top end 24*b* of the rubber packing 24. Thus, the force of the interlock acts for the horizontal wall 26*b* of the gasket 26 like a lever with the screws 27 as its fulcrum. The end portion of the horizontal wall 26*b* is pressed downward, whereby the sealing capability against water is enhanced between the rubber packing 24 and the rim 22*a* of the opening A 22.

(4) Since the filter unit 87 is placed close to the opening C 92 of the drum 69, the filter unit 87 can be easily attached and detached.

(5) The wall 37*a* of the air duct A 37, which covers the cylinder 36 is positioned close to the cylinder 36, and then the rear drum bearing 38 is fixed to the wall 37*a*. In this way, the drum shaft 79 can be shortened, and moreover, air pressure is increased because of the sectional area of the wall 37*a* is reduced.

(6) Each of the bores 74 is widened along the outward radial direction of the drum 69 as shown in FIG. 18, whereby external heated air is increasingly introduced into the drum 69, and the drying efficiency is enhanced. In addition to that, the laundry is dehumidified from the outer portion, and thus, the laundry easily comes off the drum 69 when it is completely dehumidified.

Since additional parts are employed as shown in FIG. 19, it is not necessary for the drum 69 to be subjected to any special processing, and the manufacturing cost can be reduced.

Figure 26:
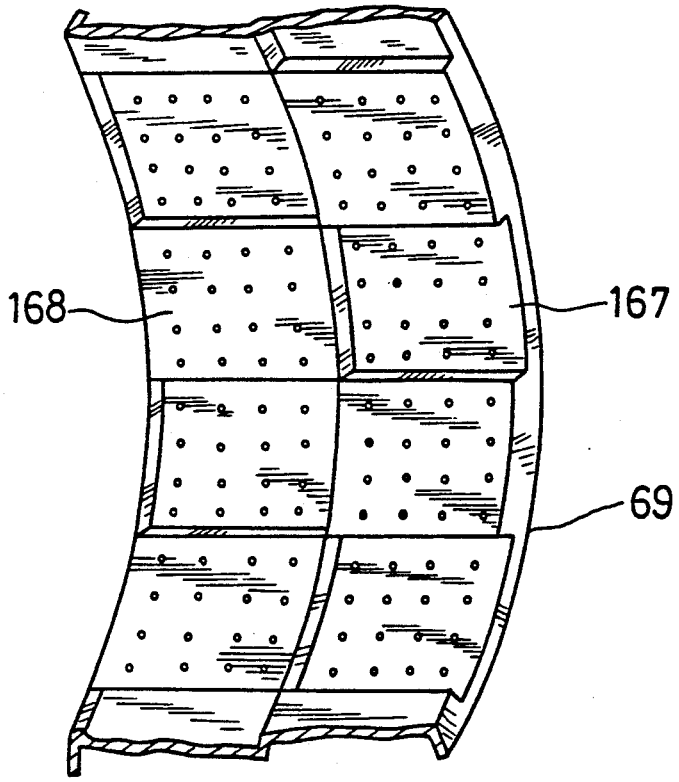
FIGS. 26 to 28 are diagrams showing different embodiments.

(7) Concave portions 167 and convex portions 168 are alternately placed checkerwise on the inner surface of the drum 69 as shown in FIG. 26, whereby the laundry does not easily cling to the inner surface of the drum 69. On washing, the laundry rubs against the drum along the circumferential and axial directions, and thus the washing capability can be enhanced.

Figure 27:
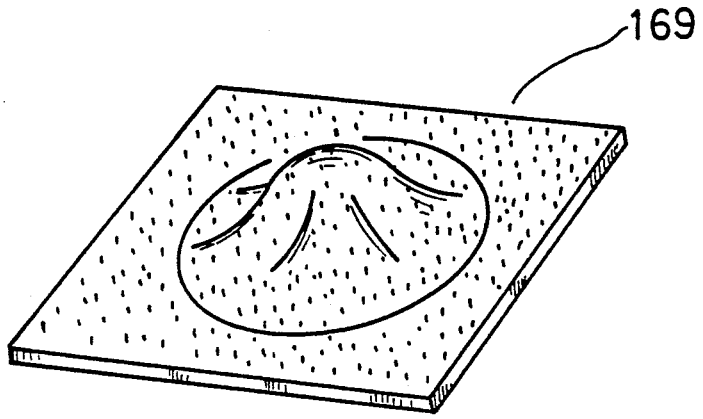

(8) A rubber bulging member 169 having hair-like protuberances on its surface as shown in FIG. 27 is provided on the inner surface of the drum 69, so that the laundry easily comes off the drum 69 because of the elastic force of the rubber member.

Figure 28:
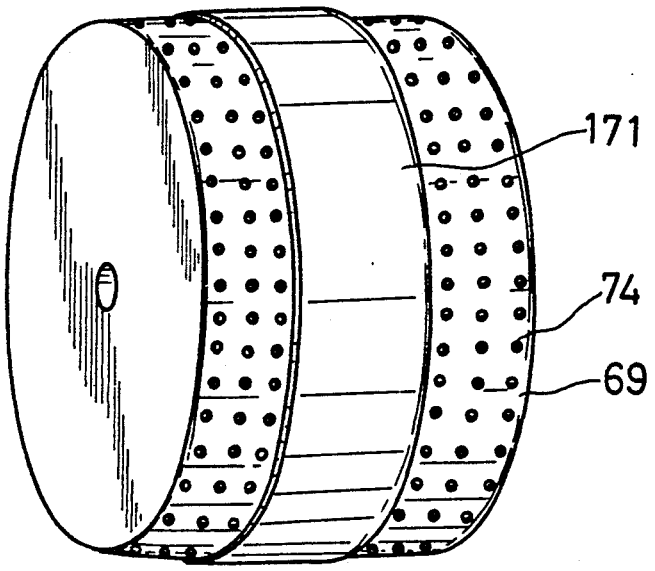
Figure 29A:
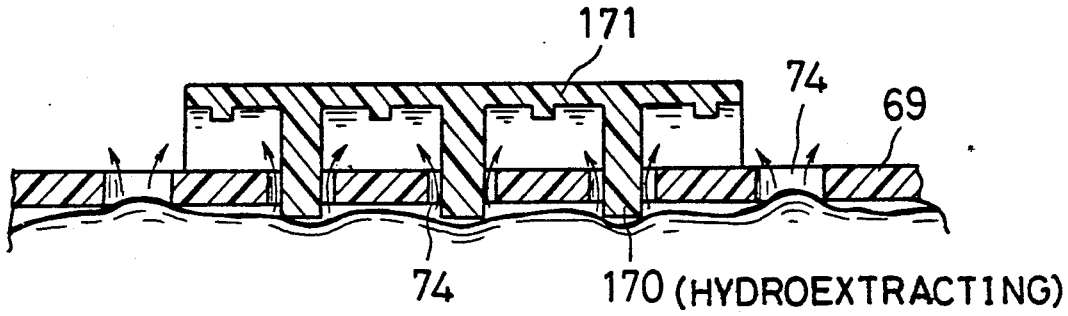
FIG. 29 is a sectional view showing a major portion in FIG. 28.
Figure 29B:
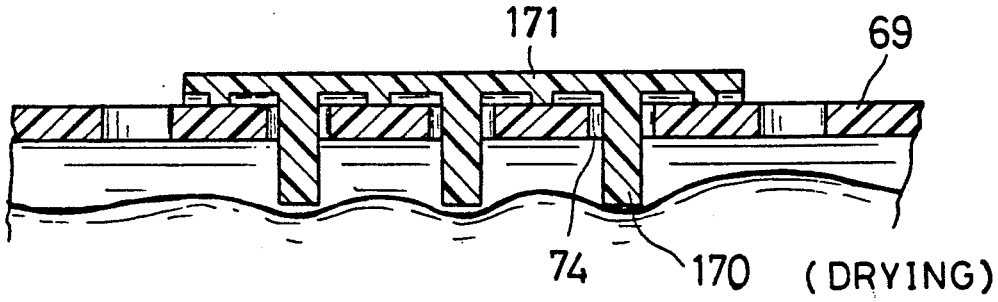

(9) A rubber band 171 having projections 170 loosely fitting into the bores 74 as shown in FIGS. 28 and 29 is wound around the outer peripheral surface of the drum 69. In the hydroextracting operation, the projections 170 is pressed out by the centrifugal force and the rubber band 171 is stretched, as shown in FIG. 29(*a*). This never reduces the hydroextracting efficiency. After the hydroextracting operation, the projections 170 protrudes into the drum 69 and push the laundry off the drum 69.

Figure 30:
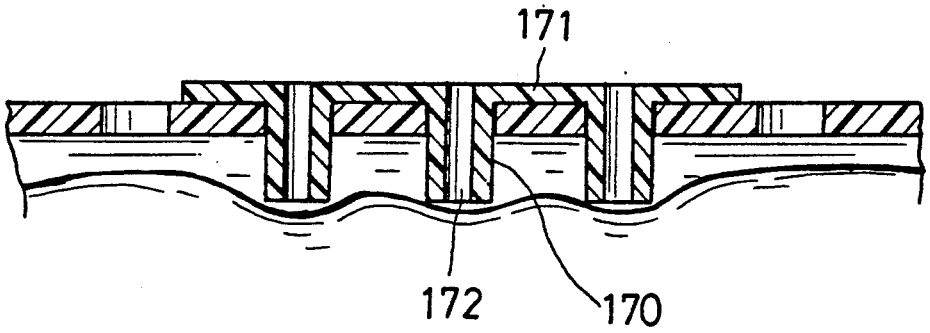
FIG. 30 is a view showing another embodiment of the portion in FIG. 29(*b*)

Apertures 172 may be formed in the projections 170 in the rubber band 171, as shown in FIG. 30. Thus, the projections 170 never prevent water from coming out of the drum 69.

(10) The angles $\theta_1$, $\theta_2$ of the horizontal ribs 75 provided in the baffle 73 are determined as mentioned above, whereby the laundry can be assuredly carried up in the drum 69 even when the drum 69 rotates at low speed.

(11) The outer tub 2 is supported by the upper supporting members 5 and the lower supporting members 15, whereby in the hydroextracting operation, the outer tub 2 decreases in the vertical and lateral amplitude, especially the amplitude at starting time, and thus, the vibration of the machine body can be suppressed.

Generally, the vibration suppressing force F for a vibration proofing member is represented as $F=m\ddot{x}+c\dot{x}+kx+\mu p$ . . . (1), where m is mass, c is attenuation coefficient, k is spring constant, $\mu$ is friction coefficient, $\ddot{x}$ is acceleration, $\dot{x}$ is speed, x is displacement and p is vertical force against the friction plane.

With the upper supporting member 5 and the lower supporting member 15 according to the present invention, the vibration is attenuated by the expansion and contraction force of the spring A 11 and the spring B 16, and the mutual frictional force between the supporting rod 9 and the aperture 7*a*, and between the spring B 16 and the elastic cylinder. The above equation (1) comes to be $F=kx+\mu p$ . . . (2) for both the upper and lower supporting members 5 and 15. When the vibration is suppressed, the $\mu$ has a significant influence; particularly, since static friction coefficient is larger than kinetic friction coefficient, the vibration at the starting time is very effectively suppressed. The elastic cylinder 17 of the lower supporting member 15 has restoring force against deformation and is considerably helpful for suppressing the lateral vibration.

Figure 31:
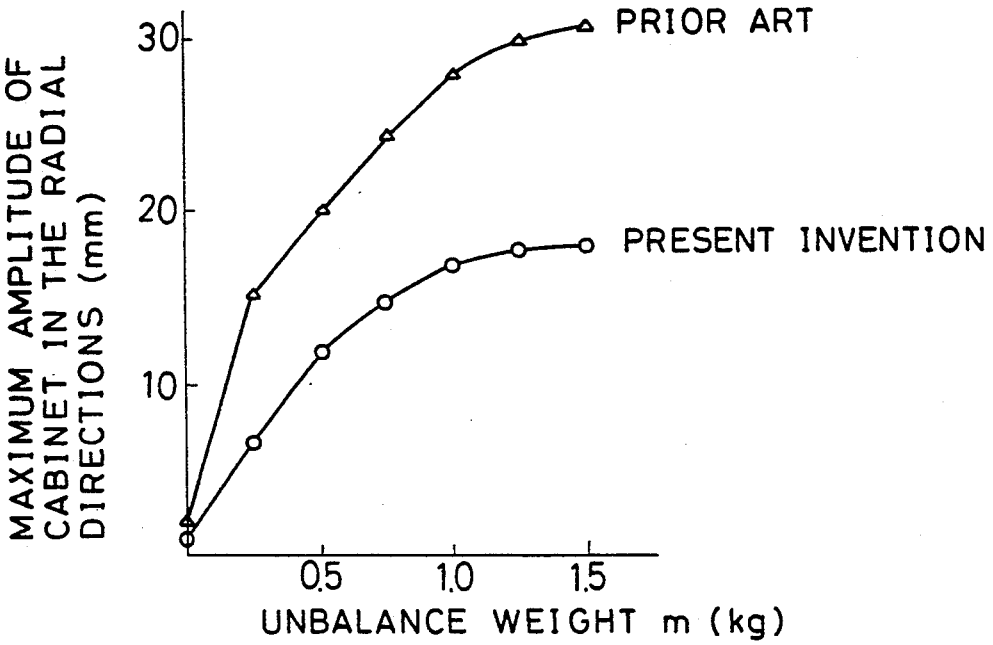
FIG. 31 is a graph showing the relations between the load and the amplitude.
Figure 32:
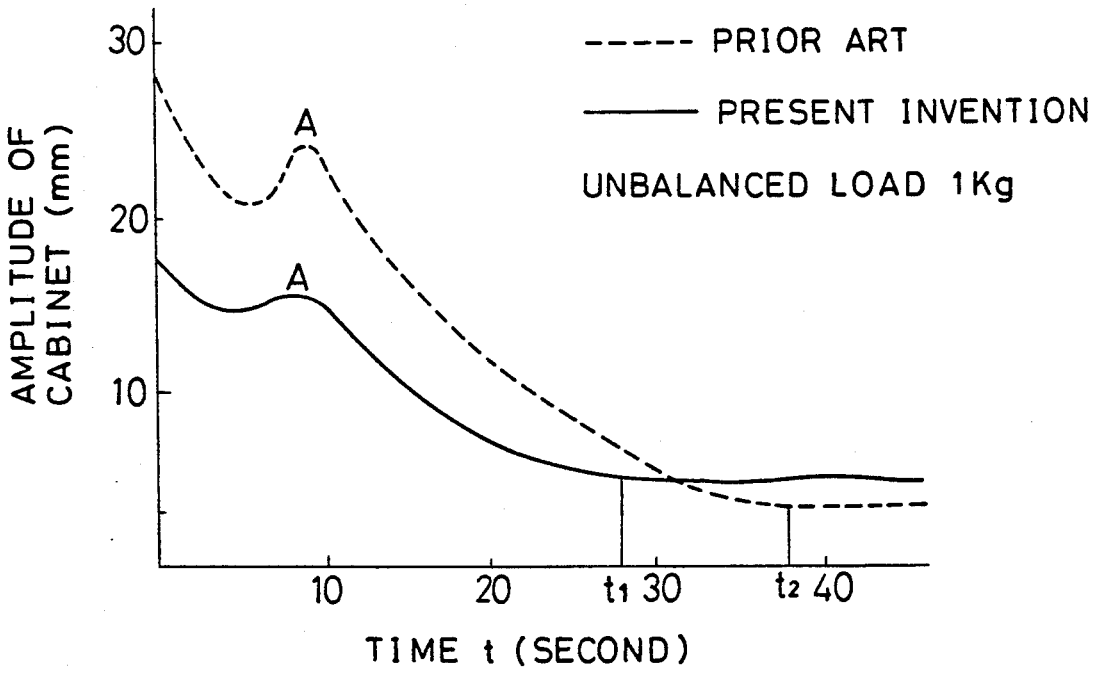
FIG. 32 is a graph showing the relations between the time and the amplitude.

FIGS. 31 and 32 present experimental proofs of the aforementioned matters.

FIG. 32 shows the relations between vibration characteristics and time, and FIG. 31 shows the vibration characteristics for different loads. In any cases, the amplitude can be considerably suppressed compared to a prior art embodiment.

As the prior art example, a spring unity is used for an upper supporting member, and a shock absorber is used for a lower supporting member. According to such a prior art embodiment, the upper vibration suppressing force $F_1$ is given by the extension and contraction of a spring. From the above equation (1), $F_1=kx$ . . . (3) is obtained. The lower vibration suppressing force $F_2$ given by the shock absorber is in accordance with the change in speed, and $F_2=c\dot{x}$ . . . (4) is obtained.

With regard to the equation (3), since merely the expansion and contraction of the spring acts the suppressing force, an attenuating time of the vibration is long. With regard to the equation (4), the suppressing force $F_2$ is extremely small at the starting time when the speed is almost zero, and experimental data proves the assumption is correct.

With regard to the vibration attenuating property of the spring, good following property of the spring causes resonance phenomena soon after the starting, as shown by point A in FIG. 32. In this embodiment, since the friction force also acts, the resonance phenomena is not so significant, and the vibration is easily attentuated, and thus, it takes short time to start the normal rotation ($t1<t2$).

Figure 33:
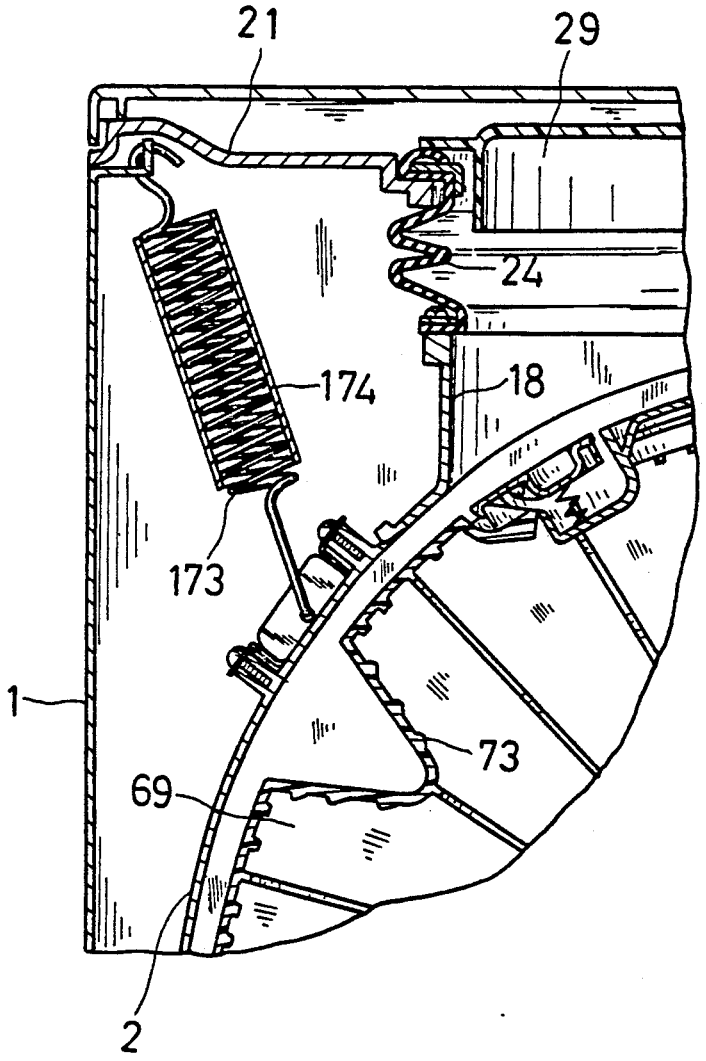
FIG. 33 is a sectional view showing a major portion of another embodiment of the upper supporting member.

FIG. 33 shows further another embodiment where the upper supporting members 5 has an elastic cylinder 174 placed surrounding a spring C 173 similar to the lower supporting member 15.

Figure 45:
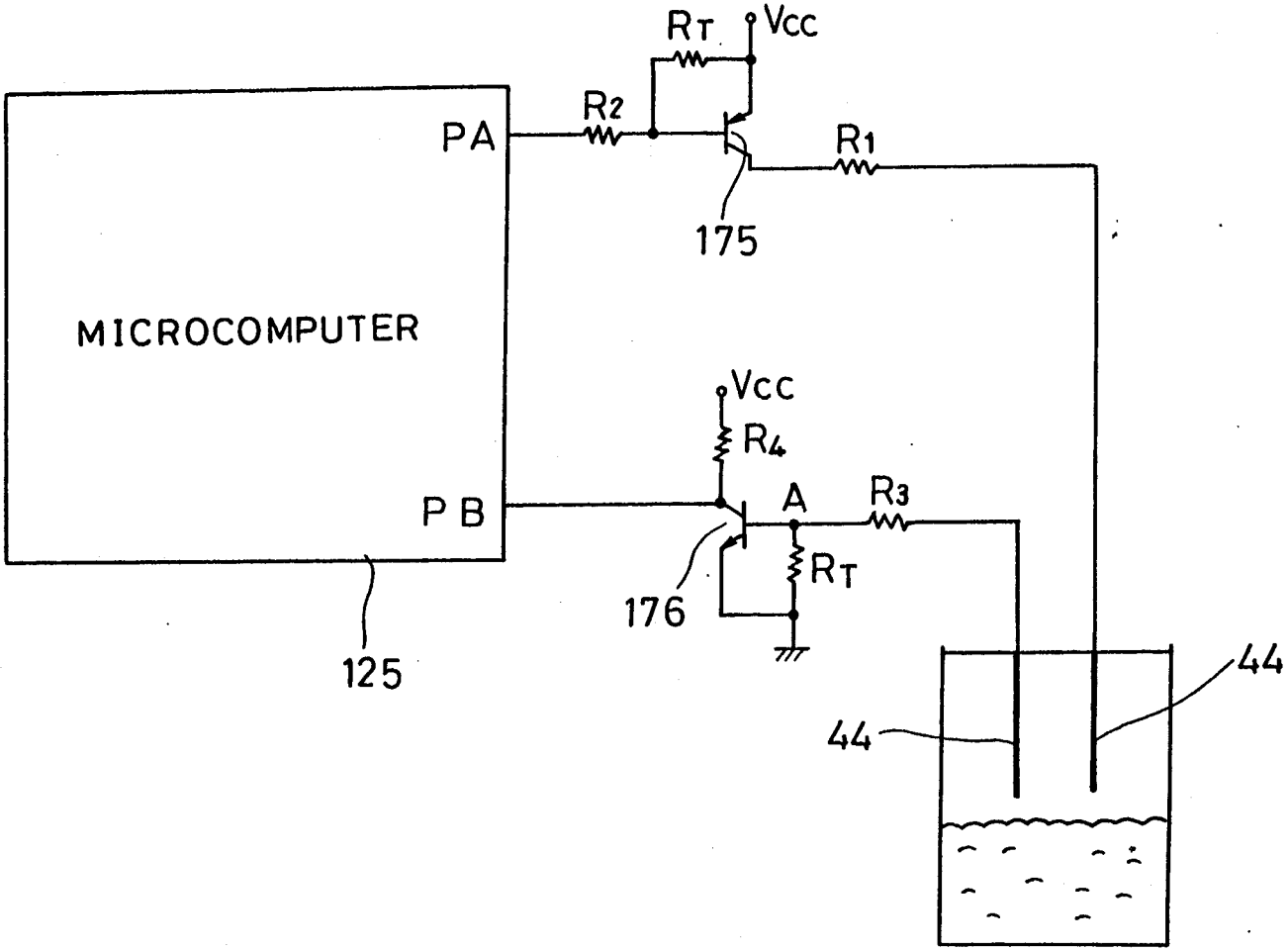
FIG. 45 is a diagram showing a foaming sensing circuit.

(12) FIG. 45 shows another example of the abnormal foam sensing circuit employing the electrodes 44, 44.

One of the electrodes 44, 44 is connected to a terminal PA of the microcomputer 125 through resistances $R_1$, $R_2$ and a transistor A 175 (2SA1317-type), and the other electrode 44 is connected to a terminal PB of the microcomputer 125 through a resistance $R_3$ and a transistor B 176 (2SC3331-type). The resistances $R_2$, $R_4$ are resistances for limiting current, and the resistance RT is a resistance for ensuring the turning-ON and -OFF of the transistors.

During the washing process, the microcomputer 125 has its terminal PA grounded. When the foam generated makes the electrodes 44, 44 conductive, the transistor B 176 turns on, and the terminal PB is grounded. In this way, the microcomputer 125 recognizes the foam generated. During processes other than the washing process, the terminal PA is left disconnected not to turn the transistor A 175 on. In this way, false sensing due to the water splashing on the electrodes 44, 44 is avoided, and the corrosion of the electrodes 44, 44 can be prevented because no electric current flows.

Figure 66:
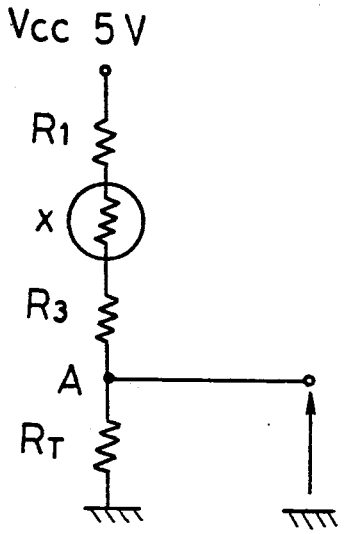
FIG. 66 is a diagram showing an equivalent circuit, presented for explaining FIG. 45.

FIG. 66 shows an equivalent circuit for determining the resistances $R_1$ to $R_4$ and RT.

In FIG. 66, the potential at the point A is given by the following formula:

$$\frac{R_T}{R_1 + x + R_3 + R_T} \times Vcc \qquad \text{(a)}$$

where x is resistance of the foam.

In order to turn the transistor B 176 on, the potential at the point A must be more than about 0.7 V. Allowing for that the resistance of the foam is about 50 KΩ and assuming that $R_1=R_3=5.6$ KΩ, $R_T=12$ KΩ and Vcc=5 V, it is found that the potential at the point A is about 0.82 V from the formula (a), and the foam can be sensed by the electrodes 44, 44.

The resistance of vapor in the atmospheric air is more than several MΩ. Assuming x=1MΩ, it is found from the formula (a) that the potential at the point A is about 0.059 V, and the transistor B 176 never turn on. Thus, the conduction of the electrodes 44, 44 due to the vapor in the air is never sensed.

Figure 46:
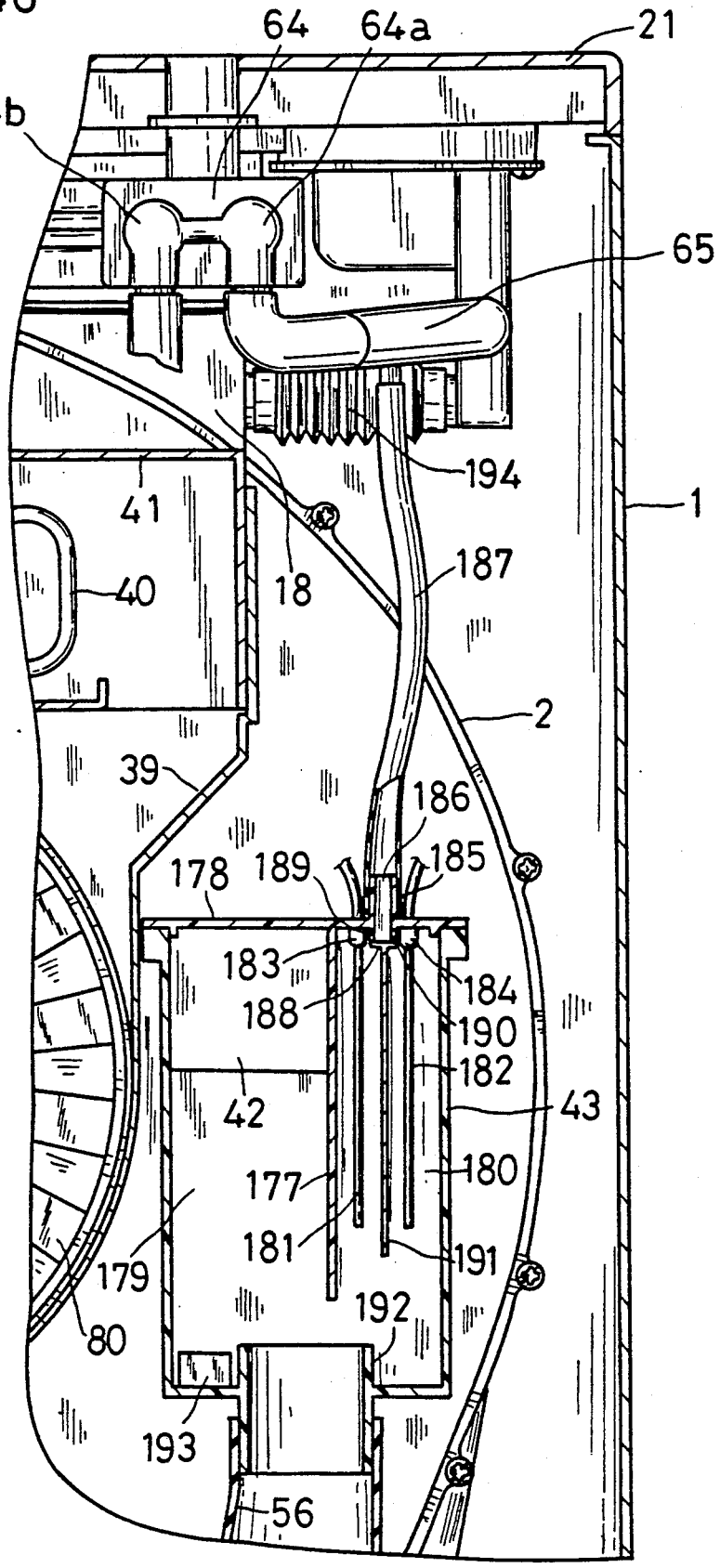
FIG. 46 is a sectional view showing a major portion of another example of an abnormal foaming sensing structure in the washing machine.
Figure 47:
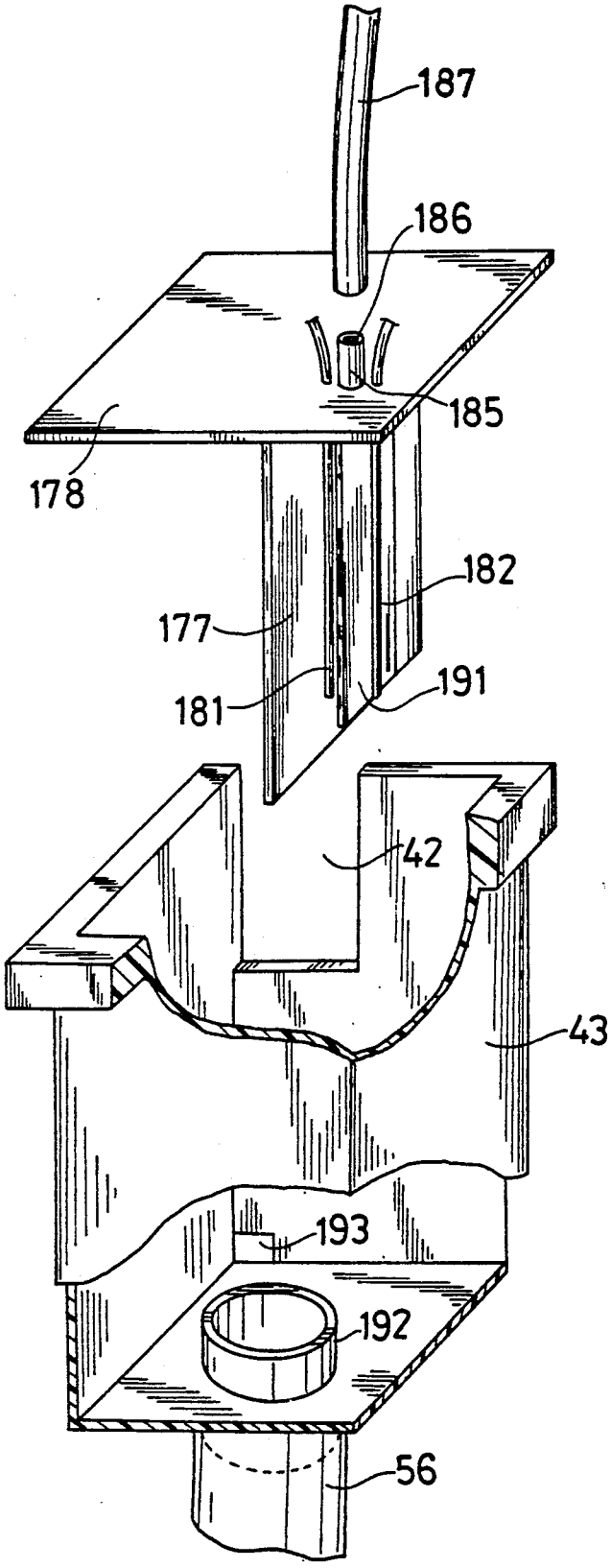
FIG. 47 is a exploded perspective view showing an overflow pipe of the washing machine.

(13) Another embodiment of the foam sensing means will be explained with reference to FIGS. 46 and 47.

A partition plate 177 is integrally formed on the bottom surface of a lid 178 which covers the upper face of the overflow pipe 43, hanging down from the bottom surface of the lid 178. The partition plate 177 separates the inner room of the overflow pipe 43 into two cells 179, 180 which communicate with each other only in the lower part. The overflow outlet 42 is provided on the upper part of the cell 179 of the two cells 179, 180. A pair of rod-shaped electrodes 181, 182 as the foam sensing means is suspended from the lid 178 in the cell 180 of the two cells 179, 180. These electrodes 181, 182 become conductive similar to the electrodes 44, 44 when the excessive foam is generated and sends a signal to the microcomputer 125.

Elastic insulating members 183, 184 are attached to protect the mounting portion of the electrodes 181, 182 and to prevent the electrodes 181, 182 from bending at respective roots. A joint pipe 185 as a part of the water supply means is integrally formed on the lid 178. A water supply branch pipe 187 as a part of the water supply means, which is branching away from the inlet hose A 65, is connected to one end 186 projecting over the upper face of the lid 178. The other end 188 projects between the electrodes 181, 182 below the bottom face of the lid 178. Ports 189, 190 are provided on both sides of the other end 188, directed to the root portions of the electrodes 181, 182.

A separating plate 191 is integrally provided, hanging down from the other end 188 of the joint pipe 185, and its lower end reaches a position under the electrodes 181, 182. The separating plate 191 is wide enough to conceal the electrodes 181, 182 from each other, but is narrower than the partition wall 177. An outlet 192 is provided at the end of the overflow hose 56, and is projected upwardly from the overflow pipe 43. A ventilator 193 is provided in a position lower than the upper end of the outlet 192 to communicate the outer tub 2 and the overflow pipe 43. The ventilator 193 is smaller in the area of its opening than the outlet 192.

Thus, while water is supplied to the outer tub 2, water is also introduced into the cell 180 of the overflow pipe 43 from the water supply branch pipe 187. The water supplied into the cell 180 is poured from the ports 189, 190 onto the electrodes 181, 182 to clean them from their roots.

(14) Different embodiments of the abnormal foam managing program (FIG. 36) will be described with reference to FIGS. 48 to 53.

Figure 48:
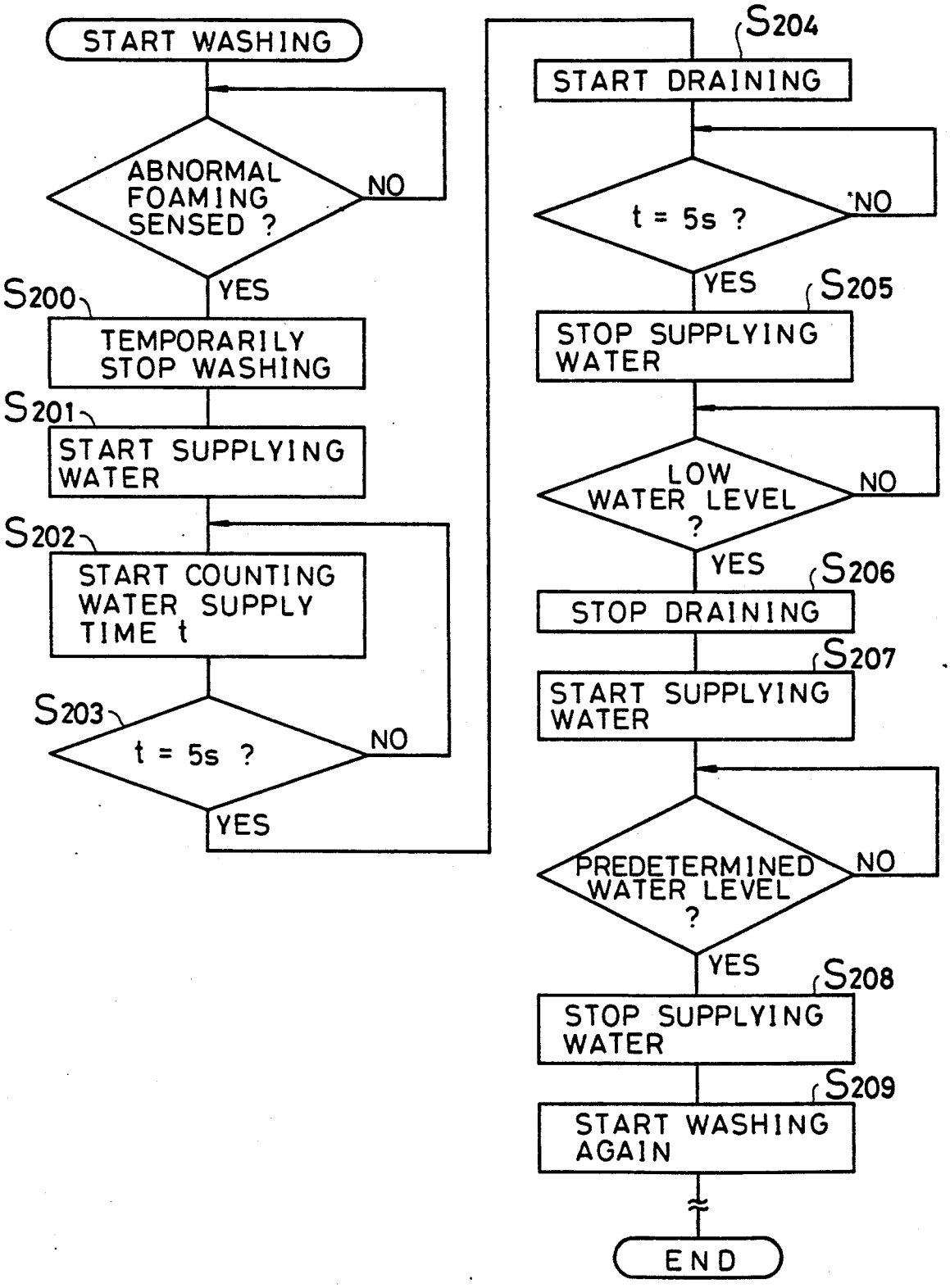

In FIG. 48, when the abnormal foaming is sensed, the washing operation is temporarily stopped (S-200), and water supply to the tub begins (S-201). The water supplying operation is carried out for ten seconds. Five seconds after the beginning of the water supply, water is also discharged (S-202) to (S-205). The discharging operation is completed when the water level in the tub reaches the Low level (S-206). Then, after water is supplied to the set level again (S-207) (S-208), the washing operation is started again (S-209).

In this way, in the defoaming operation, water is resupplied and thereafter the water in the tub is discharged so that the washing water which has been defoamed by supplying water is discharged. Thus, there is no possibility the foam flows reversely from the overflow hose 56 to the overflow pipe 43.

In FIG. 49, when the abnormal foaming is sensed, the washing operation is temporarily stopped (S-210), and a counter starts counting a defoaming time T (S-211). At the same time, the water supply valve A **64*a*** is repeatedly driven in the cycle where it turns ON for 2 seconds and OFF for 2 seconds to intermittently supply water to the tub (S-212) to (S-217). After the defoaming time T, 30 seconds, has elapsed, the water in the tub is discharged while water is being supplied (S-218). When a discharging time T, 1 minutes, has elapsed, water supply and drainage are completed (S-219), and the washing operation starts again (S-220).

Figure 50:
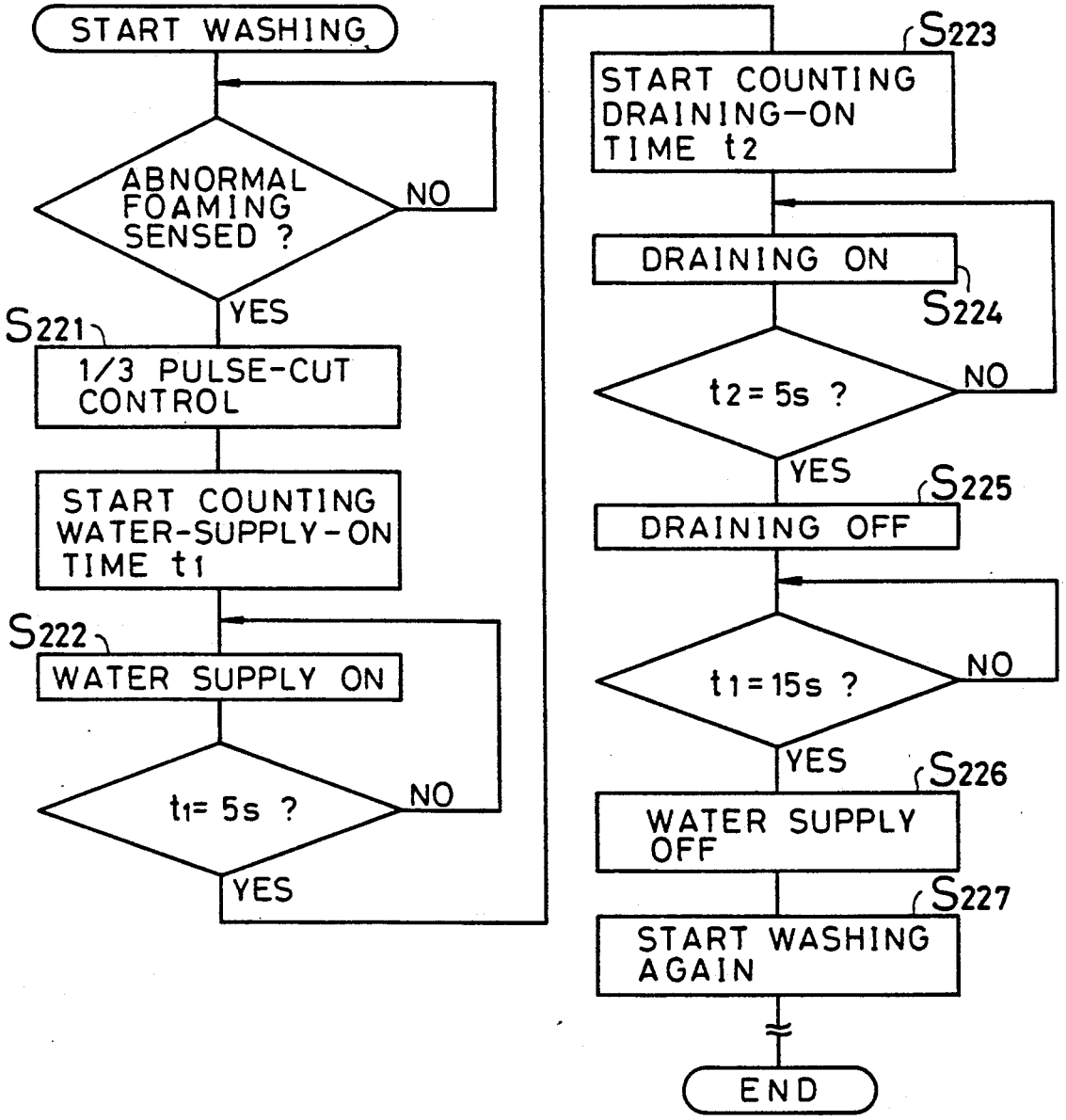

In FIG. 50, when the abnormal foaming is sensed, the drum is rotated through the ⅓ pulse cut control in the washing operation (S-221), and water supply to the tub starts (S-222). The water supplying operation continues for 15 seconds. Five seconds after the beginning of the water supply, the water in the tub 2 is also discharged for five seconds (S-223) to (S-225). 15 seconds after, the water supply is completed (S-226), and the washing operation is started again (S-227).

Figure 51:
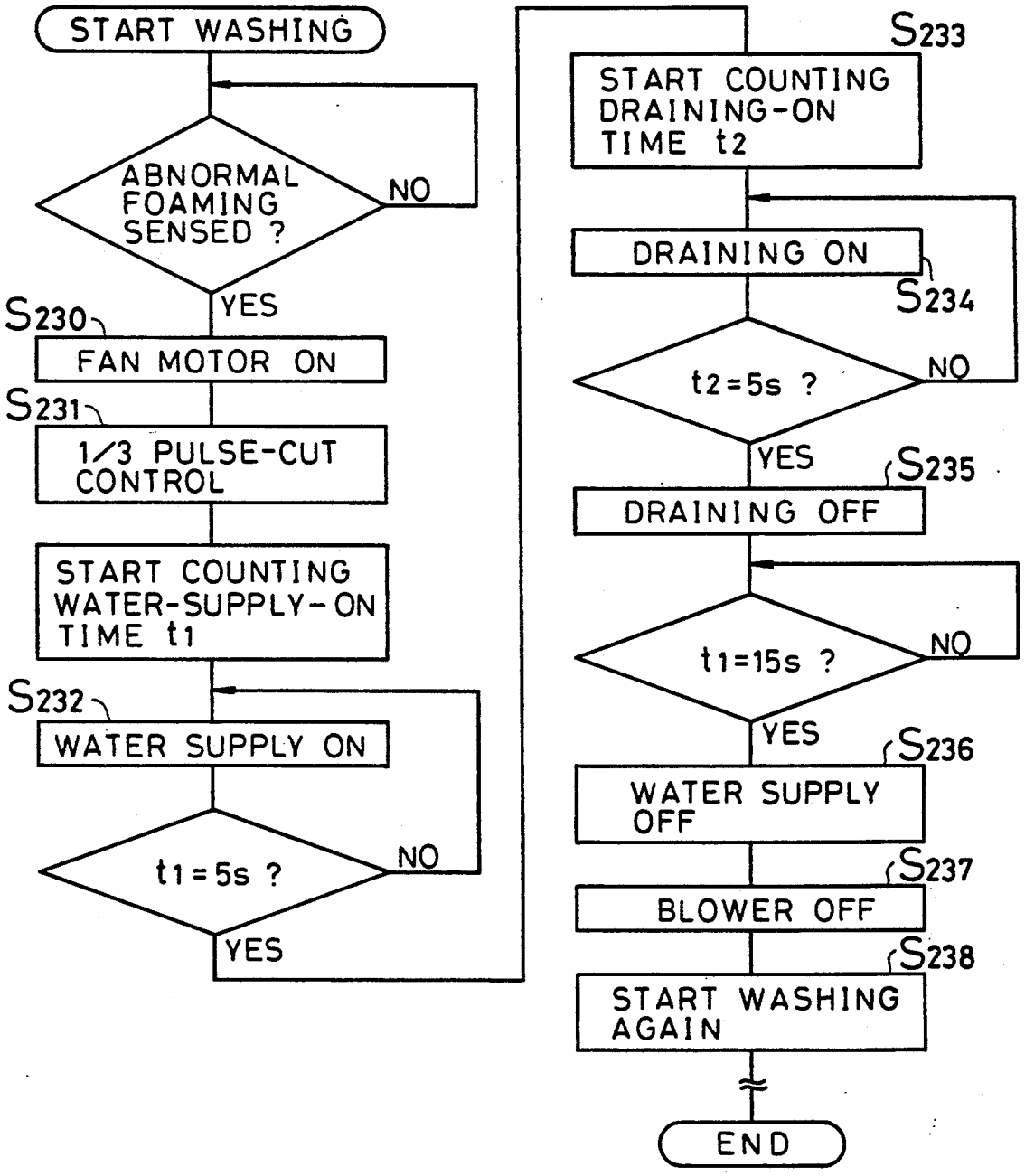

In FIG. 51, when the abnormal foaming is sensed, the fan motor 60 is driven to introduce air into the tub (S-230). At the same time, the drum is rotated through the ⅓ pulse cut control in the washing operation (S-231), and then water supply is started (S-232). The water supplying operation is carried out for 15 seconds. 5 seconds after the beginning of the water supply, the water in the tub 2 is also discharged for five seconds (S-233) to (S-235). When 15 seconds has elapsed, the water supply is completed (S-236), and the fan motor 60 is turned off (S-237), and the washing operation is started again (S-238).

½ pulse cut control is a braking operation as previously mentioned, but it does not stop the drum 69 completely; the drum 69 very slowly rotates under this control (at 1/10 speed compared with the speed in successively turning the motor on). The control at the steps S-221 and S231 is not limited to the ⅓ pulse cut control, but the ½ pulse cut control may be employed.

Figure 52:
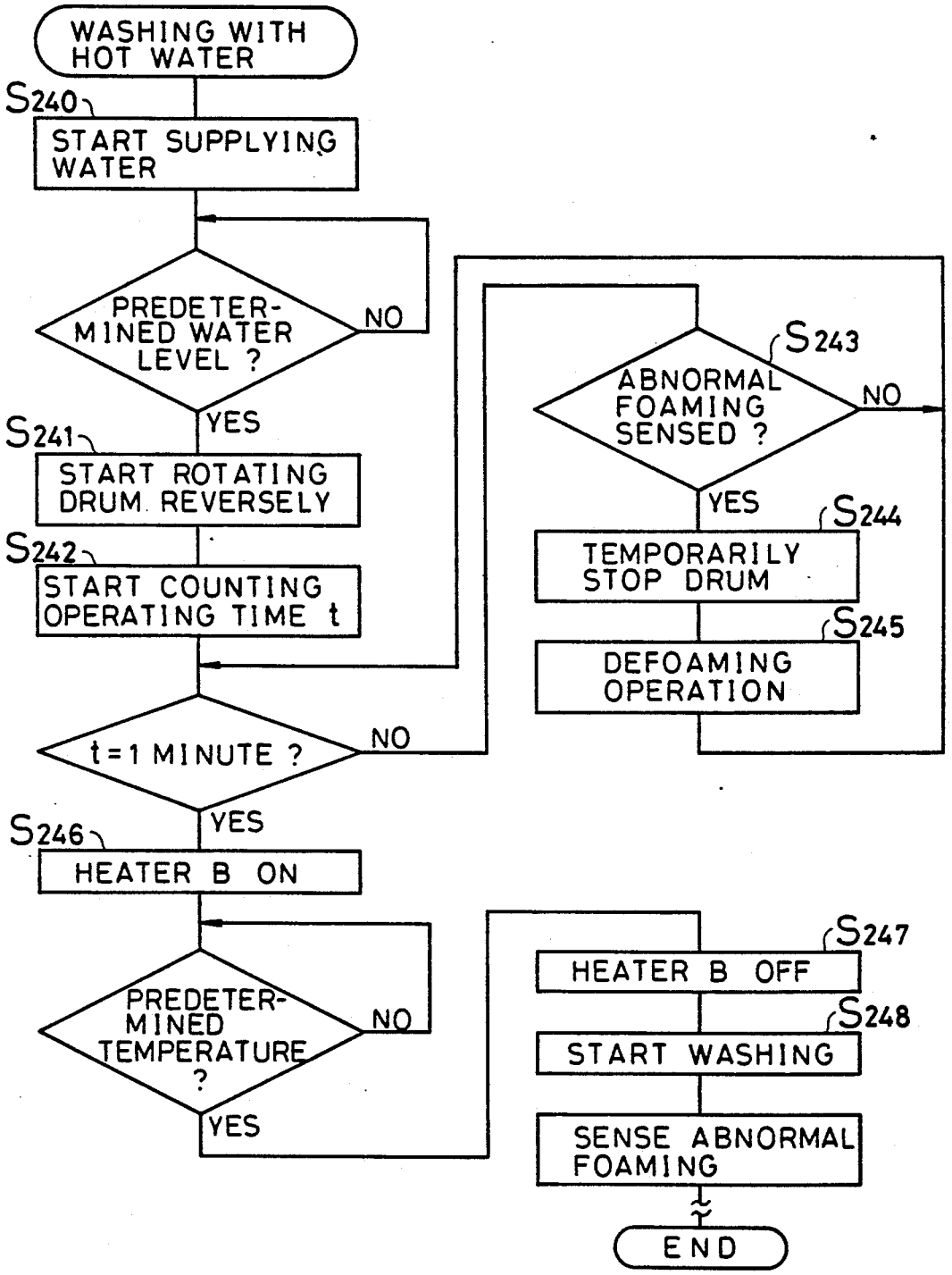

In FIG. 52, the turn-on of the heater B 68 in the washing process is delayed by 1 minute after the water supply is completed (S-240) to (S-242). If the abnormal foaming is sensed during this 1 minute (S-243), the defoaming program is carried out (S-244) (S-245). After the 1 minute has elapsed, the heater B 68 is turned on to heat the washing water (S-246) (S-247), and the washing operation is continued (S-248).

Figure 53:
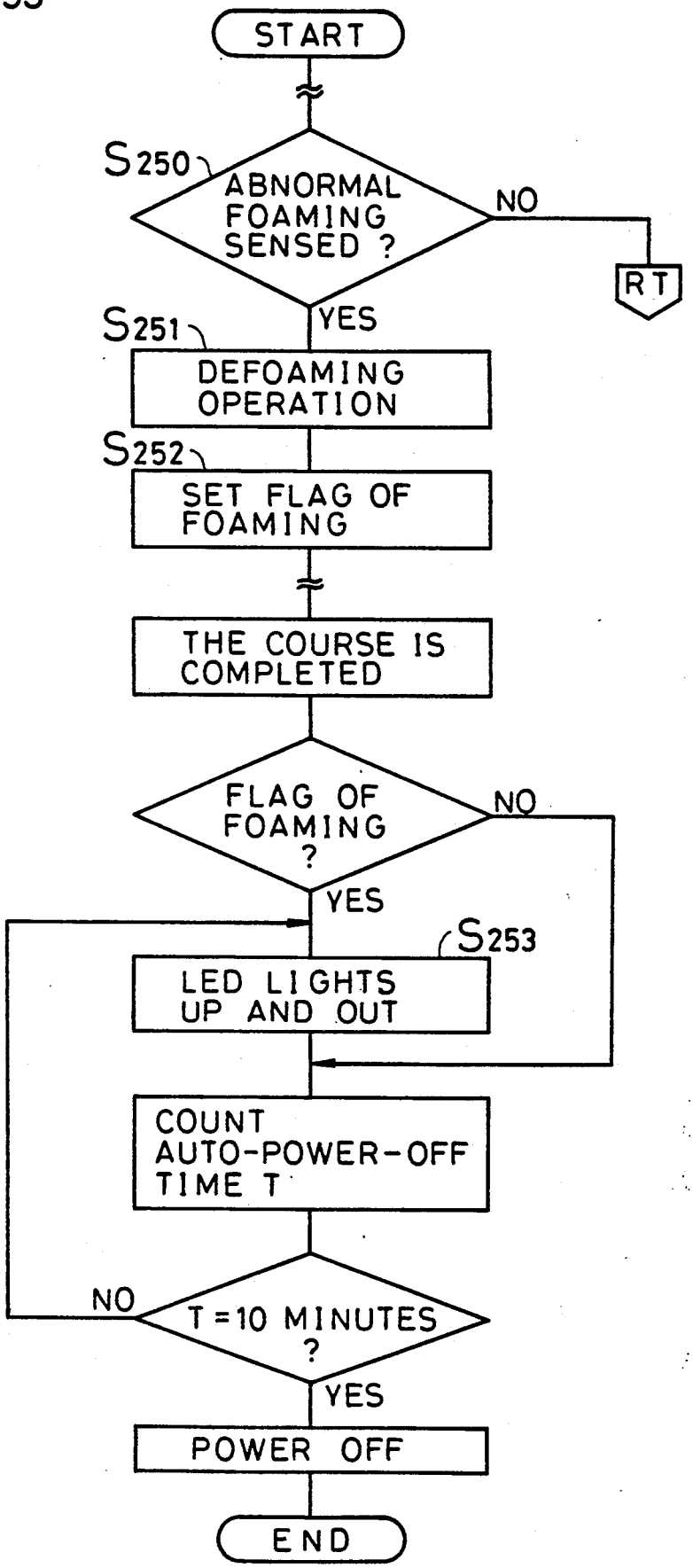

In FIG. 53, when the abnormal foaming is sensed in the washing operation and the defoaming control is carried out (S-250) (S-251), the RAM 127 stores it (S-251). After the operation is completed, the buzzing circuit 146 or the LED drive circuit 147 receives instructions to give an alarm sound or light up and out all the LEDs in the operating unit **21*a***, so as to warn the user not to overuse washing agent (S-253). Ten minutes after the completion of the operation, the power source is automatically shut off, and the warning operation of the LEDs is also completed (S-254).

In the above embodiment, similar to the embodiment described in conjunction with FIG. 36, a period of time for the water supply and drainage may be varied in accordance with the degree of the foaming.

Figure 54:
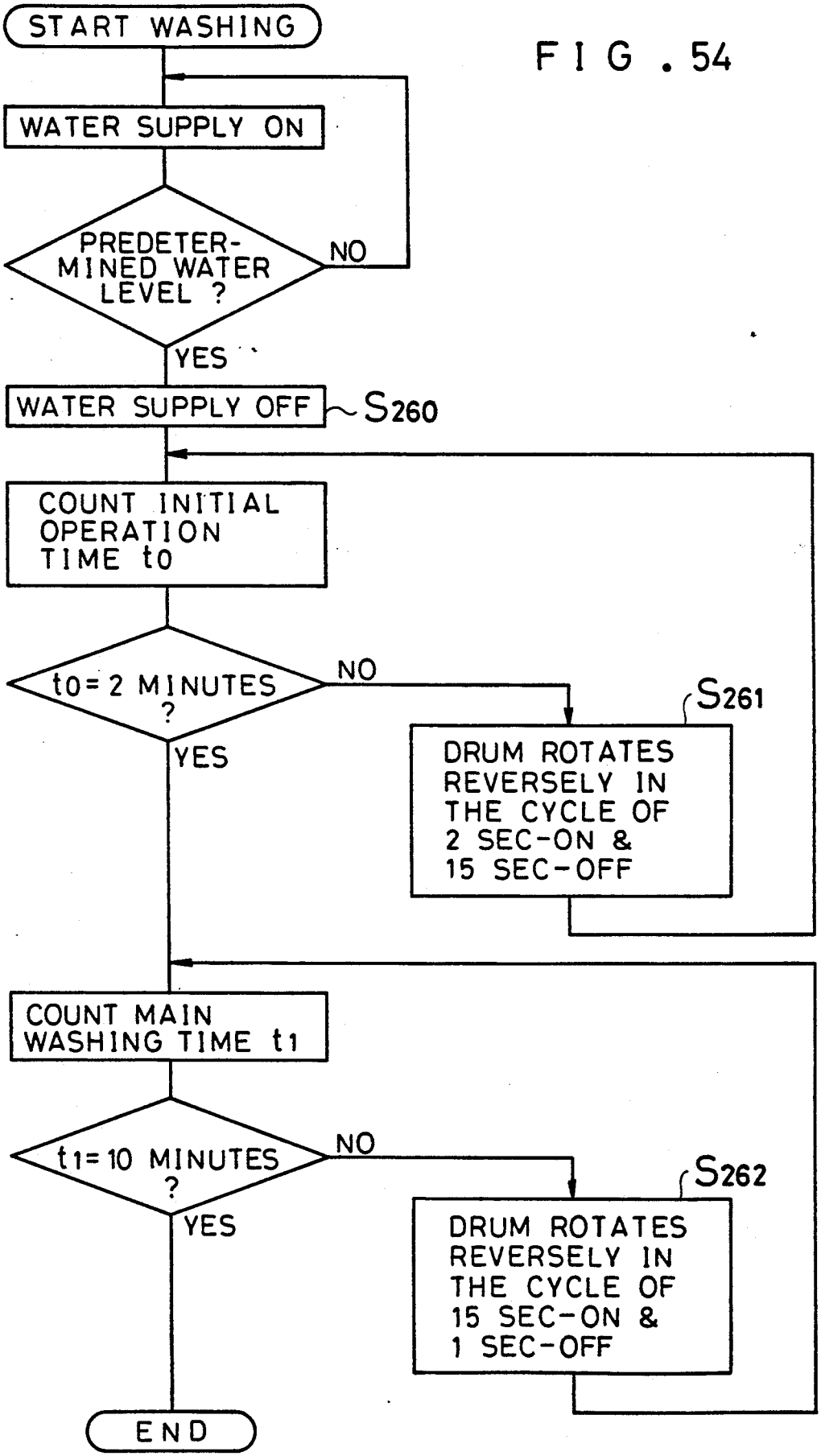
FIGS. 54 to 56 are flow charts showing different embodiments of the defoaming operation in washing the laundry.

(15) In FIG. 54, after the water supply in the washing process is completed (S-260), for initial two minutes of the drum reversal operation (for example, 12 minutes), the drum 69 is rotated reversely in the cycle of ON for 2 seconds—OFF for 15 seconds (S-261); and for the remaining period of time (10 minutes), the normal operation is carried out (S-262). Namely, the reversal cycle where a relatively long period of time is allotted for a pause is employed at the beginning of the washing. In this way, the foaming is suppressed while surface activating effect of the washing agent separates soil from the laundry into the washing water. The washing water, when made turbid by the soil, comes not to easily produce foam, and therefore, after the soil has been separated, the drum 69 is rotated in the usual reversal cycle. On the reversal operation at the step S-261, the rotating speed of the drum may be reduced through the pulse cut control instead of protracting the pause.

Figure 55:
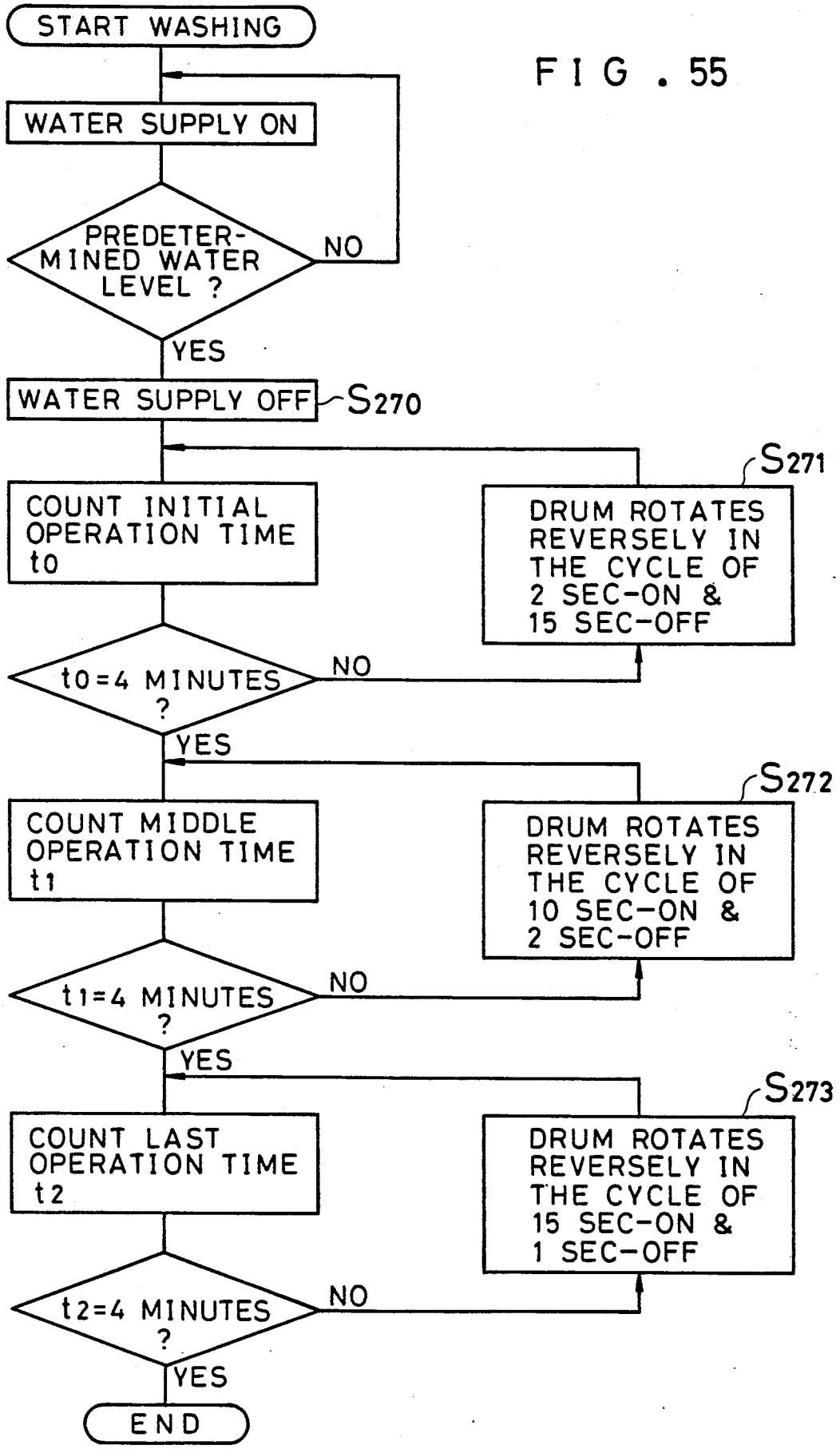

As shown in FIG. 55, the period of time for the drum reversal operation (for example, 12 minutes) is divided into three terms; first term (4 minutes), middle term (4 minutes) and last term (4 minutes). After water supply is completed (S-270), the drum 69 may be rotated in the cycle of ON for 2 seconds and OFF for 15 seconds at the first term (S-271), ON for 10 seconds and OFF for 2 seconds at the middle term (S-272) and ON for 15 seconds and OFF for 1 second at the last term (S-273).

Figure 56:
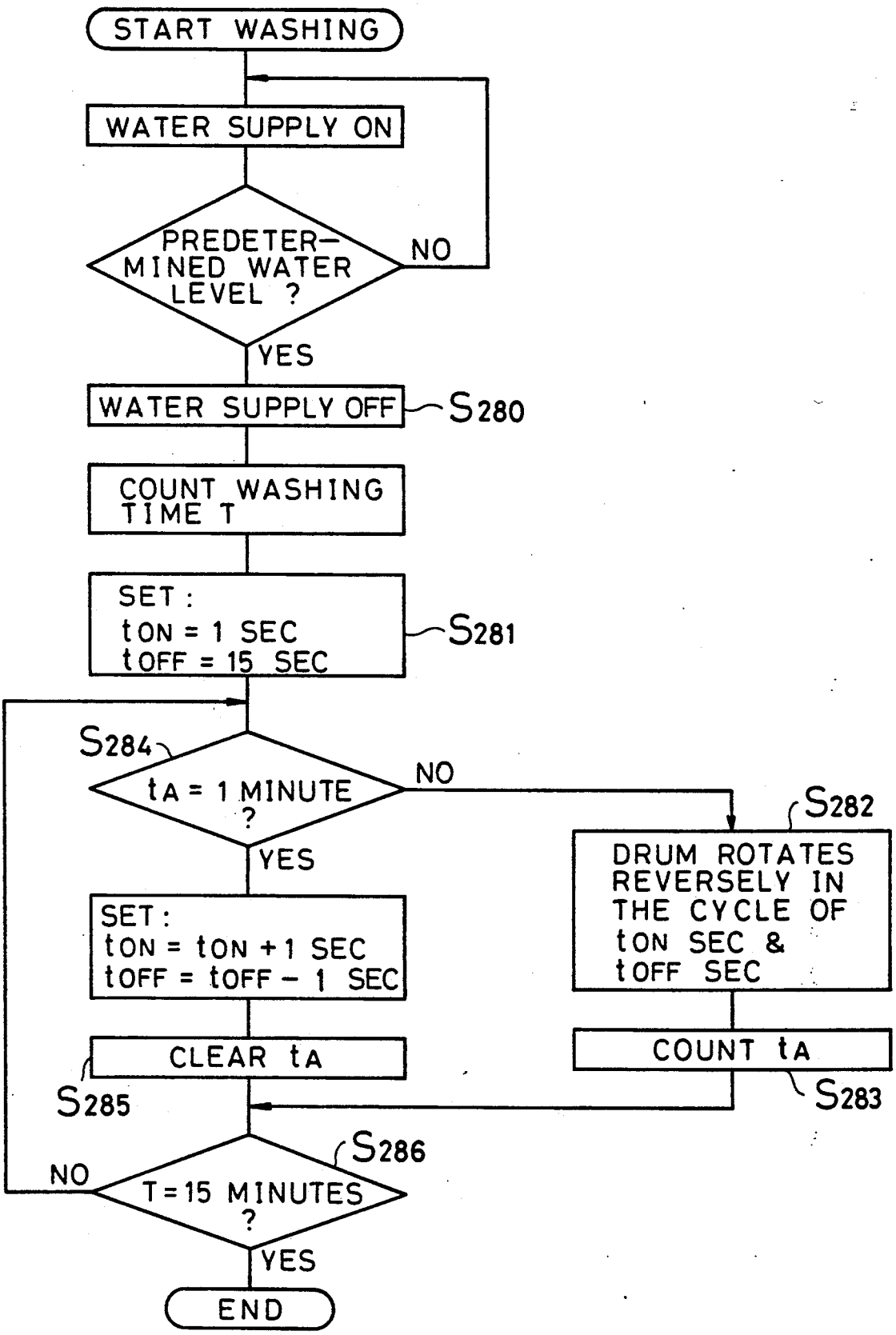

As shown in FIG. 56, after the water supply is completed (S-280), the drum reversal cycle is set ON for 1 second—OFF for 15 seconds at the beginning of a period of time T for the drum reversal operation (S-281). Then, every 1 minute elapsed, the ON-time in the reversal cycle may be increased by 1 second while the OFF-time is decreased by 1 second (S-282) to (S-286).

In an embodiment shown in FIGS. 54 to 56, the ON-time (operating time) in the drum reversal cycle at the beginning of the washing is set at 1 second or 2 seconds. This ON-time is desirably a period of time under the time necessary for a turn of the drum 69; while the drum 69 is making a turn, the laundry is carried up and dropped, and this enhances foaming. For example, if the rotating number of the drum 69 is 60 r.p.m, a turn of the drum 69 takes 1 second, and hence the above-mentioned ON-time is desirably under 1 second. According to the experiment, the optimum condition of the reversal cycle at the beginning of the washing is ¼ turn of the drum for 0.25 second.

Figure 57:
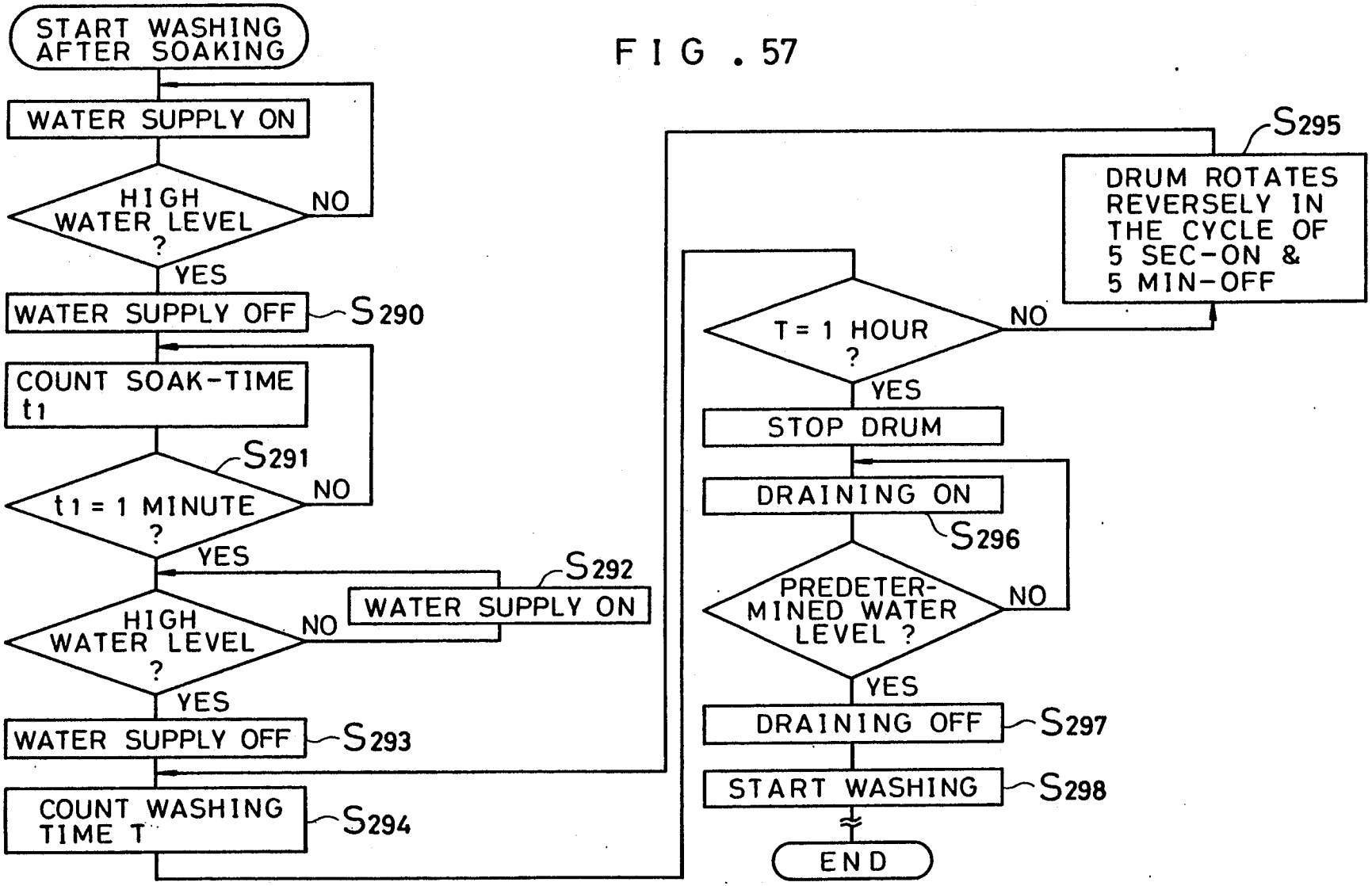
FIG. 57 is a flow chart showing the operation of washing-after-soaking.

(16) As shown in FIG. 57, a washing-after-soaking process may be carried out before the washing process by giving instructions with the keys in advance.

In the washing-after-soaking, first water is supplied at the highest water level ("High" water level) in the tub 2 (S-290), and then the laundry is left in the tub 2 for one minute (S-291). The laundry absorbs the washing water for that period, and the water level is lowered. After water is supplied to the highest water level again (S-292) (S-293), counting 1 hour begins (S-294). For that period of time, the drum 69 is rotated for five seconds every five minutes at low speed (S-295). For the five-minute pause the surface activating effect of the washing agent separates soil from the laundry, and the five-second rotating operation diffuses the soil into the washing water.

One hour after, the water level is lowered to the set level for the washing process (S-296) (S-297), and then the washing process is carried out (S-298).

While the laundry is left in the tub 2 at the step S-291, 291, the drum 69 may be rotated for a short time to force the laundry to absorb the washing water.

Figure 5:
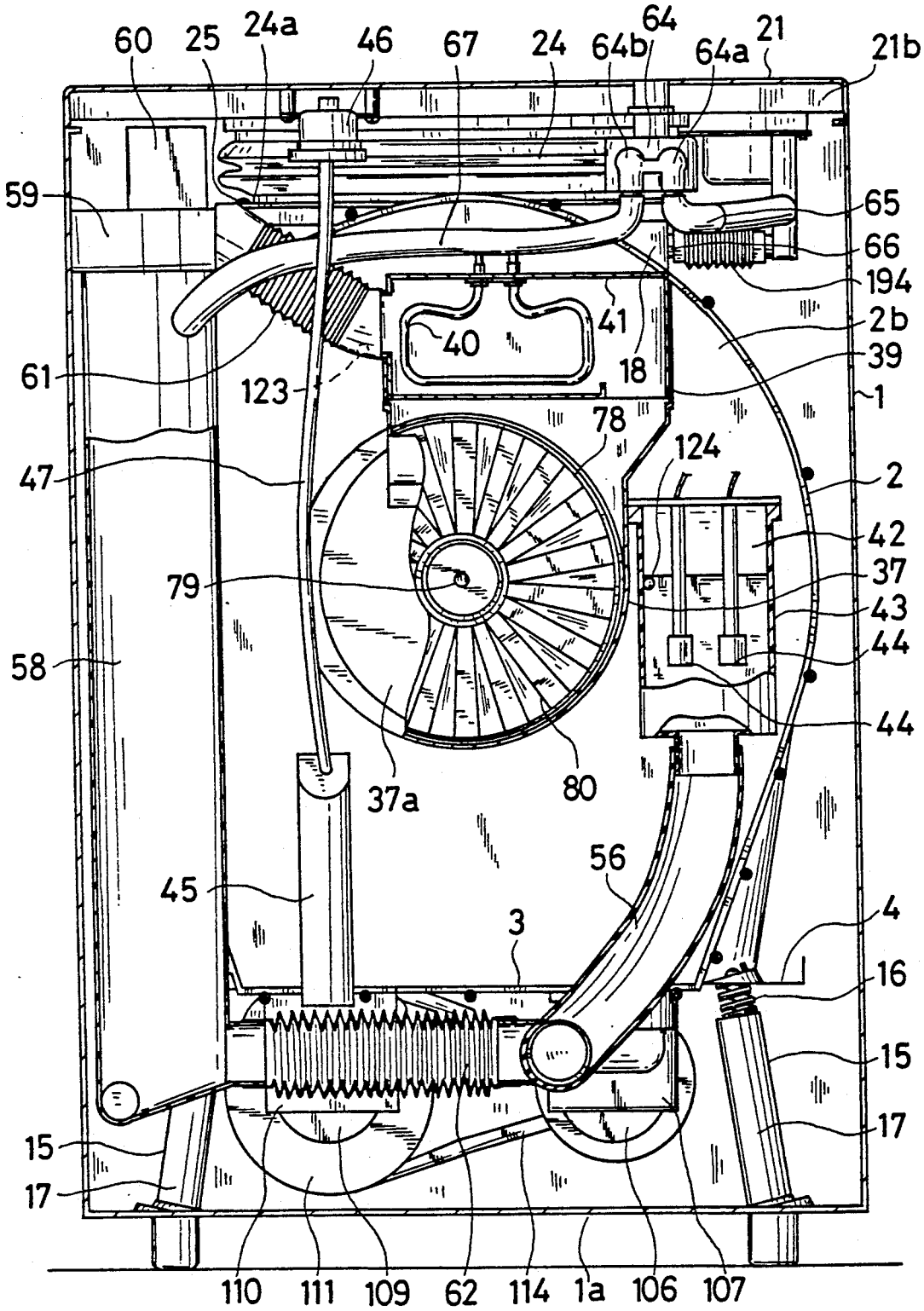
FIG. 5 is a rear elevation view showing a major portion of the washing machine.
Figure 6:
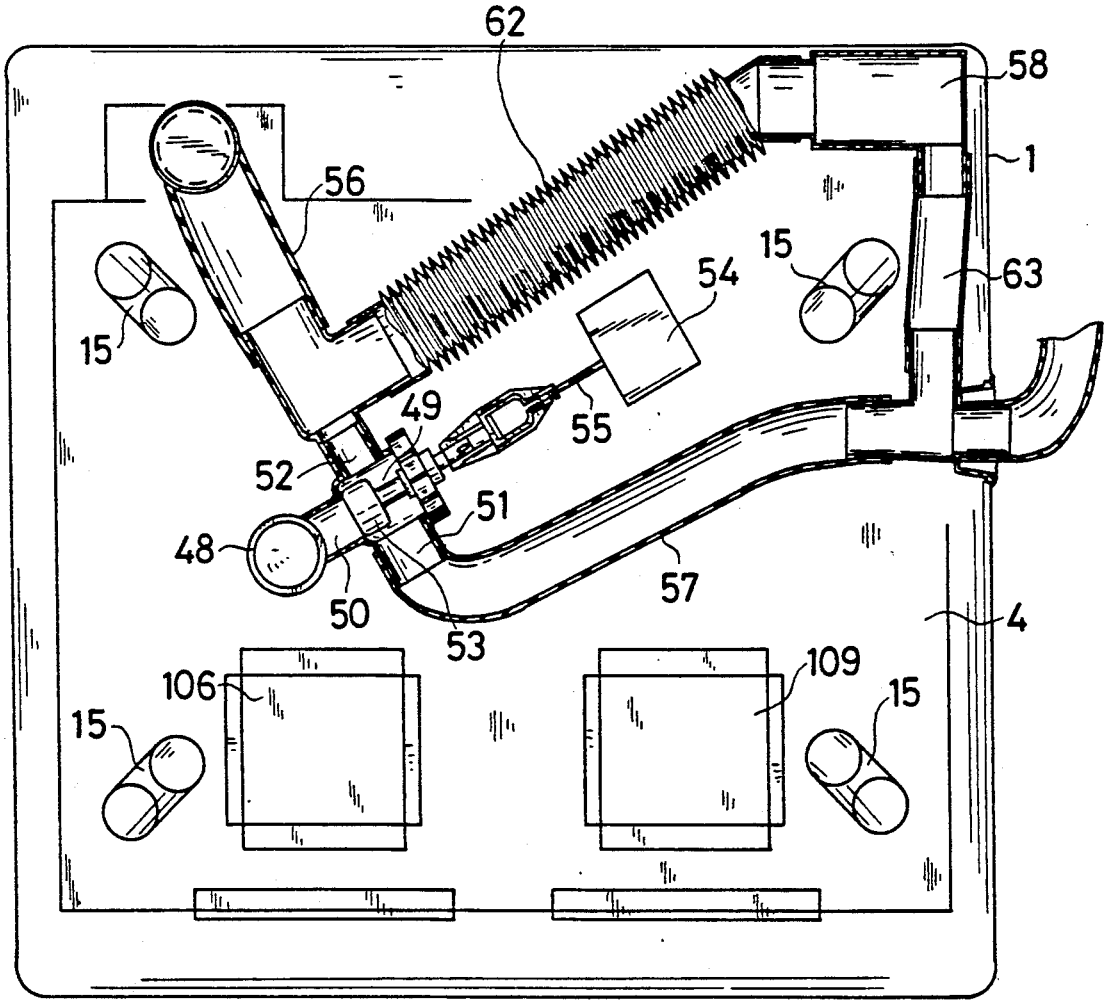
FIG. 6 is a bottom view showing the washing machine.
Figure 7:
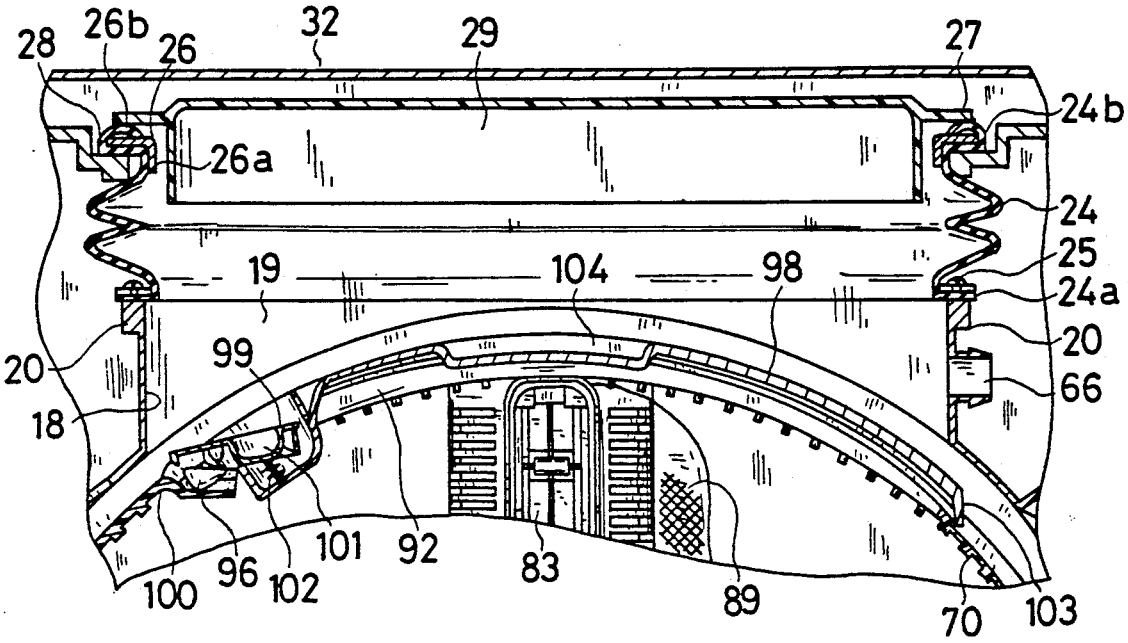
FIG. 7 is an expanded view showing a major portion of FIG. 3.
Figure 8:
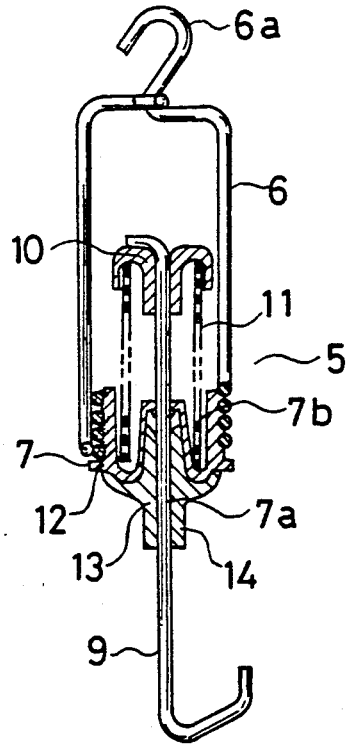
FIG. 8 is a sectional view showing a major portion of an upper supporting member.

(17) As shown in FIG. 5, a tail portion 194 of the inlet hose A 65 is horizontally held and connected to the opening 66. The tail portion 194 is shaped like bellows. The horizontal vibration of the outer tub 2 can be absorbed by the expansion and contraction of the bellows.

Figure 58:
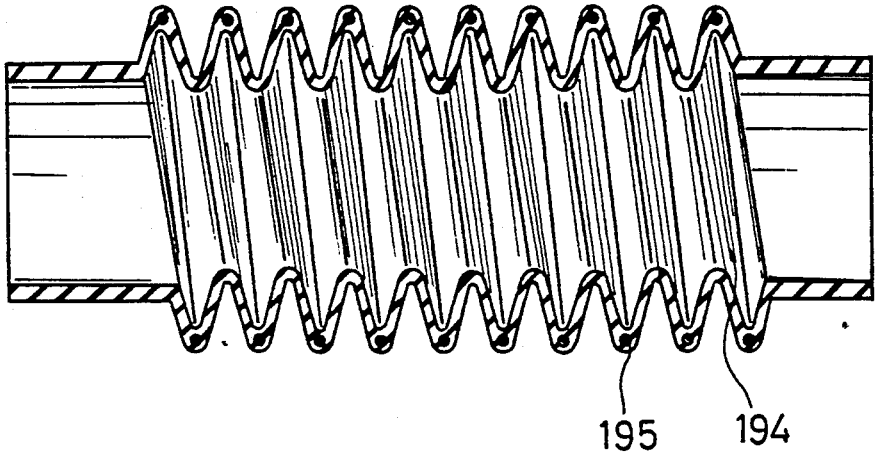
FIG. 58 is a sectional side view showing another embodiment of a tail portion of an inlet hose A.

FIG. 58 shows an example where a spring 195 is inserted into the tail portion 194. With this hose A 65, vibration absorbing effect can be further enhanced.

Figure 59:
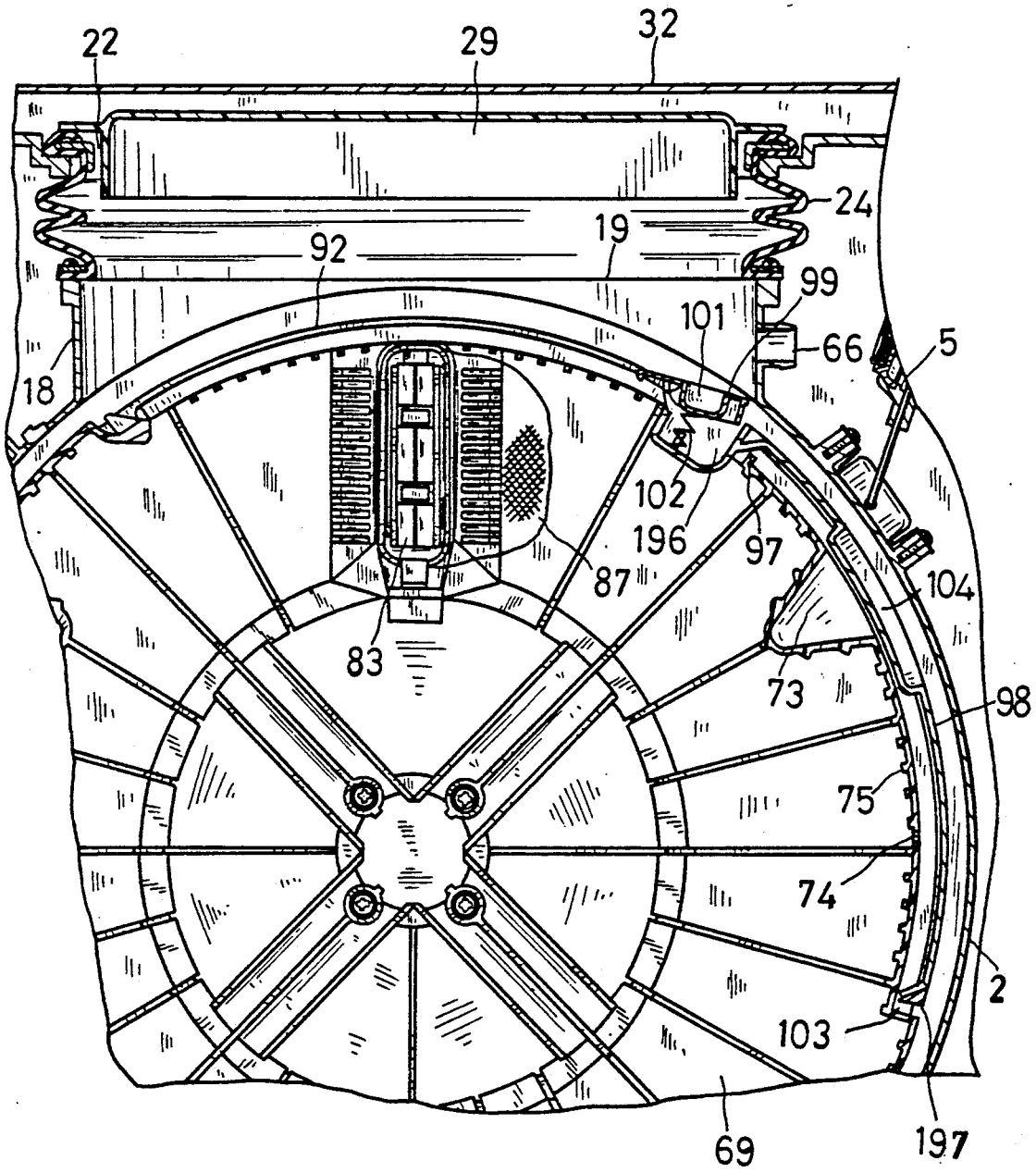
FIG. 59 is a view showing a lid released, in another embodiment corresponding to that of FIG. 7.

(18) As shown in FIG. 59, a concave portion 196 is integrally formed along one edge portion of the lid 98 to receive the pull 99, and the concave portion 196 engages with the rib 97 at the opening C 92 when the lid 98 is left opened. Thus, there is no need of providing any member to engage with the rib 97. Putting his or her hand in the concave portion 196 to open the lid 98, the user feels the shock of the engagement, and thus it is easy for the user to recognize that the lid 98 has opened completely. Additionally, the concave portion 196 is helpful for preventing the deformation of the lid 98.

(19) As shown in FIG. 59, a weight 197 is placed at an end corresponding to the openwise direction of the lid 98. The weight 197 always urges the lid 98 in the openwise direction, and thus the lid 98 is easily opened.

Figure 60:
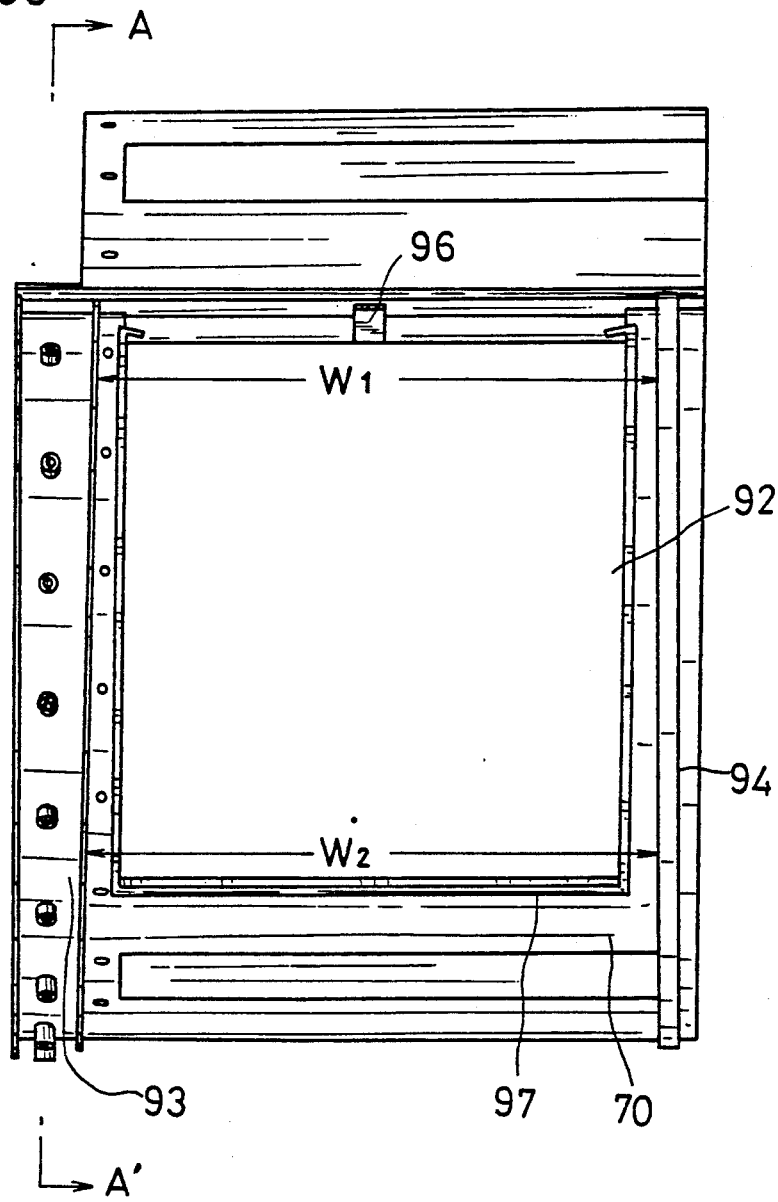
FIG. 60 is a plan view showing a trunk of a drum in another embodiment.

(20) As shown in FIG. 60, a distance W between the slide groove 93 and 94 is gradually made large along the openwise direction of the lid 98 (W1 W2). As a result, as the lid 98 approaches its opening position, the slide resistance of the lid 98 is increased. If the lid 98 is opened with considerable force, the force is relieved. Thus, the possibility that the lid 98 is accidentally damaged or it goes bump with the rib 97 can be reduced.

Figure 62:
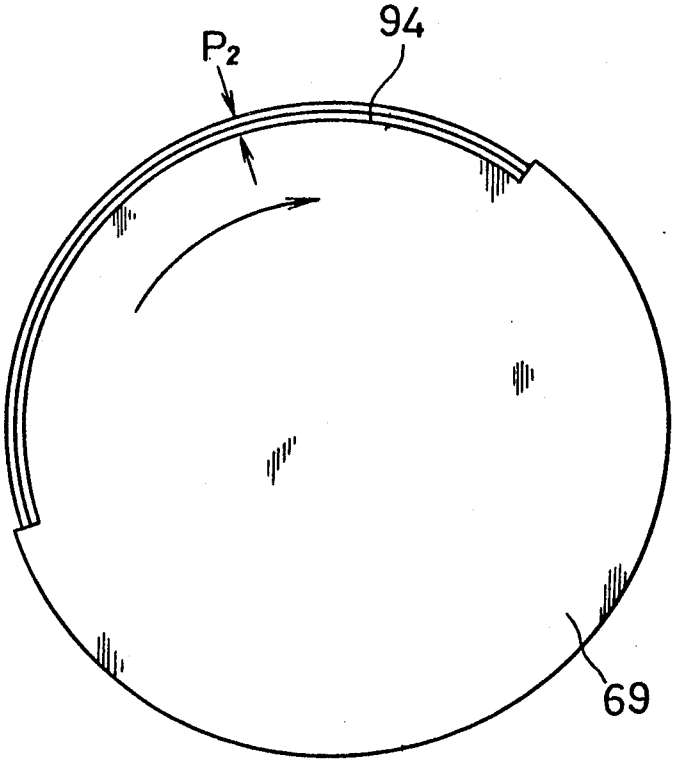
FIG. 62 is an elevational view showing the trunk of FIG. 60.
Figure 61:
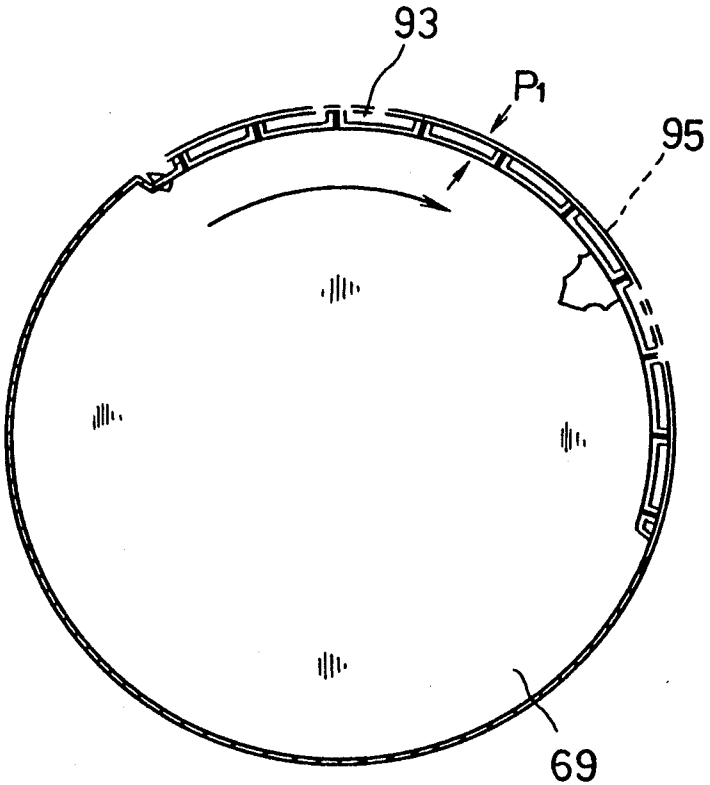
FIG. 61 is a sectional view taken along the line A—A' of FIG. 60.

As shown in FIGS. 61 and 62, the depth P1 of the slide groove 93 is gradually made small along the openwise direction (shown by the arrow in these figures), while the thickness P2 of the slide groove 94 is gradually made large along the openwise direction of the lid 98. In this way, too, the slide resistance of the lid 98 can be increased as the lid 98 approaches its opening position.

Figure 63:
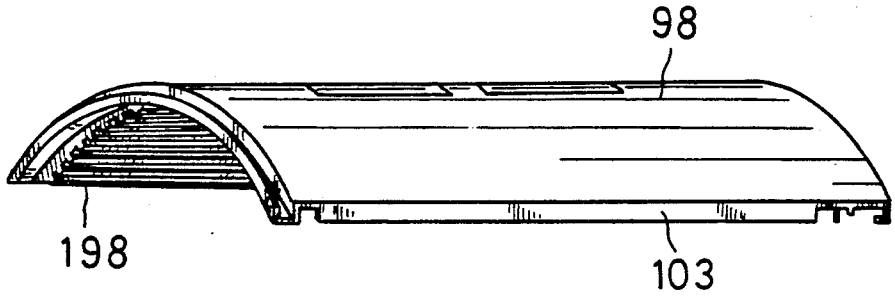
FIG. 63 is a perspective view sowing a lid in another embodiment.
Figure 64:
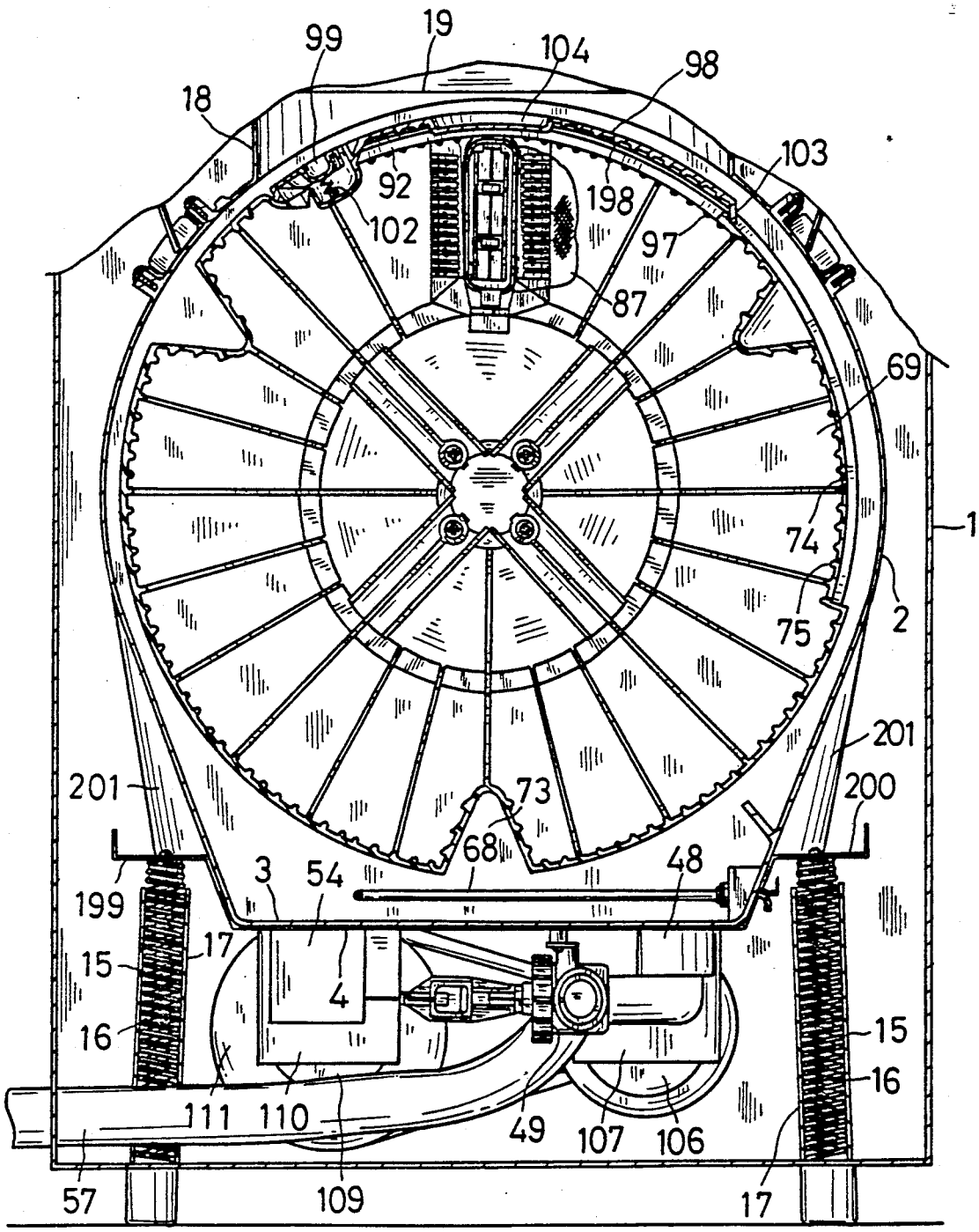
FIG. 64 is a view showing another embodiment corresponding to that of FIG. 3.

(21) As shown in FIGS. 63 and 64, horizontal ribs 198 similar to the horizontal rib 75 are integrally formed on the inner surface of the lid 98. This enhances the cleaning efficiency, and moreover, prevents the laundry from clinging to the inner surface of the lid 98. In this way, the trouble that a handkerchief and stuff like clinging to the inner surface of the lid 98 gets jammed between the lid 98 and the drum 69 when the lid 98 is opened can be avoided.

Figure 65:
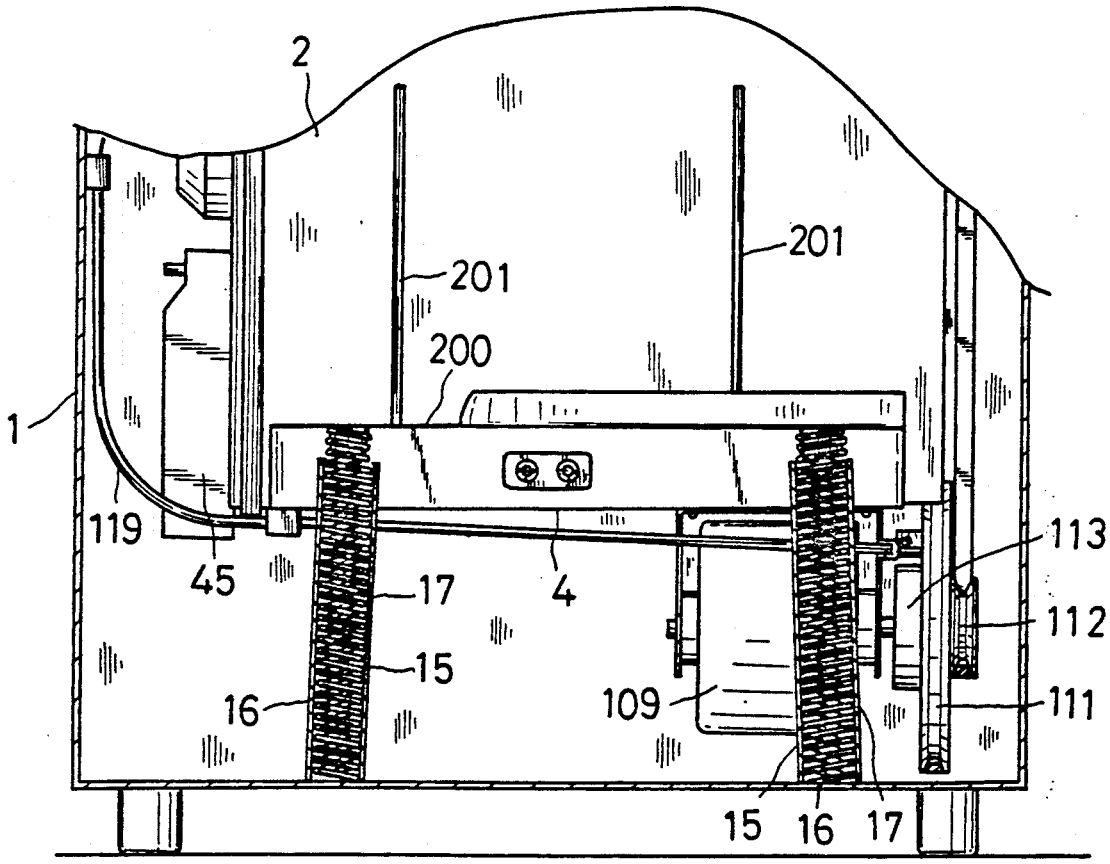
FIG. 65 is a sectional side view showing a major portion of FIG. 64.

(22) As shown in FIGS. 64 and 65, opposite ends of the mounting plate 4 are extended and bent up to form supporting portions 199, 200 protruding in the horizontal direction over the horizontal supporting face 3. The lower supporting members 15 are fixed to the supporting portions 199, 200. In this way, the lower supporting members 15 extends its entire stretch. As a result, the spring B 16 increases in the amount of expansion and contraction, and the vibration can be effectively attenuated.

Moreover, a supporting rib 201 is integrally formed on the side of the outer tub 2 to engage with the supporting portions 199, 200, so as to prevent the deformation of the supporting portions 199, 200.

What is claimed is:

1. A washing machine comprising:
an outer tub supported in a frame;
means for supplying water to said tub;
means for draining said tub;
a drum rotatably supported about a horizontal supporting shaft in said tub and formed with a plurality of bores in its peripheral wall;
means for rotating said drum;
sensing means including an overflow chamber formed in the wall of said tub and communicating to a drain pipe,
a pair of electrodes placed in said overflow chamber for sensing foam generated beyond a permissible amount in said tub in washing the laundry and producing a signal representative thereof; and
control means for settling foaming in response to the foam sensing signal from said sensing means.

2. A machine according to claim 1, wherein said sensing means further comprises a partition plate provided in said overflow chamber for separating said electrodes from an overflow outlet of said overflow chamber, so that said overflow chamber has a double-cell structure where said partition plate divides the chamber into two cells and the cells communicate to each other.

3. A machine according to claim 2, wherein said pair of electrodes are rod-shaped and held extending downwardly in said overflow chamber.

4. A machine according to claim 3, wherein said sensing means further comprises a separating plate provided between said pair of electrodes for separating them from each other.

5. A machine according to claim 4, wherein said sensing means further comprises an inlet pipe provided adjacent the position where said pair of electrodes are held for introducing water to said overflow chamber.

6. A machine according to claim 6, wherein said overflow chamber is formed with a drain outlet projecting upward and is also formed with an aperture positioned lower than said drain outlet and communicating with said tub.

7. A machine according to claim 1, wherein said control means acts in response to the signal produced by said sensing means to instruct said water supplying means to supply water to increase the amount of the water in said tub.

8. A machine according to claim 7, wherein said control means acts to instruct said drum rotating means to temporarily stop the drum in supplying water.

9. A machine according to claim 7, wherein said control means acts to instruct said drum rotating means to rotate said drum at low speed in supplying water.

10. A machine according to claim 7, wherein said control means acts to instruct said water supplying means to intermittently supply water in said tub.

11. A machine according to claim 1, wherein said control means acts in response to the signal produced by said sensing means to instruct said water supplying means to supply water and increase the amount of the water in said tub and to instruct said draining means to drain said tub by a predetermined amount of the water.

12. A machine according to claim 11, wherein said control means acts to instruct said drum rotating means to temporarily stop the drum in supplying water.

13. A machine according to claim 11, wherein said control means acts to instruct said drum rotating means to rotate said drum at low speed in supplying water.

14. A machine according to claim 11, wherein said control means acts to instruct said water supplying means to intermittently supply water in said tub.

15. A machine according to claim 1, further comprising means for blowing air into said tub onto the foam therein, wherein said control means acts to instruct said blowing means to blow air while water is being supplied to and/or is being drained from said tub.

16. A machine according to claim 1, further comprising heating means for raising the temperature of the water in said tub, wherein said control means acts to instruct said water supplying means and/or said draining means to supply water in said tub and/or to drain said tub in a predetermined time from the beginning of the washing, and then it acts to instruct said heating means to raise the temperature of the water.

17. A washing machine comprising:
an outer tub supported in a frame;
means for supplying water to said tub;
means for draining said tub;
a drum rotatably supported about a horizontal supporting shaft in said tub and formed with a plurality of bores in its peripheral wall;
means for rotating said drum;
means for sensing foam generated beyond a permissible amount in said tub in washing the laundry; and
control means for settling foaming in response to a foam sensing signal from said sensing means said control means acting to instruct said drum rotating means to stepwise increase operating time per unit time.

18. A washing machine comprising:
an outer tub supported in a frame;
means for supplying water to said tub;
means for draining said tub;
a drum rotatably supported about a horizontal supporting shaft in said tub and formed with a plurality of bores in its peripheral wall;
means for rotating said drum;
means for sensing foam generated beyond a permissible amount in said tub in washing the laundry;
control means for settling foaming in response to a foam sensing signal from said sensing means; and
alarm means to alert a user that the foaming has been settled by supplying water in said tub and/or draining said tub, said control means acting to instruct said alarm means to give warning in response to a stored signal corresponding to the foaming having been settled, after the completion of the washing including washing, rinsing, hydroextracting, or drying operation.

19. A washing machine comprising:
an outer tub supported in a frame;
means for supplying water to said tub;
means for draining said tub;
a drum rotatably supported about a horizontal supporting shaft in said tub and formed with a plurality of bores in its peripheral wall;
means for rotating said drum;
sensing means for sensing foam generated beyond a permissible amount in said tub in washing the laundry;
control means for settling foaming in response to a foam sensing signal from said sensing means; and
means for estimating the degree of the foaming based upon the length of period from a certain point of time to a point of time when the foam sensing signal is received from said sensing means, said control means acting to instruct.

* * * * *

UNITED STATES PATENT AND TRADEMARK OFFICE

CERTIFICATE OF CORRECTION

PATENT NO. : 5,038,586

DATED : August 13, 1991

INVENTOR(S) : Tadashi Nukaga, et al

It is certified that error appears in the above-identified patent and that said Letters Patent is hereby corrected as shown below:

Column 25, claim 6, line 1, delete "claim 6" and substitute --claim 5--.

The drawing sheet 48 of 52, consisting of Fig. 59, should be deleted, to be replaced with the drawing sheet, consisting of Fig. 49, as shown on the attached page.

Sheet 48 & 52 (1st occurrence) should be deleted and replaced with sheet 38 & 52 consisting of Figure 49 as shown on the attached sheet.

Signed and Sealed this

Twenty-ninth Day of June, 1993

*Attest:*

Michael K. Kirk

MICHAEL K. KIRK

*Attesting Officer*

*Acting Commissioner of Patents and Trademarks*